US007942412B2

(12) United States Patent
Sato

(10) Patent No.: US 7,942,412 B2
(45) Date of Patent: May 17, 2011

(54) DRIVE CONTROL METHOD AND APPARATUS FOR SHEET PROCESSING MACHINE

(75) Inventor: Toshiyuki Sato, Ibaraki (JP)

(73) Assignee: Komori Corporation, Tokyo (JP)

( * ) Notice: Subject to any disclaimer, the term of this patent is extended or adjusted under 35 U.S.C. 154(b) by 238 days.

(21) Appl. No.: 12/220,257

(22) Filed: Jul. 23, 2008

(65) Prior Publication Data

US 2009/0033027 A1 Feb. 5, 2009

(30) Foreign Application Priority Data

Aug. 3, 2007 (JP) ..... 2007-202843

(51) Int. Cl.
*B65H 5/04* (2006.01)

(52) U.S. Cl. ..... 271/275; 271/314

(58) Field of Classification Search ..... 27/69, 314, 27/275; 399/394; 101/248, 481, 484, 485; 271/69, 314, 275
See application file for complete search history.

(56) References Cited

U.S. PATENT DOCUMENTS

| | | | | |
|---|---|---|---|---|
| 4,451,027 | A * | 5/1984 | Alper | 271/10.02 |
| 2006/0153604 | A1 * | 7/2006 | Matsuda et al. | 399/301 |

FOREIGN PATENT DOCUMENTS

| | | |
|---|---|---|
| CN | 1652937 A | 8/2005 |
| DE | 44 44 755 A 1 | 8/1995 |
| DE | 100 44 068 A 1 | 4/2001 |
| EP | 0 922 657 A1 | 6/1999 |
| JP | 62-026344 | 2/1987 |
| JP | 03-023138 | 3/1991 |
| JP | 09-255183 | 9/1997 |

* cited by examiner

*Primary Examiner* — Stefanos Karmis
*Assistant Examiner* — Michael C McCullough
(74) *Attorney, Agent, or Firm* — Blakely, Sokoloff, Taylor & Zafman

(57) ABSTRACT

A drive control method for a sheet processing machine includes the steps of operating a driving motor of a sheet feed device which feeds a sheet to a sheet processing device that processes the sheet, in synchronism with a rotary member of the sheet processing device, and adjusting a rotary phase of the rotary member of the sheet processing device and a rotary phase of the driving motor of the sheet feed device relative to each other.

16 Claims, 57 Drawing Sheets

OFFSET SHEET-FED PRINTING PRESS
FEEDER
θPO (SYNCHRONOUS STANDBY POSITION)
θFO (ORIGIN POSITION)
T
θPR
θFR
θFA

θPO
T
θPR
T
θPT
Δ θPRT
θFO
θFR
θFA
θFB

θPO
T
θPR
θFO
θFR
θFA
θFA'
HA+HB+HC

θPO
T
θPR
θFO
θFA
Δ θFRA'
θFA'

DRIVE CONTROL METHOD AND APPARATUS FOR SHEET PROCESSING MACHINE

BACKGROUND OF THE INVENTION

The present invention relates to a drive control method and apparatus for a sheet processing machine which processes a sheet.

Conventionally, as a sheet processing machine of this type, a sheet-fed rotary printing press comprising a printing press main body (sheet processing device) and feed device (sheet supply device) is known as described in, e.g., reference 1 (Japanese Utility Model Laid-Open No. 62-26344) and reference 2 (Japanese Patent Laid-Open No. 9-255183). A plurality of conveyor tapes which extend on a feeder board and convey paper (sheet), a feedboard on which the conveyed sheet travels smoothly, a register device which is located at the distal end of the feedboard and aligns the registration of the sheet in the circumferential direction and lateral direction, and a swing arm shaft pregripper which supplies the registered sheet to the printing press main body are arranged between the feed device and printing press main body of the sheet-fed rotary printing press.

FIGS. 23 and 24 show the side structure and perspective structure of the feed convey unit of a sheet-fed rotary printing press described in reference 1. FIG. 23 shows a feed device (feeder) 101 and printing press main body 102. As the printing press main body 102, only one of a plurality of printing units is shown.

The feed device 101 comprises a pile board 104 on which sheets 103 are stacked and which is lifted as the sheets 103 are fed to reduce its weight, a suction device (not shown) which grips the sheets (stacked sheets) 103 on the pile board 104 one by one from the upper layer and sends them to a portion between a pair of upper and lower feed rollers 105 and 106, and the like. Each printing unit of the printing press main body 102 comprises a plate cylinder 107 with a plate mounted on its surface, a blanket cylinder 108 in contact with the plate cylinder 107, and an impression cylinder 109 which is in contact with the blanket cylinder 108 and applies a printing pressure to the sheet 103 passing between the blanket cylinder 108 and impression cylinder 109. A transfer cylinder 110 is arranged between the impression cylinders 109 of adjacent printing units to transfer the sheet 103 between them.

A feeder board 111 extends between the feed rollers 105 and 106 and the front end of the printing press main body 102 to be inclined slightly. A pair of front and rear rollers 112 and 113 which are pivotally, axially supported are disposed near the front and rear ends of the feeder board 111. A plurality of conveyor tapes 114 extend between the rollers 112 and 113 to line up in the widthwise direction of the feeder board 111 such that their upper traveling portions are in contact with the feeder board 111.

A small frame 115 (FIG. 24) which supports the rollers 112 and 113 and feeder board 111 is fixed to the printing press main body 102. A feedboard 116 with almost the same width as that of the feeder board 111 extends in front (downstream in the convey direction) of the small frame 115 at a predetermined gap from the front end of the small frame 115 to be inclined at an angle of inclination almost the same as that of the feeder board 111. A circumferential direction register device comprising a front lay 117 and the like is arranged at the front end of the feedboard 116. A swing arm shaft pregripper 118 grips the sheet 103 that has stopped as it abuts against the front lay 117, and swings to gripping-change the sheet 103 to the gripper of the impression cylinder 109.

A stay 119 is disposed between the small frame 115 and feedboard 116 with its two ends being fixed by a pair of left and right frames 120. A side lay device 121 which aligns the registration in the circumferential direction of the sheet 103 under conveyance is mounted on each of the two ends of each frame 120 such that the side lay device 121 can movable and adjustable in the widthwise direction of the feeder board 111. One convey plate 123 which constitutes a convey table together with the stay 119, and a plurality of convey plates 124 line up on the stay 119 in the widthwise direction of the feeder board 111.

In this sheet-fed rotary printing press, the suction device grips the sheets 103 stacked on the pile board 104 one by one and feeds them forward. The feed rollers 105 and 106 which rotate in contact with each other vertically capture the sheet 103 and feed it onto the conveyor tapes 114, and the conveyor tapes 114 convey the sheet 103. The conveyed sheet 103 is released from the conveyor tapes 114 at the position of the roller 112, is supplied onto the feedboard 116 and smoothly travels on the feedboard 116, and abuts against the front lay 117 to stop there. At this time, the sheet 103 is registered in the circumferential direction by the front lay 117 and in the lateral direction by the side lay devices 121. The swing arm shaft pregripper 118 grips the sheet 103 that has been registered in the circumferential direction and lateral direction. After that, the swing arm shaft pregripper 118 gripping-changes the sheet 103 to the gripper of the impression cylinder 109, and the sheet 103 is printed while being conveyed.

In this sheet-fed rotary printing press, when transferring the sheet 103 from, e.g., the suction device to the feed rollers 105 and 106 and from the feed rollers 105 and 106 to the conveyor tapes 114, slippage may occur between the sheet 103 and the feed rollers 105 and 106 and between the sheet 103 and the conveyor tapes 114, so that the timing to transfer the sheet 103 to the swing arm shaft pregripper 118 may shift accordingly. If this change in timing increases, printing cannot be performed at the correct position on the sheet 103, causing defective printing. In view of this, rotary phase adjustment is performed. That is, the rotary phase of the feed device 101 with respect to that of the printing press main body 102 is adjusted, so that the timing to transfer the sheet 103 to the swing arm shaft pregripper 118 is set at an appropriate timing.

In the conventional sheet-fed rotary printing press, as shown in FIG. 25, the feed device 101 is connected to the printing press main body 102 through a clutch 125, and a prime motor 126 of the printing press main body 102 drives the feed device 101. Hence, if the timing to transfer the sheet 103 to the swing arm shaft pregripper 118 changes during printing, the printing press must be stopped temporarily, the clutch 125 must be "disconnected", and the operator must adjust the rotary phase of the feed device 101 manually. After the adjustment, whether or not the rotary phase is adjusted correctly cannot be checked unless "connecting" the clutch 125 to drive the printing press and feeding the sheet 103. Hence, adjustment must be repeated a number of times to impose the load to the operator. Also, the adjustment takes time to degrade the operation efficiency. Also, unwanted waste paper is generated (first problem).

The amount of slippage described above which occurs when transferring the sheet 103 changes depending on the printing conditions such as the speed of the printing press (speed of final printing), the size, thickness, and quality of the sheet 103, and the like. Every time the printing conditions are changed, the operator must adjust the rotary phase of the feed device 101 manually, thus causing a problem (second problem) similar to the first problem.

In the example described above, the rotary phase of the feed device with respect to the rotary phase of the printing press main body is adjusted. The same problems also arise when adjusting the rotary phase of the printing press with respect to the rotary phase of the feed device.

In the example described above, the feed device employs the conveyor tapes. The same problems also arise in a roll type feed device, as described in reference 3 (Japanese Utility Model Laid-Open No. 3-23138), which does not employ conveyor tapes. In the roll type feed device, a sheet is fed to a portion between a feed roller and feed roll, and is conveyed on a feedboard by rotational driving of the feed roller. In this case, slippage occurs only when supplying the sheet from a suction device to the portion between the feed roller and feed roll.

SUMMARY OF THE INVENTION

The present invention has been made to solve the above problems, and has as its object to enable rotary phase adjustment operation in a sheet processing machine to be done easily within a short period of time.

In order to achieve the above object, according to one aspect of the present invention, there is provided a drive control method for a sheet processing machine, comprising the steps of operating a driving motor of a sheet feed device which feeds a sheet to a sheet processing device that processes the sheet, in synchronism with a rotary member of the sheet processing device, and adjusting a rotary phase of the rotary member of the sheet processing device and a rotary phase of the driving motor of the sheet feed device relative to each other.

According to another aspect of the present invention, there is also provided a drive control apparatus for a sheet processing machine, comprising synchronous operation means for operating a driving motor of a sheet feed device which feeds a sheet to a sheet processing device that processes the sheet, in synchronism with a rotary member of the sheet processing device, and rotary phase adjustment means for adjusting a rotary phase of the rotary member of the sheet processing device and a rotary phase of the driving motor of said sheet feed device relative to each other.

BRIEF DESCRIPTION OF THE DRAWINGS

FIGS. 5A to 10 are flowcharts showing the processing operation of the drive control device of the offset sheet-fed printing press shown in FIG. 1, in which FIGS. 5A to 5D are flowcharts showing the processing operation including setting printing conditions, printing start, calculation of a rotary phase correction value of the feeder which is specific to a printing target object, slower rotation of the offset sheet-fed printing press, and restoration of the feeder to the origin, FIG. 10 is a flowchart showing the processing operation of standalone operation of the offset sheet-fed printing press;

FIGS. 11 to 14 are flowcharts showing the processing operation performed by the drive control device of the feeder shown in FIG. 2, in which FIG. 11 is a flowchart showing the processing operation of restoration of the feeder to the origin.

FIG. 14 is a flowchart showing the processing operation of the standalone operation of the feeder;

DESCRIPTION OF THE PREFERRED EMBODIMENT

An embodiment of the present invention will be described in detail with reference to the accompanying drawings. FIGS.

1 and 2 show the configuration of a drive control system for a sheet-fed rotary printing press as an embodiment of a drive control apparatus for a sheet processing machine according to the present invention. The drive control system for the sheet-fed rotary printing press comprises a drive control device 100 of a printing press main body (to be referred to as an offset sheet-fed printing press hereinafter) and a drive control device 200 for a feed device (feeder). The drive control device 100 of the offset sheet-fed printing press and the drive control device 200 of the feeder are connected to each other via a communication line.

Figure 1:
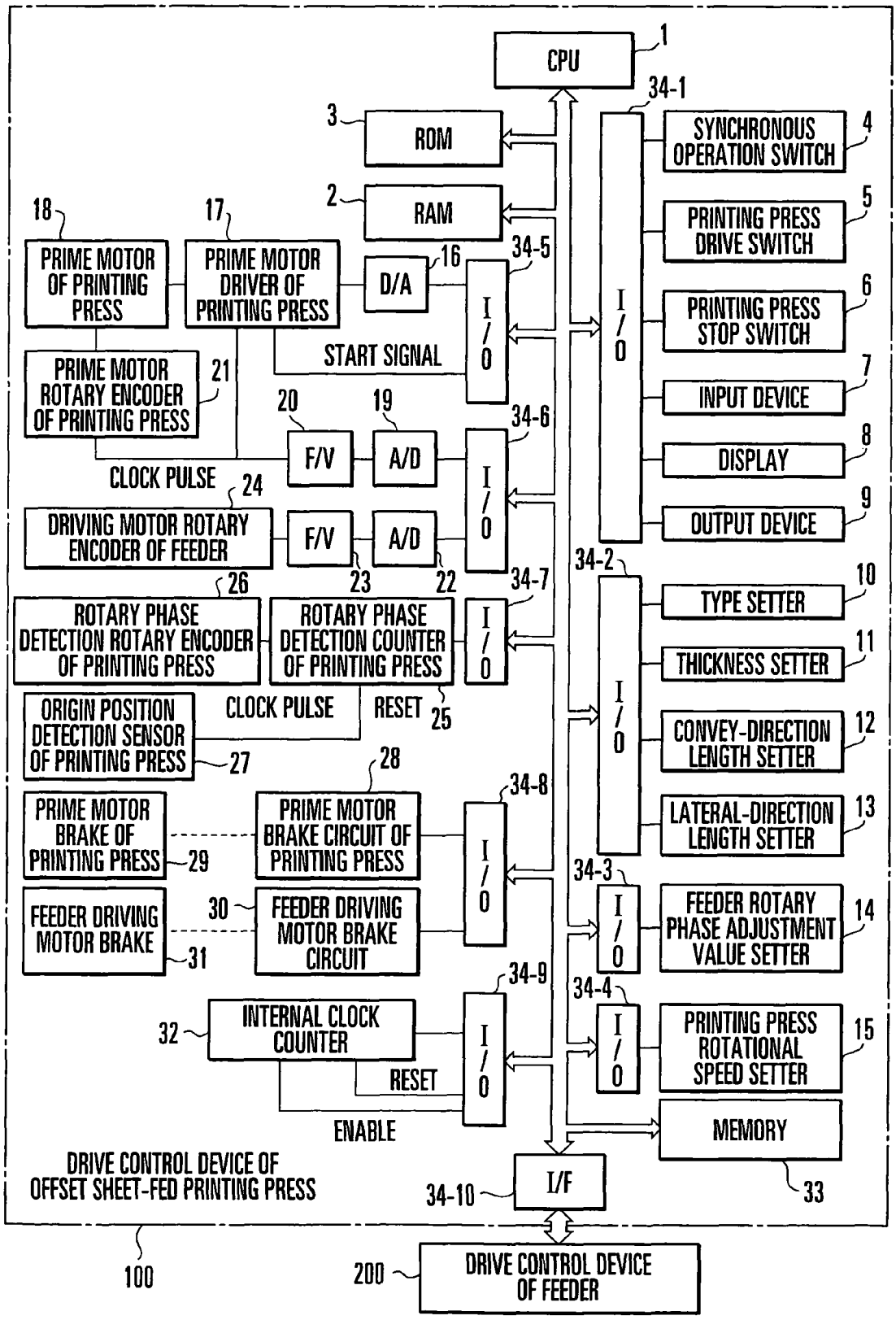
FIGS. 1 and 2 are block diagrams showing the configuration of a drive control system for a sheet-fed rotary printing press as an embodiment of a drive control apparatus for a sheet processing machine according to the present invention, in which FIG. 1 mainly shows the outline of the internal configuration of the drive control device of an offset sheet printing press, and FIG. 2 mainly shows the outline of the internal configuration of the drive control device of a feeder.

As shown in FIG. 1, the drive control device 100 of the offset sheet-fed printing press comprises a CPU 1, a ROM 3, a synchronous operation switch 4, an offset sheet-fed printing press drive switch 5, a printing press stop switch 6, an input device 7, a display 8, an output device 9 such as an FD drive or printer, a printing target object type setter 10, a printing target object thickness setter 11, a length setter 12 for a printing target object in the convey direction (circumferential direction), a length setter 13 for the printing target object in the lateral direction (widthwise direction; a direction perpendicular to the convey direction), a rotary phase adjustment value setter 14 of the feeder, a rotational speed setter 15 for the offset sheet-fed printing press, a D/A converter 16, a prime motor driver 17 of the offset sheet-fed printing press, a prime motor 18 of the offset sheet-fed printing press, A/D converters 19 and 22, F/V converters 20 and 23, a rotary encoder 21 for an offset sheet-fed printing press prime motor, a driving motor rotary encoder 24 of the feeder, a rotary phase detection counter 25 of the offset sheet-fed printing press, a rotary phase detection rotary encoder 26 of the offset sheet-fed printing press, an origin position detection sensor 27 of the offset sheet-fed printing press, a prime motor brake circuit 28 of the offset sheet-fed printing press, a prime motor brake 29 of the offset sheet-fed printing press, a driving motor brake circuit 30 of the feeder, a driving motor brake 31 of the feeder, an internal clock counter 32, a memory 33, and interfaces (I/O and I/F) 34-1 to 34-10.

Figure 3A:
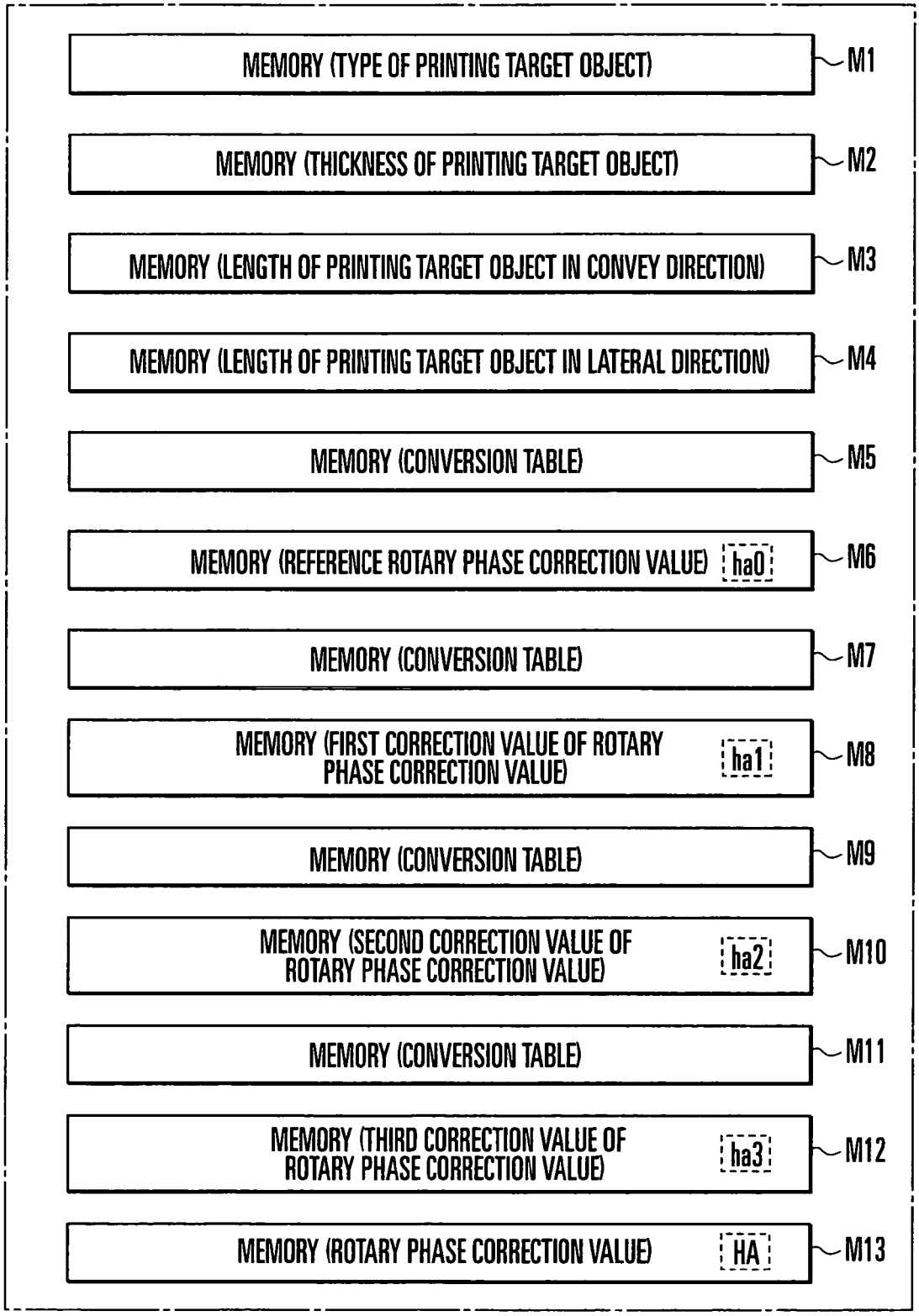
FIGS. 3A to 3C are block diagrams divisionally showing the configuration of a memory in the drive control device of the offset sheet-fed printing press shown in FIG. 1.
Figure 3B:
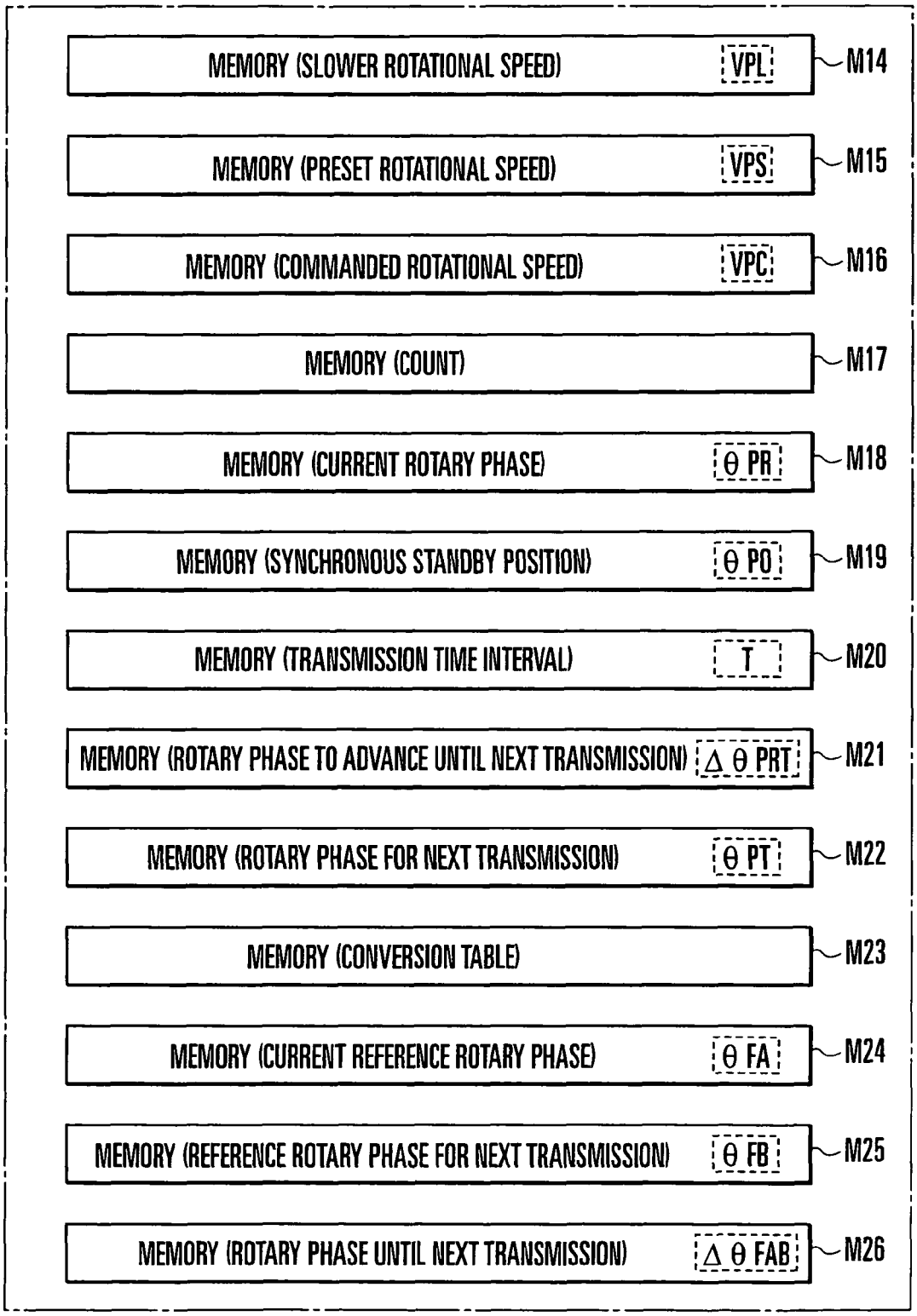
Figure 3C:
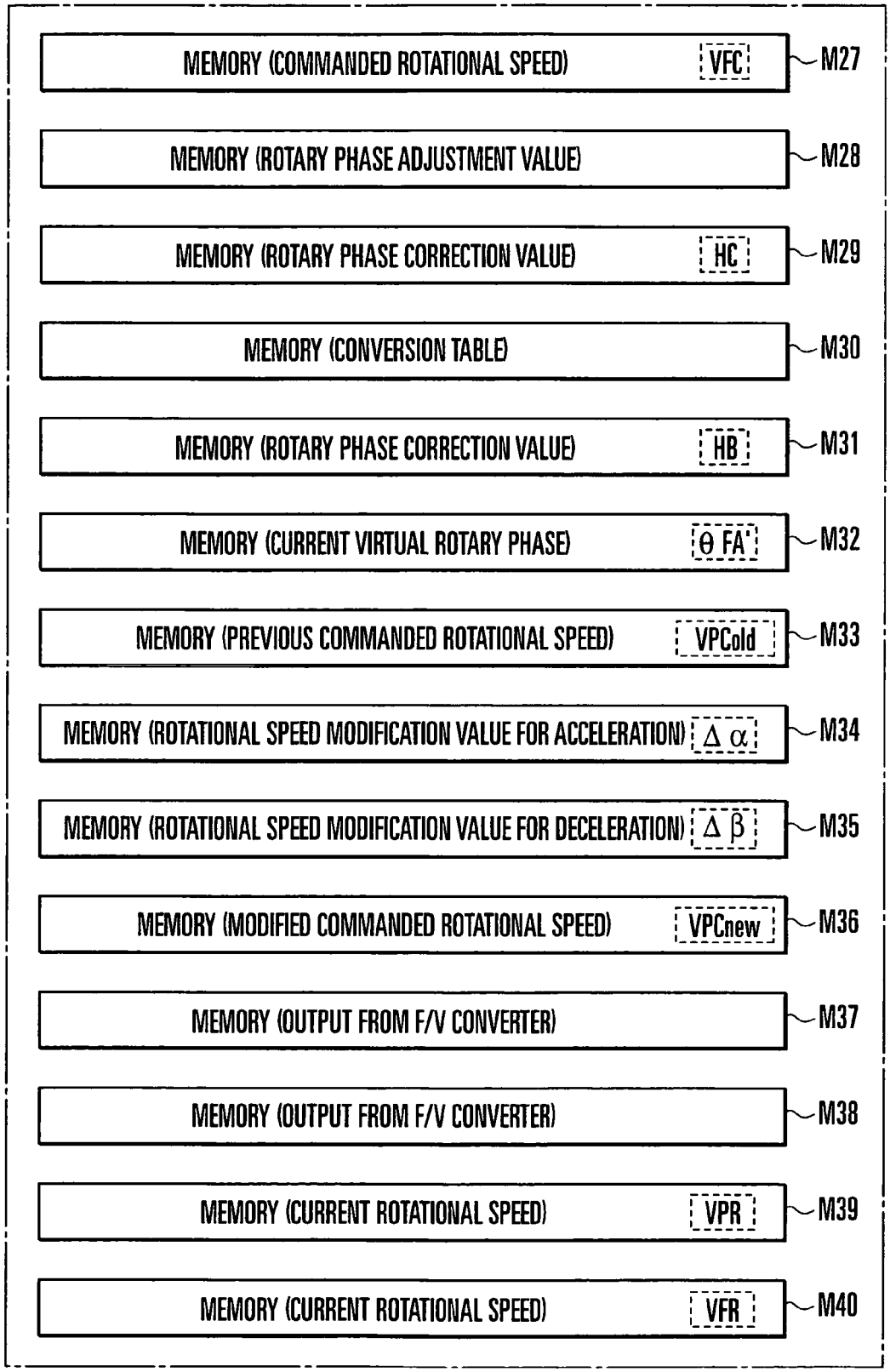

As shown in FIGS. 3A to 3C, the memory 33 comprises memories M1 to M40. The memory M1 stores the type of the printing target object. The memory M2 stores the thickness of the printing target object. The memory M3 stores the length of the printing target object in the convey direction. The memory M4 stores the length of the printing target object in the lateral direction. The memory M5 stores a conversion table for converting the type of the printing target object into the rotary phase correction value of the feeder. The memory M6 stores the reference rotary phase correction value of the feeder which is specific to the printing target object. The memory M7 stores a conversion table for converting the thickness of the printing target object into the rotary phase correction value of the feeder. The memory M8 stores the first correction value of the rotary phase correction value of the feeder which is specific to the printing target object. The memory M9 stores a conversion table for converting the length of the printing target object in the convey direction into the rotary phase correction value of the feeder. The memory M10 stores the second correction value of the rotary phase correction value of the feeder which is specific to the printing target object. The memory M11 stores a conversion table for converting the length of the printing target object in the lateral direction into the rotary phase correction value of the feeder. The memory M12 stores the third correction value of the rotary phase correction value of the feeder which is specific to the printing target object. The memory M13 stores the rotary phase correction value of the feeder which is specific to the printing target object. The memory M14 stores a slower rotational speed. The memory M15 stores the preset rotational speed of the offset sheet-fed printing press. The memory M16 stores the commanded rotational speed of the offset sheet-fed printing press. The memory M17 stores the count of the rotary phase detection counter of the offset sheet-fed printing press. The memory M18 stores the current rotary phase of the offset sheet-fed printing press. The memory M19 stores a synchronous standby position. The memory M20 stores a time interval at which the commanded rotational speed and current virtual rotary phase of the feeder are transmitted to the drive control device of the feeder. The memory M21 stores a rotary phase for which the offset sheet-fed printing press advances until the next transmission. The memory M22 stores the rotary phase of the offset sheet-fed printing press for the next transmission. The memory M23 stores a conversion table for converting the rotary phase of the offset sheet-fed printing press into the reference rotary phase of the feeder. The memory M24 stores the current reference rotary phase of the feeder. The memory M25 stores the reference rotary phase of the feeder for the next transmission. The memory M26 stores a rotary phase for which the feeder advances until the next transmission. The memory M27 stores the commanded rotational speed of the feeder. The memory M28 stores the rotary phase adjustment value of the feeder. The memory M29 stores the rotary phase correction value of the feeder by manual adjustment. The memory M30 stores a conversion table for converting the rotational speed of the prime motor of the offset sheet-fed printing press into the rotary phase of the feeder. The memory M31 stores the speed-specific rotary phase correction value of the feeder. The memory M32 stores the current virtual rotary phase of the feeder. The memory M33 stores the previous commanded rotational speed of the offset sheet-fed printing press. The memory M34 stores a rotational speed modification value for acceleration. The memory M35 stores a rotational speed modification value for deceleration. The memory M36 stores the modified commanded rotational speed of the offset sheet-fed printing press. The memory M37 stores an output from an F/V converter connected to the prime motor rotary encoder of the offset sheet-fed printing press. The memory M38 stores an output from an F/V converter connected to the driving motor rotary encoder of the feeder. The memory M39 stores the current rotational speed of the offset sheet-fed printing press. The memory M40 stores the current rotational speed of the feeder. The functions of the memories M1 to M40 in the memory 33 will be described later.

In the following description of the embodiment, the driving shaft of the prime motor 18 of the offset sheet-fed printing press is connected to the driven shaft of the printing press main body of the offset sheet-fed printing press through a driving belt. Due to the slippage of the driving belt, the rotary phase of the prime motor 18 of the offset sheet-fed printing press does not coincides with the rotary phase of the printing press main body of the offset sheet-fed printing press. Hence, according to this embodiment, the rotary phase detection rotary encoder 26 of the offset sheet-fed printing press is attached to the rotary member of the printing press main body of the offset sheet-fed printing press. The rotary phase of the printing press main body of the offset sheet-fed printing press is directly detected from the signal of the rotary phase detection rotary encoder 26 of the offset sheet-fed printing press. Examples of the rotary member to which the rotary phase detection rotary encoder 26 is to be attached include a plate cylinder and blanket cylinder.

Figure 2:
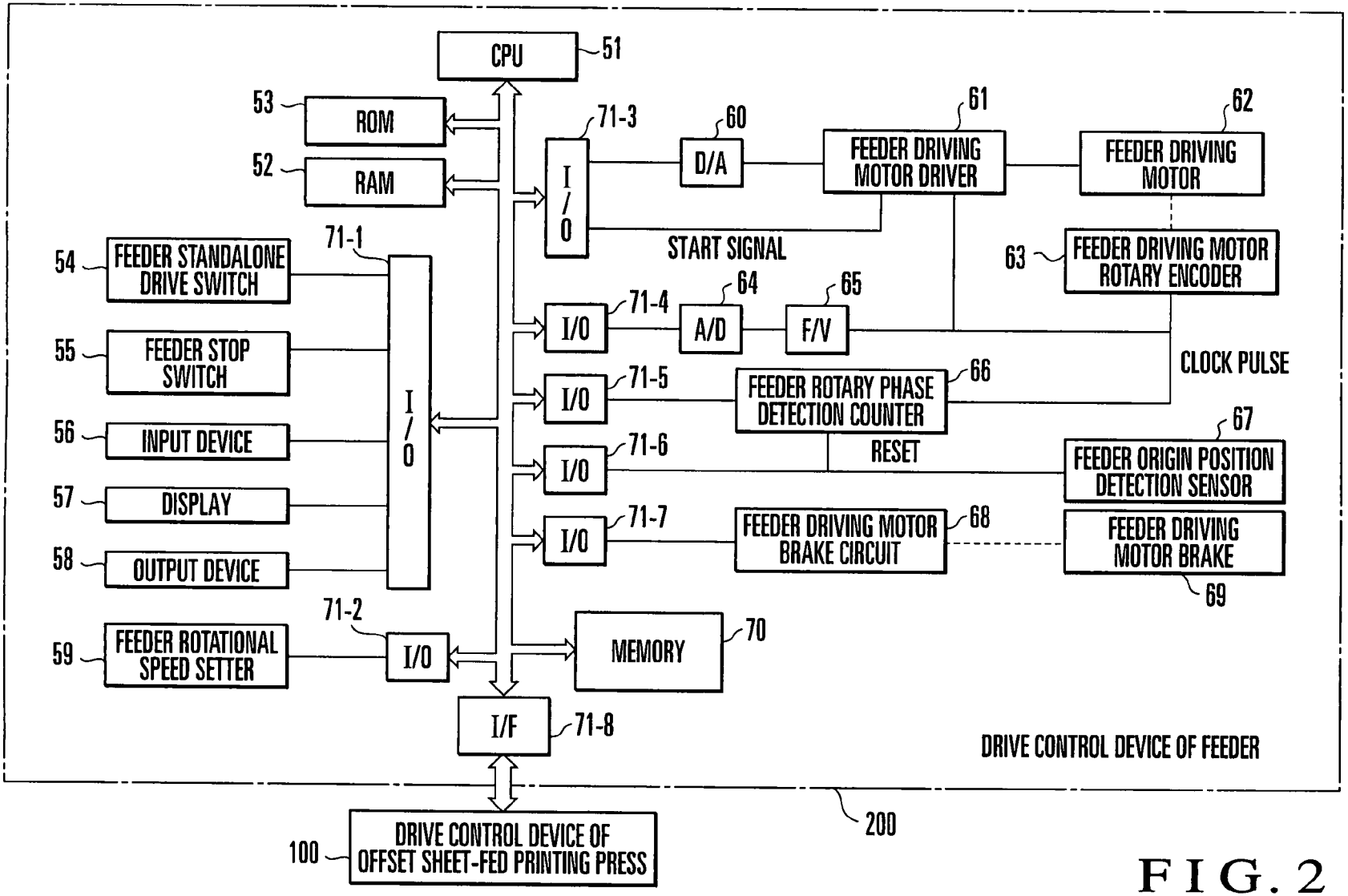

As shown in FIG. 2, the drive control device 200 of the feeder comprises a CPU 51, a RAM 52, a ROM 53, a feeder standalone drive switch 54, a feeder stop switch 55, an input device 56, a display 57, an output device 58 such as an FD driver or printer, a feeder rotational speed setter 59, a D/A converter 60, a feeder driving motor driver 61, a feeder driving motor 62, a feeder driving motor rotary encoder 63, an A/D converter 64, an F/V converter 65, a feeder rotary phase detection counter 66, a feeder origin position detection sensor 67, a feeder driving motor brake circuit 68, a feeder driving motor brake 69, a memory 70, and interfaces (I/Os and I/Fs) 71-1 to 71-8.

Figure 4:
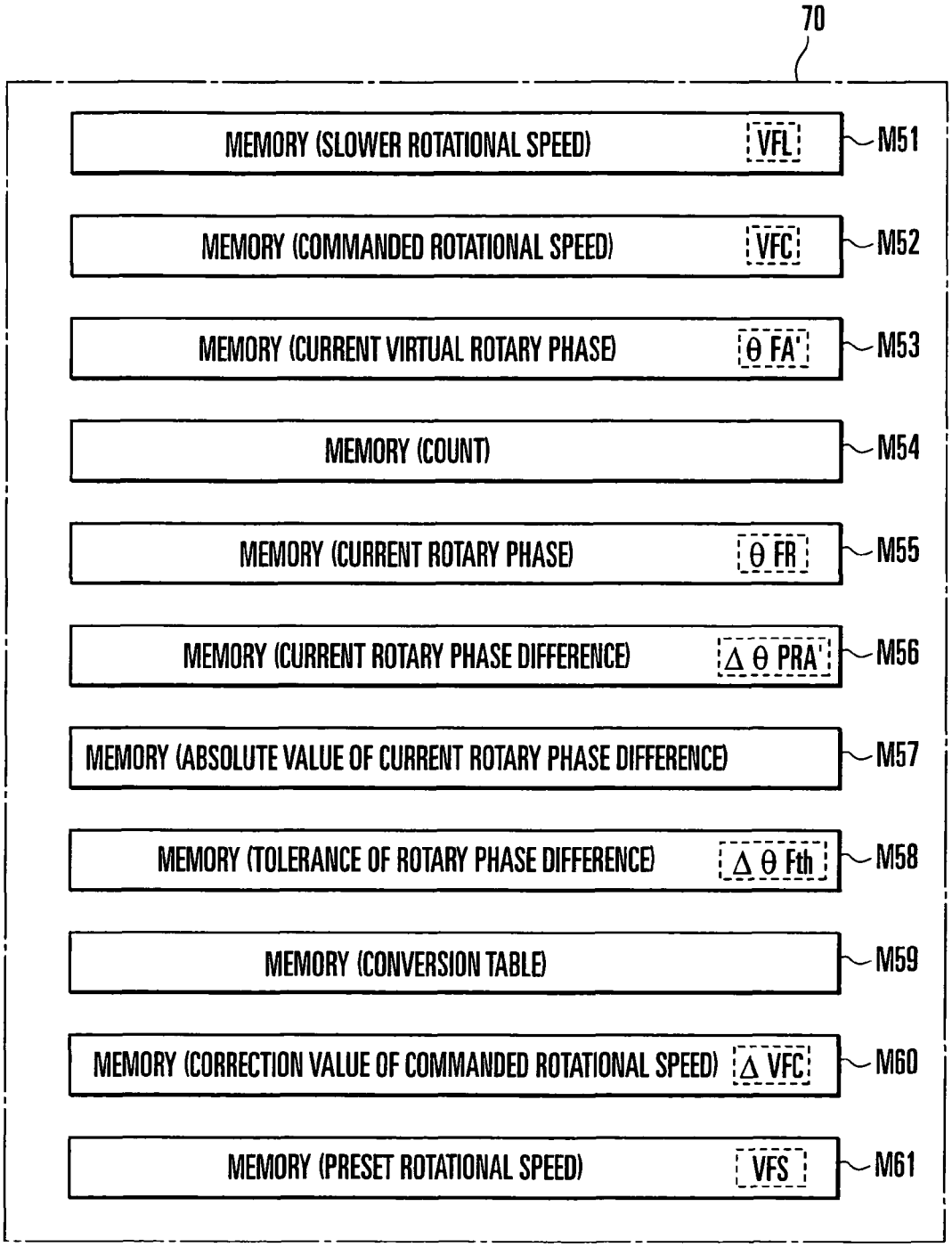
FIG. 4 is a block diagram showing the configuration of a memory in the drive control device of the feeder shown in FIG. 2.

As shown in FIG. 4, the memory 70 comprises memories M51 to M61. The memory M51 stores a slower rotational speed. The memory M52 stores the commanded rotational speed of the feeder. The memory M53 stores the current virtual rotary phase of the feeder. The memory M54 stores the cont of the rotary phase detection counter of the feeder. The memory M55 stores the current rotary phase of the feeder. The memory M56 stores the current rotary phase difference of the feeder. The memory M57 stores the absolute value of the current rotary phase difference of the feeder. The memory M58 stores the tolerance of the rotary phase difference of the feeder. The memory M59 stores a conversion table for converting the current rotary phase difference of the feeder into the correction value of the commanded rotational speed. The memory M60 stores the correction value of the commanded rotational speed of the feeder. The memory M61 stores the preset rotational speed of the feeder. The functions of the memories M51 to M61 in the memory 70 will be described later.

In the drive control device 100 of the offset sheet-fed printing press, the CPU 1 obtains various types of input information given via the input/output interfaces 34-1 to 34-10 and operates in accordance with the program stored in the ROM 3 while accessing the RAM 2 and memory 33. In the drive control device 200 of the feeder, the CPU 51 obtains various types of input information given via the input/output interfaces 71-1 to 71-8 and operates in accordance with the program stored in the ROM 53 while accessing the RAM 52 and memory 70. The ROM 3 of the drive control device 100 of the offset sheet-fed printing press and the ROM 53 of the drive control device 200 of the feeder respectively store shares of the processing functions of the rotary phase adjustment program of the feeder as a program unique to this embodiment. The rotary phase adjustment program of the feeder can be provided in the form of a machine-readable recording medium.

The processing operation which is performed by the CPU 1 of the drive control device 100 of the offset sheet-fed printing press and the CPU 51 of the drive control device 200 of the feeder in a linked manner in accordance with the rotary phase adjustment program of the feeder will be described hereinafter with reference to the flowcharts shown in FIGS. 5A to 14.

Note that the flowcharts of FIGS. 5A to 10 show the processing operation performed by the CPU 1 of the drive control device 100 of the offset sheet-fed printing press, and the flowcharts of FIGS. 11 to 14 show the processing operation performed by the CPU 51 of the drive control device 200 of the feeder.

[Setting of Printing Conditions]

Before the start of printing, the operator inputs printing conditions to the drive control device 100 of the offset sheet-fed printing press. In this case, as the printing conditions, the operator inputs the type of the printing target object (the paper or sheet to be employed) from the printing target object type setter 10, the thickness of the printing target object from the printing target object thickness setter 11, the length of the printing target object in the convey direction from the setter 12 for the length of the printing target object in the convey direction, the length of the printing target object in the lateral direction from the setter 13 for the length of the printing target object in the lateral direction, and the rotational speed (e.g., the speed of final printing) of the printing press from the rotational speed setter 15.

When the printing conditions are input, the CPU 1 of the drive control device 100 of the offset sheet-fed printing press reads out the type of the printing target object from the printing target object type setter 10 and stores it in the memory M1 (steps S1 and S2 in FIG. 5A), reads out the thickness of the printing target object from the printing target object thickness setter 11 and stores it in the memory M2 (steps S3 and S4), reads out the length of the printing target object in the convey direction from the setter 12 for the length of the printing target object in the convey direction and stores it in the memory M3 (steps S5 and S6), and reads out the length of the printing target object in the lateral direction from the setter 13 for the length of the printing target object in the lateral direction and stores it in the memory M4 (steps S7 and S8).

[Start of Printing]

When starting printing, the operator turns on the synchronous operation switch 4 to command synchronous operation of the offset sheet-fed printing press and feeder. The operator also turns on the offset sheet-fed printing press drive switch 5 to command start of printing.

[Calculation of Rotary Phase Correction Value of Feeder Which is Specific to Printing Target Object]

Upon confirmation of the ON states of the synchronous operation switch 4 and of the offset sheet-fed printing press drive switch 5 (YES in step S9, YES in step S10), the CPU 1 advances to step S11 (FIG. 5B) and reads out the conversion table for converting the type of the printing object target into the rotary phase correction value of the feeder from the memory M5. The conversion table for converting the type of the printing target object into the rotary phase correction value of the feeder is a table that shows the relationship between the type of the printing target object and the rotary phase correction value of the feeder, and is determined through repeated experiments.

The CPU 1 then reads out the type of the printing target object from the memory M1 (step S12), obtains the rotary phase correction value of the feeder corresponding to the type of the printing target object using the conversion table for converting the type of the printing target object into the rotary phase correction value of the feeder, which table is read out from the memory M5, and stores the obtained value in the memory M6 as a reference rotary phase correction value ha0 of the feeder which is specific to the printing target object (step S13).

Then, the CPU 1 reads out the type of the printing target object from the memory M1 (step S14) and the conversion table for converting the thickness of the printing target object into the rotary phase correction value of the feeder corresponding to the type of the printing target object from the memory M7 (step S15). The memory M7 stores the table showing the relationship between the thickness of the printing target object and the rotary phase correction value of the feeder of each printing target object type. This table is also determined through repeated experiments.

Then, the CPU 1 reads out the thickness of the printing target object from the memory M2 (step S16), obtains the rotary phase correction value of the feeder corresponding to the thickness of the printing target object using the conversion table for converting the thickness of the printing target object into the rotary phase correction value of the feeder corresponding to the type of the printing target object, which table is read out from the memory M7, and stores the obtained value in the memory M8 as a first correction value ha1 of the rotary phase correction value of the feeder which is specific to the printing target object (step S17).

Then, the CPU 1 reads out the type of the printing target object from the memory M1 (step S18) and the conversion table for converting the length of the printing target object in the convey direction into the rotary phase correction value of the feeder corresponding to the type of the printing target object from the memory M9 (step S19). The memory M9 stores the table showing the relationship between the length of the printing target object in the convey direction and the rotary phase correction value of the feeder of each printing target object type. This table is also determined through repeated experiments.

Figure 5A:
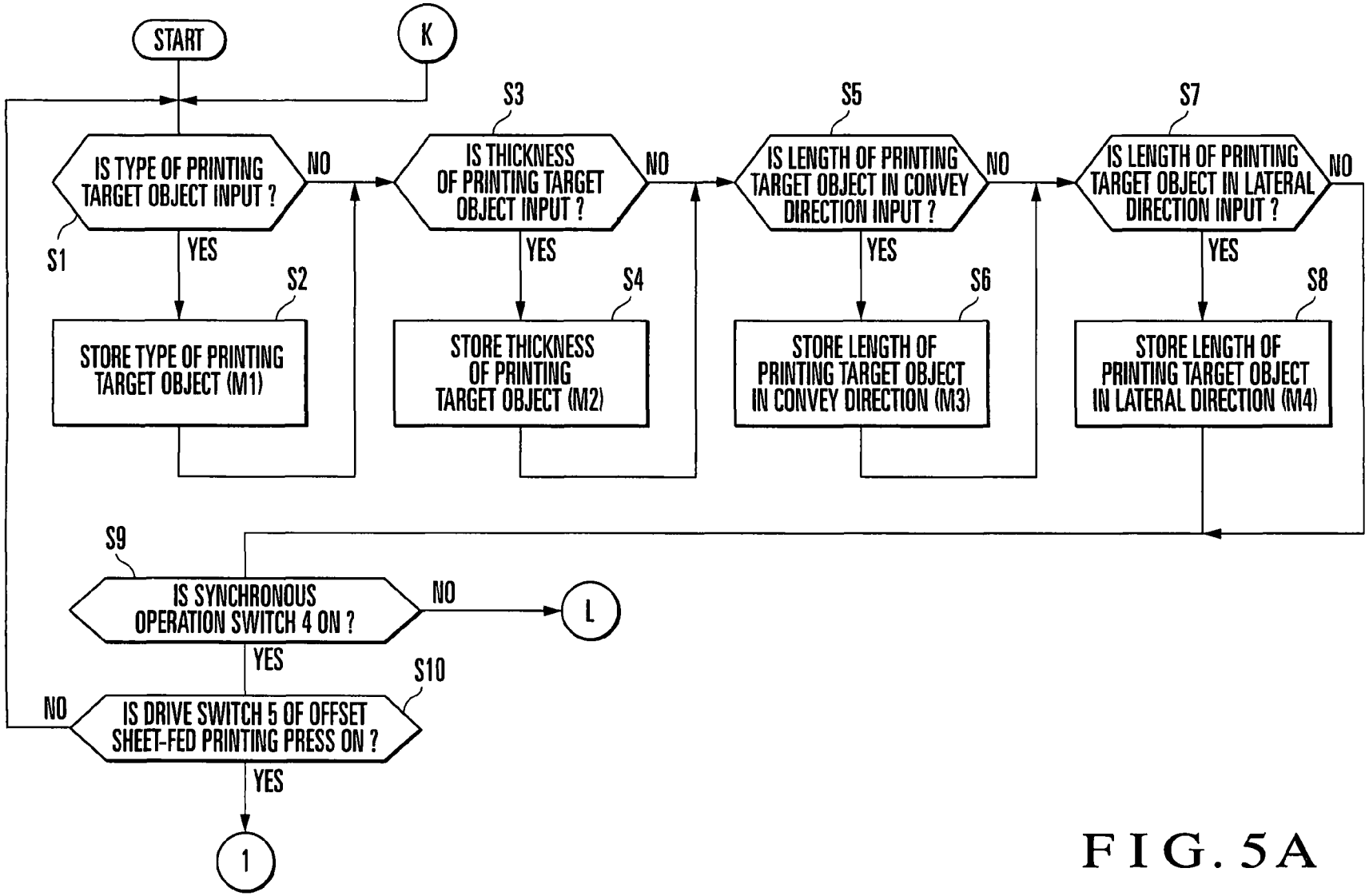
Figure 5B:
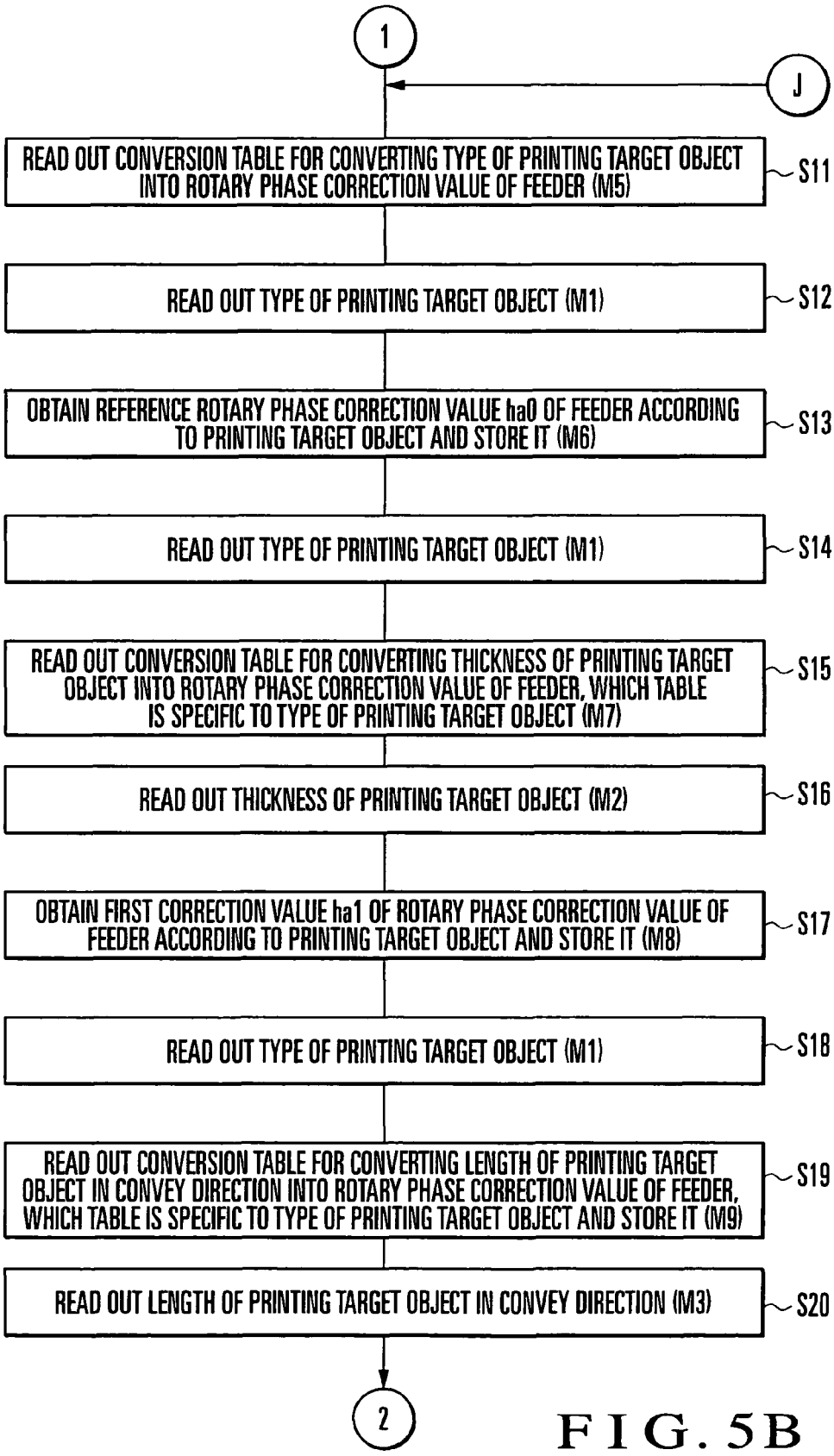
Figure 5C:
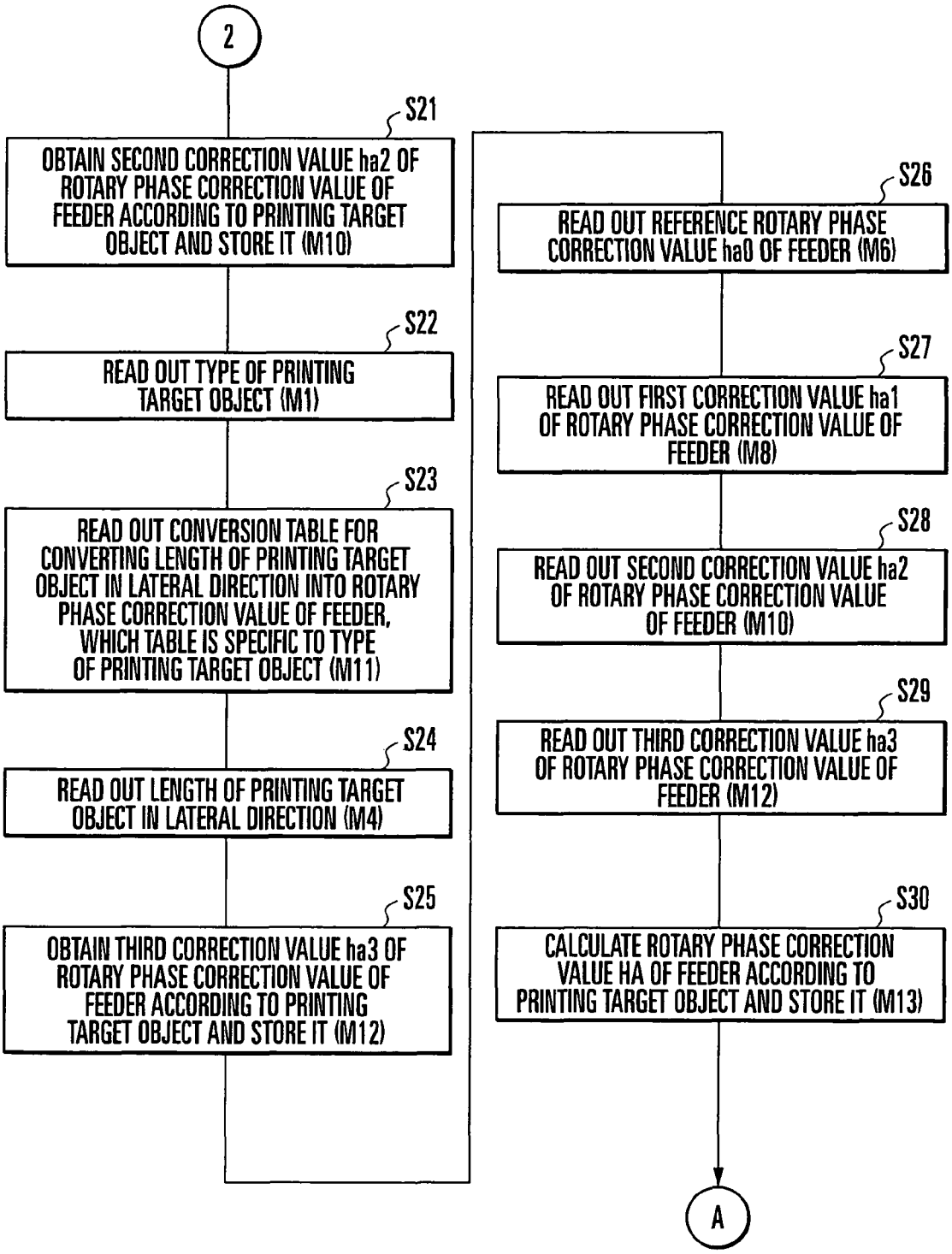
Figure 5D:
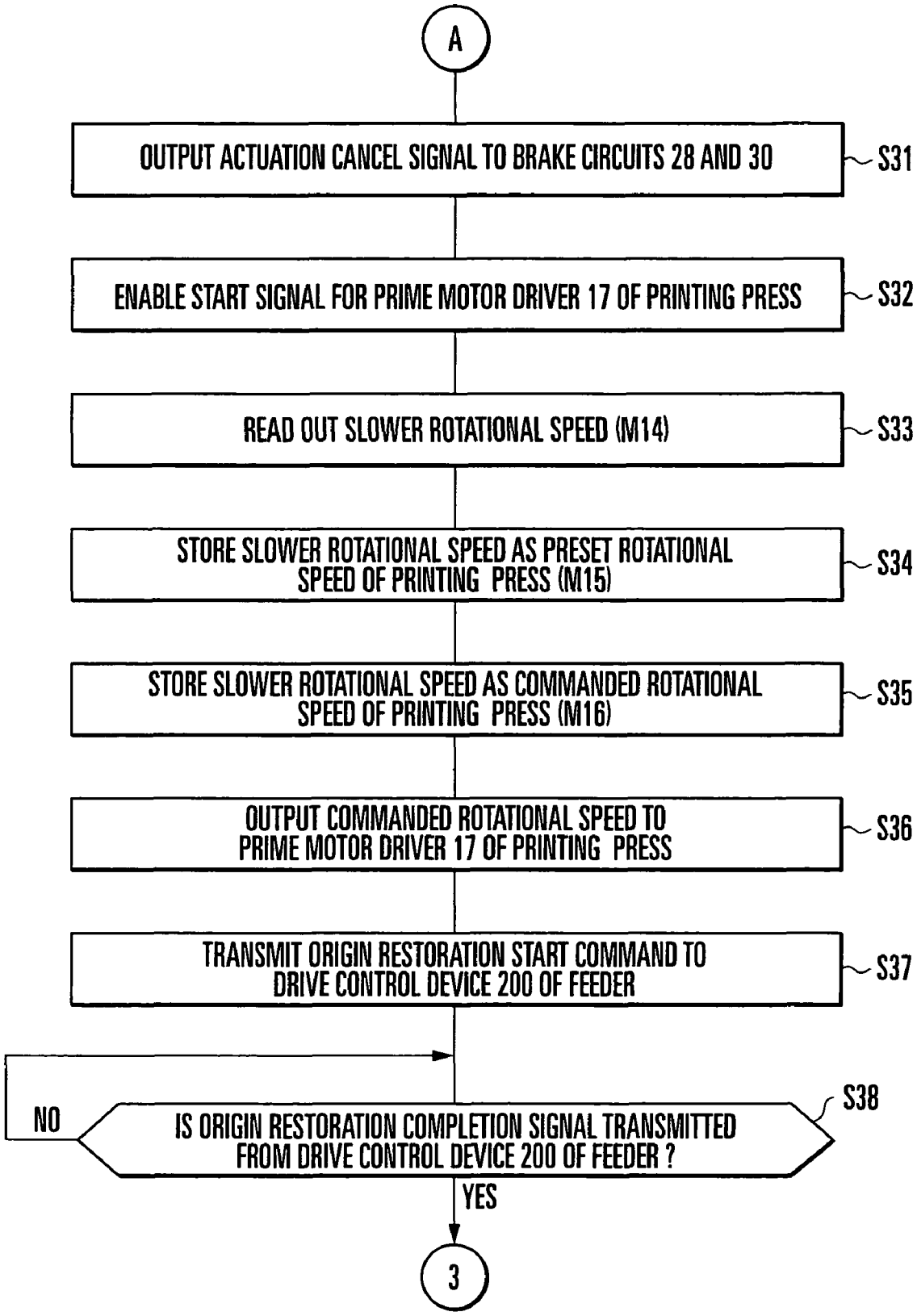

Then, the CPU 1 reads out the length of the printing target object in the convey direction from the memory M3 (step S20), obtains the rotary phase correction value of the feeder corresponding to the length of the printing target object in the convey direction using the conversion table for converting the length of the printing target object in the convey direction into the rotary phase correction value of the feeder corresponding to the type of the printing target object, which table is read out from the memory M9, and stores the obtained value in the memory M10 as a second correction value ha2 of the rotary phase correction value of the feeder which is specific to the printing target object (step S21 in FIG. 5C).

Then, the CPU 1 reads out the type of the printing target object from the memory M1 (step S22) and the conversion table for converting the length of the printing target object in the lateral direction into the rotary phase correction value of the feeder corresponding to the type of the printing target object from the memory M11 (step S23). The memory M11 stores the table showing the relationship between the length of the printing target object in the lateral direction and the rotary phase correction value of the feeder of each printing target object type. This table is also determined through repeated experiments.

Then, the CPU 1 reads out the length of the printing target object in the lateral direction from the memory M4 (step S24), obtains the rotary phase correction value of the feeder corresponding to the length of the printing target object in the lateral direction using the conversion table for converting the length of the printing target object in the lateral direction into the rotary phase correction value of the feeder corresponding to the type of the printing target object, which table is read out from the memory M11, and stores the obtained value in the memory M12 as a third correction value ha3 of the rotary phase correction value of the feeder which is specific to the printing target object (step S25).

Then, the CPU 1 reads out the reference rotary phase correction value ha0 of the feeder from the memory M6 (step S26), the first correction value ha1 of the rotary phase correction value of the feeder from the memory M8 (step S27), the second correction value ha2 of the rotary phase correction value of the feeder from the memory M10 (step S28), and the third correction value ha3 of the rotary phase correction value of the feeder from the memory M12 (step S29), adds the reference rotary phase correction value ha0, first correction value ha1, second correction value ha2, and third correction value ha3, and stores the addition result in the memory M13 as a rotary phase correction value HA (HA=ha0+ha1+ha2+ha3) of the feeder which is specific to the printing target object (step S30).

[Slower Rotation of Offset Sheet-Fed Printing Press]

Then, the CPU 1 sends an actuation cancel signal to the prime motor brake circuit 28 of the offset sheet-fed printing press and the driving motor brake circuit 30 of the feeder (step S31 in FIG. 5D) to turn off the prime motor brake 29 of the offset sheet-fed printing press and the driving, motor brake 31 of the feeder. The CPU 1 then turns on a start signal for the prime motor driver 17 of the offset sheet-fed printing press (step S32), reads out a slower rotational speed VPL set in the memory M14 (step S33), and stores the slower rotational speed VPL in the memory M15 as a preset rotational speed VPS (step S34) and in the memory M16 as a commanded rotational speed VPC (step S35). The CPU 1 then outputs the commanded rotational speed VPC (slower rotational speed VPL) to the prime motor driver 17 of the offset sheet-fed printing press (step S36). Thus, the prime motor 18 of the offset sheet-fed printing press starts to rotate at the commanded rotational speed VPC, that is, the slower rotational speed VPL.

[Restoration of Feeder to Origin]

After outputting the commanded rotational speed VPC to the prime motor driver 17 of the offset sheet-fed printing press (step S36), the CPU 1 transmits an origin restoration start command to the drive control device 200 of the feeder (step S37).

When the origin restoration start command is sent from the drive control device 100 of the offset sheet-fed printing press (YES in step S401, FIG. 11), the CPU 51 of the drive control device 200 of the feeder receives it (step S402) and enables a start signal for the feeder driving motor driver 61 (step S403). The CPU 51 then reads out a slower rotational speed VFL set in the memory M51 (step S404), writes the readout slower rotational speed VFL in the memory M52 as a commanded rotational speed VFC (step S405), and outputs the commanded rotational speed VFC (slower rotational speed VFL) to the feeder driving motor driver 61 (step S406). Thus, the feeder driving motor 62 starts to rotate at the commanded rotational speed VFC, that is, the slower rotational speed VFL.

Figure 15A:
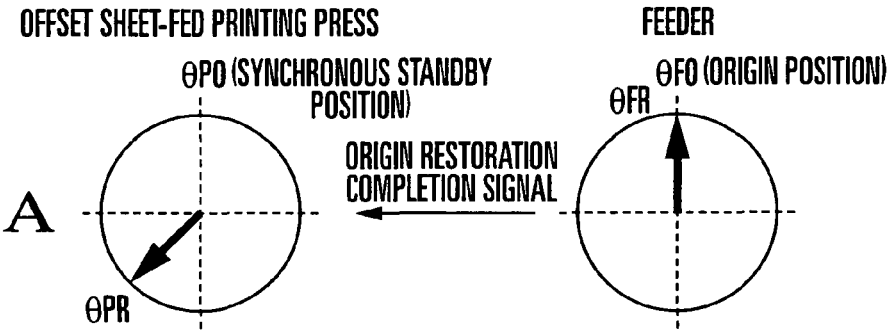
FIGS. 15A to 15E are views showing signal transmission/reception timing between the drive control device of the offset sheet-fed printing press shown in FIG. 1 and the drive control device of the feeder shown in FIG. 2.

When the rotary position of the feeder driving motor 62 rotates at the slower rotational speed VFL to reach an origin position θF0 which is determined as a reference rotational angular position, the feeder origin position detection sensor 67 is turned on. When the feeder origin position detection sensor 67 is turned on (YES in step S407), the CPU 51 outputs a stop command to the feeder driving motor driver 61 (step S408). Thus, the feeder driving motor 62 stops at the origin position θF0. Simultaneously, the CPU 51 outputs an origin restoration completion signal to the drive control device 100 of the offset sheet-fed printing press (step S409). FIG. 15A shows this state.

[Synchronous Origin Alignment of Offset Sheet-Fed Printing Press and Feeder]

When the origin restoration completion signal is sent from the drive control device 200 of the feeder (YES in step S38, FIG. 5D), the CPU 1 of the drive control device 100 of the offset sheet-fed printing press receives it (step S39 in FIG. 6A), reads the count of the rotary phase detection counter 25 of the offset sheet-fed printing press, and stores the count in the memory M17 (step S40).

The CPU 1 calculates a current rotary phase θPR of the offset sheet-fed printing press from the count of the rotary phase detection counter 25 (step S41). The CPU 1 then reads out a synchronous standby position θP0 of the offset sheet-fed printing press which is set in the memory M19 to correspond to the origin position θF0 of the feeder (step S42). The CPU 1 repeats the processes of steps S40 to S43 until the current rotary phase θPR of the offset sheet-fed printing press reaches the synchronous standby position θP0 (YES in step S43).

Figure 15B:
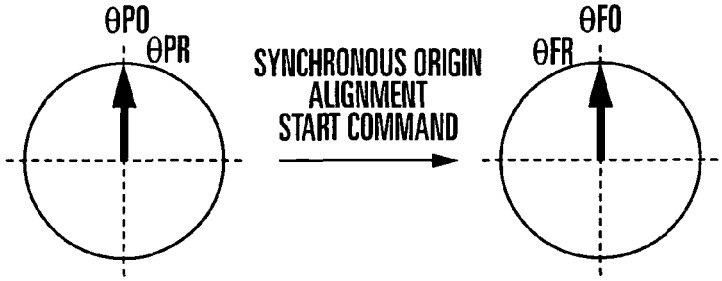

During the repeated processes, if the current rotary phase θPR of the offset sheet-fed printing press reaches the synchronous standby position θP0 (YES in step S43), the CPU 1 transmits a synchronous origin alignment start command to the drive control device 200 of the feeder (step S44). FIG. 15B shows this state.

When the synchronous origin alignment start command is sent from the drive control device 100 of the offset sheet-fed printing press (YES in step S410, FIG. 12A), the CPU 51 of the drive control device 200 of the feeder receives it (step S411) and waits for the commanded rotational speed and current virtual rotary phase (to be described later) of the feeder to be sent from the drive control device 100 of the offset sheet-fed printing press (step S412).

After transmitting the synchronous origin alignment start command to the drive control device 200 (step S44), the CPU 1 of the drive control device 100 of the offset sheet-fed printing press reads out the slower rotational speed VPL from the memory M14 (step S45), writes the readout slower rotational speed VPL in the memory M15 as the preset rotational speed VPS (step S46) and in the memory M16 as the commanded rotational speed VPC (step S47).

Then, the CPU 1 outputs a reset signal and enable signal to the internal clock counter 32 for counting the lapse time (step S48 in FIG. 6B), and stops the reset signal for the internal clock counter 32 (step S49). Thus, the internal clock counter 32 starts counting the clock pulse from zero.

A time interval T is set in the memory M20 which the commanded rotational speed and current virtual rotary phase of the feeder are transmitted to the drive control device 200 of the feeder. The CPU 1 reads out the transmission time interval T from the memory M20 (step S50). The CPU 1 also reads the count of the internal clock counter 32 (step S51).

When the count of the internal clock counter 32 becomes equal to or exceeds the time interval T (YES in step S52), the CPU 1 obtains the commanded rotational speed of the feeder and the current virtual rotary phase of the feeder which are necessary for synchronous origin alignment of the offset sheet-fed printing press and feeder. The commanded rotational speed of the feeder is a rotational speed to be commanded to the feeder so that the feeder rotates in response to rotation of the offset sheet-fed printing press, and is obtained from the processes of steps S55 to S73. The current virtual rotary phase of the feeder is an assumption value of the rotary phase of the feeder at the current time point of calculation, and is determined by considering the fluctuation of the rotary phase according to the printing conditions such as the rotational speed as well. The current virtual rotary phase of the feeder is obtained from the processes of steps S74 to S85. This will be described hereinafter in more detail.

First, the CPU 1 reads the count of the rotary phase detection counter 25 of the offset sheet-fed printing press and stores it in the memory M17 (step S55). The CPU 1 calculates the current rotary phase θPR of the offset sheet-fed printing press from the count of the rotary phase detection counter 25 of the offset sheet-fed printing press and stores it in the memory M18 (step S56 in FIG. 6C).

Then, the CPU 1 reads out the commanded rotational speed VPC (slower rotational speed VPL) of the offset sheet-fed printing press from the memory M16 (step S57) and the time interval T of transmission to the drive control device 200 of the feeder from the memory M20 (step S58). The CPU 1 multiplies the commanded rotational speed VPC by the transmission time interval T, calculates a rotary phase ΔθPRT for which the offset sheet-fed printing press advances until the next transmission, and stores the rotary phase ΔθPRT in the memory M21 (step S59).

Then, the CPU 1 reads out the current rotary phase θPR of the offset sheet-fed printing press from the memory M18 (step S60), obtains a rotary phase θPT of the offset sheet-fed printing press for the next transmission by adding the rotary phase ΔθPRT, for which the offset sheet-fed printing press advances until the next transmission, to the current rotary phase θPR of the offset sheet-fed printing press, and stores the obtained rotary phase θPT in the memory M22 (step S61).

If the rotary phase θPT of the offset sheet-fed printing press for the next transmission is equal to or more than 360° (YES in step S62), the CPU 1 subtracts 360° from the rotary phase θPT of the offset sheet-fed printing press for the next transmission, and overwrites the obtained rotary phase in the memory M22 as the rotary phase θPT of the offset sheet-fed printing press for the next transmission (step S63).

Figure 6A:
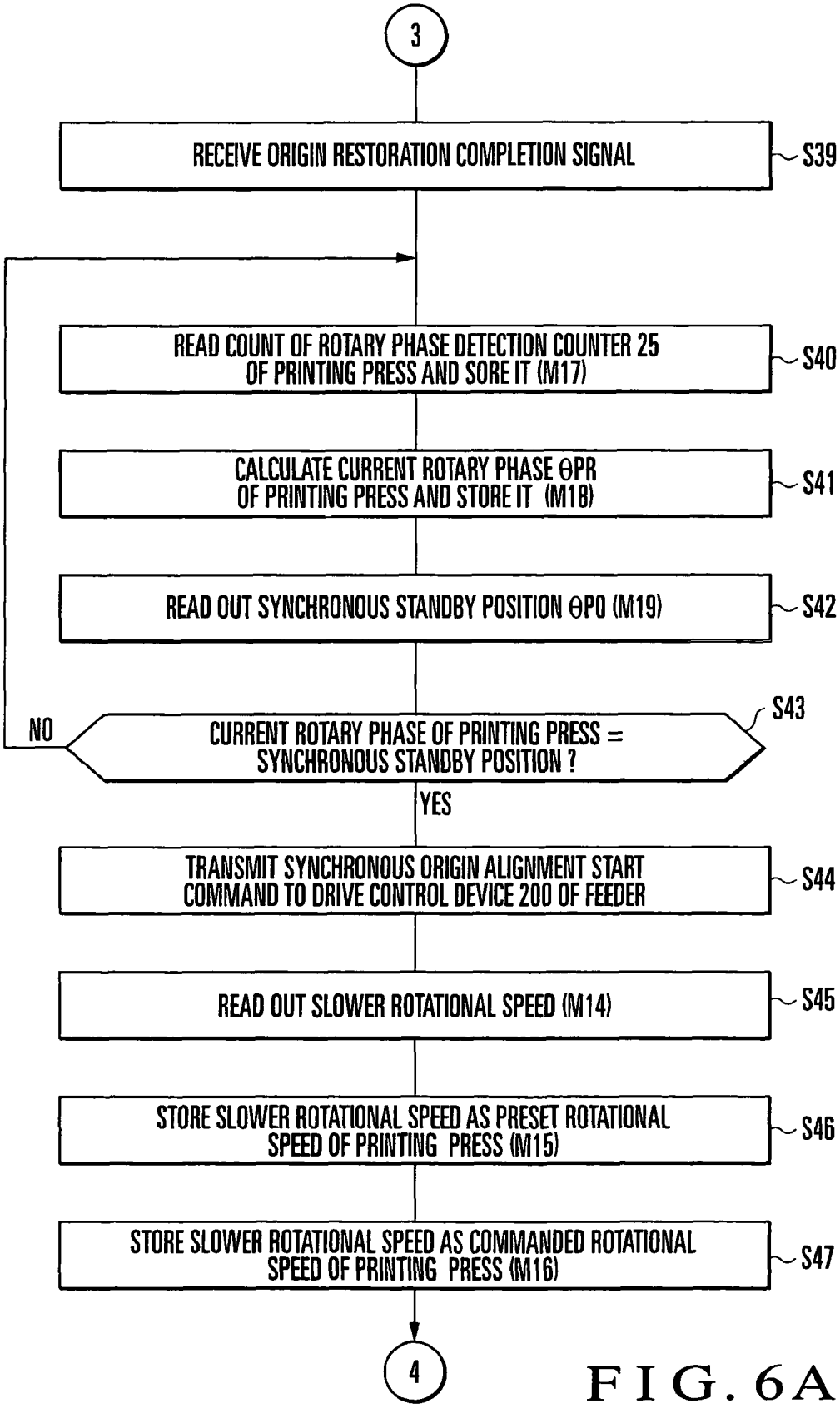
FIGS. 6A to 6K are flowcharts showing the processing operation of synchronous origin alignment of the offset sheet-fed printing press and feeder.
Figure 6B:
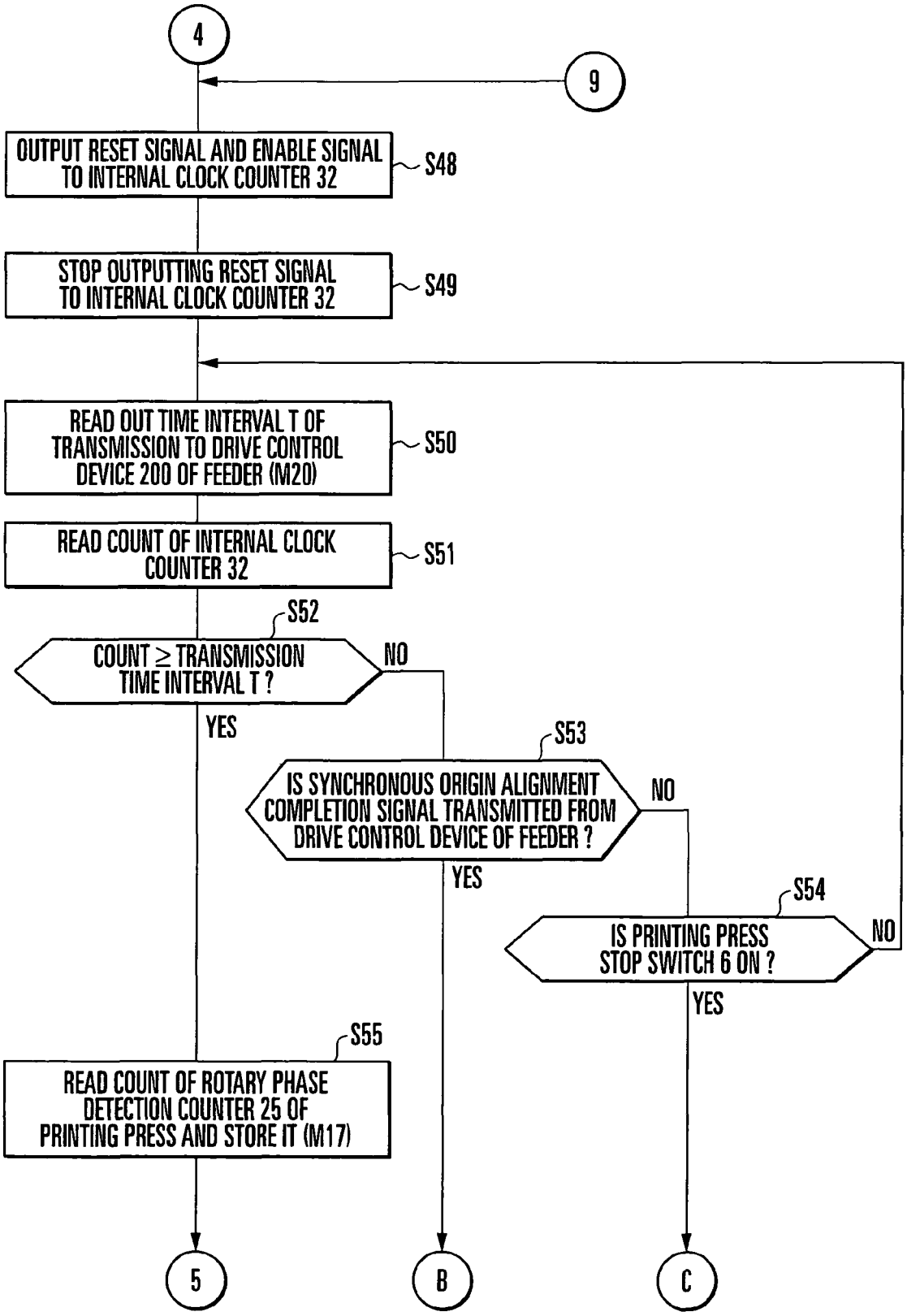
Figure 6C:
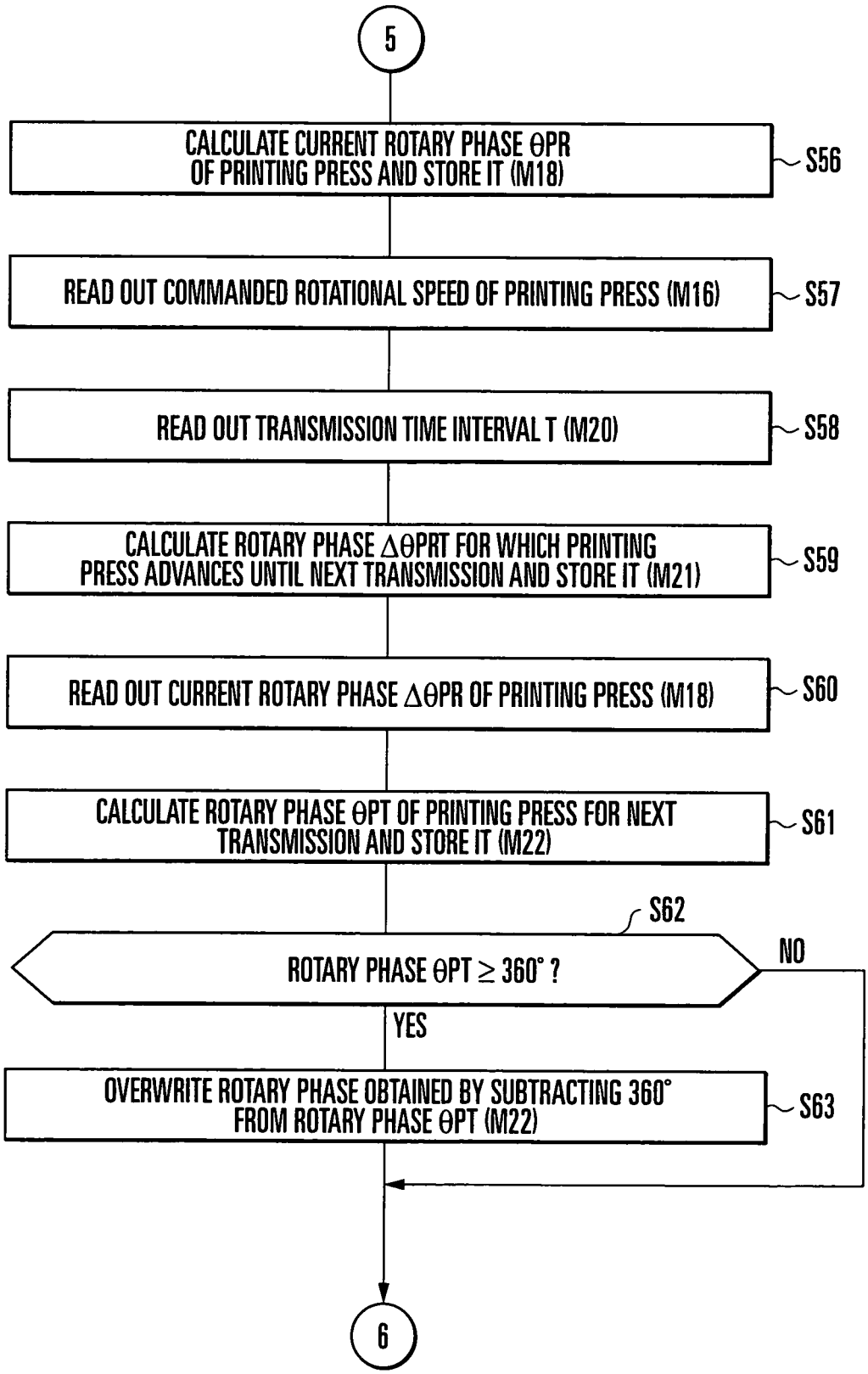
Figure 6D:
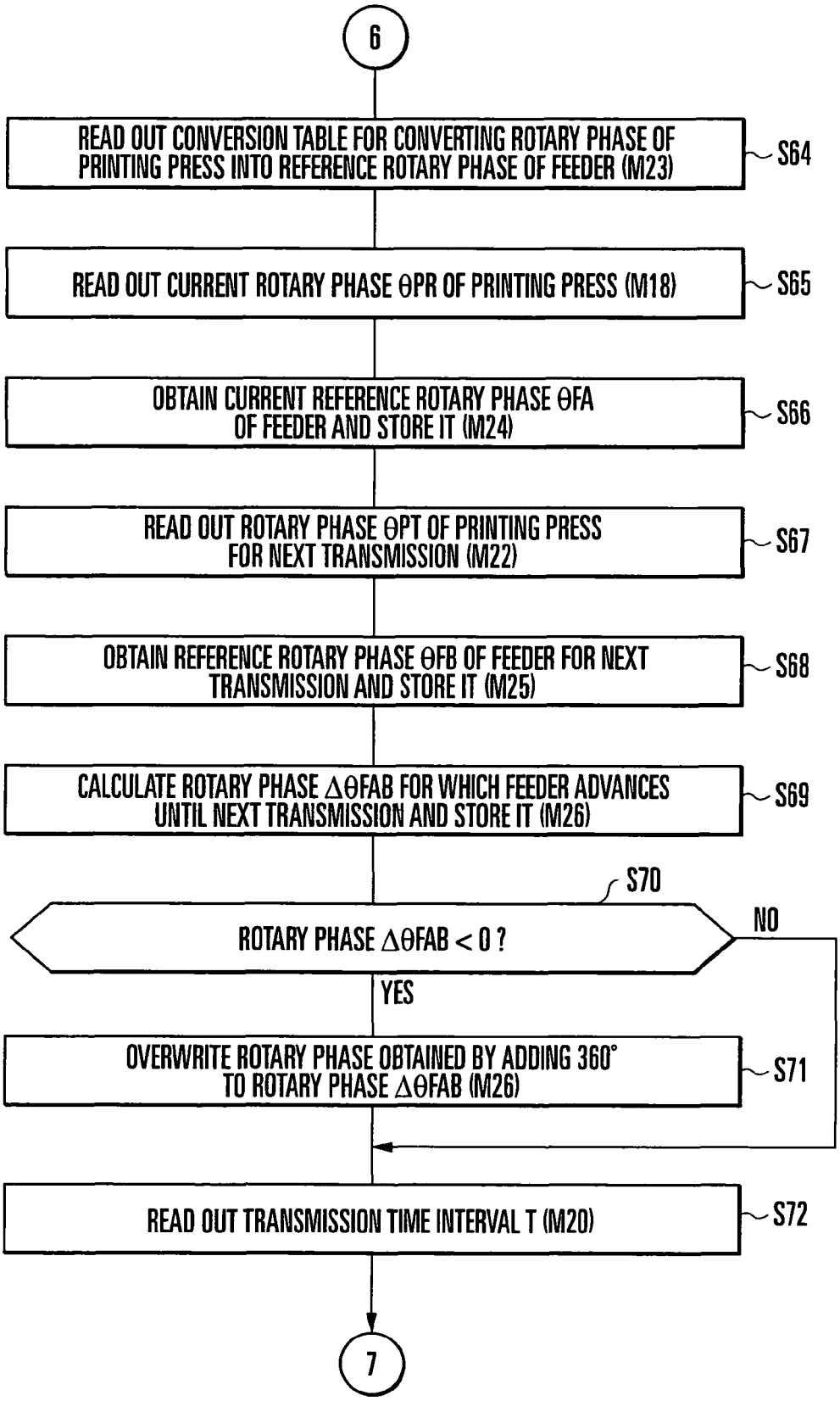
Figure 17:
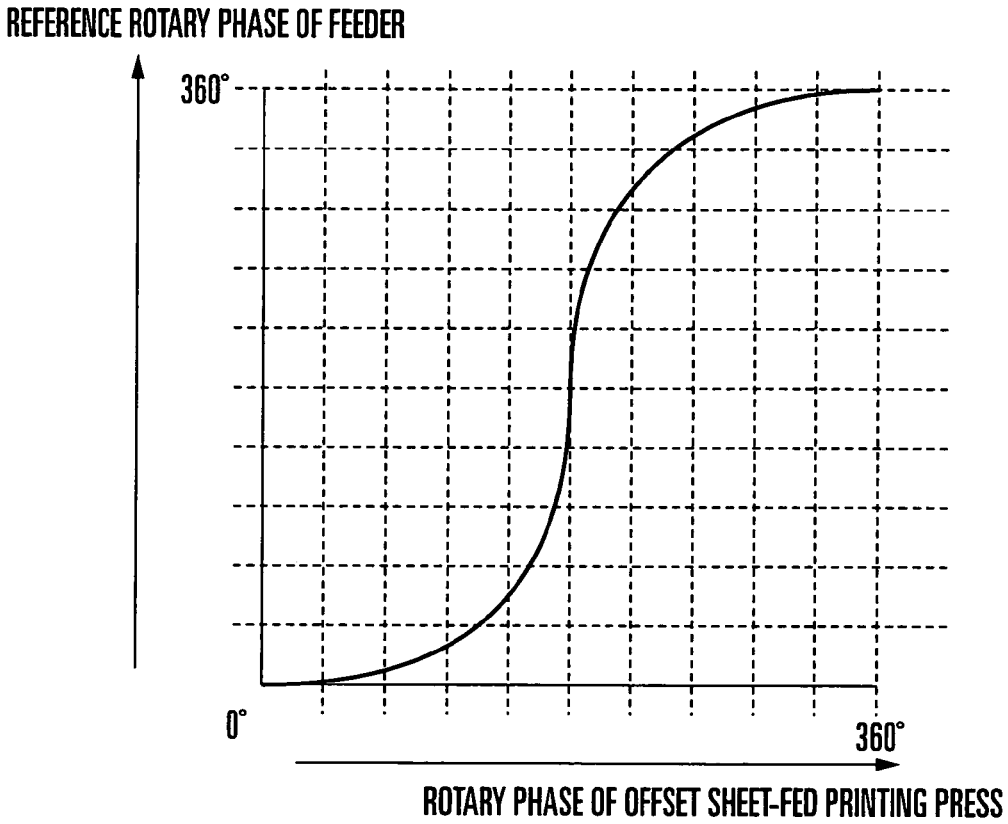
FIG. 17 is a graph showing the relationship between the rotary phase of the offset sheet-fed printing press and the reference rotary phase of the feeder which is set as a conversion table for converting the rotary phase of the offset sheet-fed printing press into the reference rotary phase of the feeder.

Then, the CPU 1 reads out the conversion table for converting the rotary phase of the offset sheet-fed printing press into the reference rotary phase of the feeder from the memory M23 (step S64 in FIG. 6D). The conversion table for converting the rotary phase of the offset sheet-fed printing press into the reference rotary phase of the feeder is a table showing the relationship between the rotary phase of the offset sheet-fed printing press and the reference rotary phase of the feeder, and is determined in advance to exhibit the relationship as shown in FIG. 17.

In a feeder that employs conveyor tapes, the rotary phase of the offset sheet-fed printing press and the reference rotary phase of the feeder do not establish a linear relationship, but exhibit a characteristic curve in which a change in rotary phase of the feeder accelerates or decelerates with respect to a change in rotary phase of the offset sheet-fed printing press. More specifically, according to this relationship, a change in rotary phase of the feeder is small at the start or end of sheet feed, and is large at the intermediate portion of sheet feed, thus accelerating and decelerating the change of the rotary phase (the sheet convey speed) of the feeder. According to this embodiment, this relationship is stored in the memory M23 in the form of the conversion table for converting the rotary phase of the offset sheet-fed printing press into the reference rotary phase of the feeder.

Figures 16A, 16B, 16C, 16D:
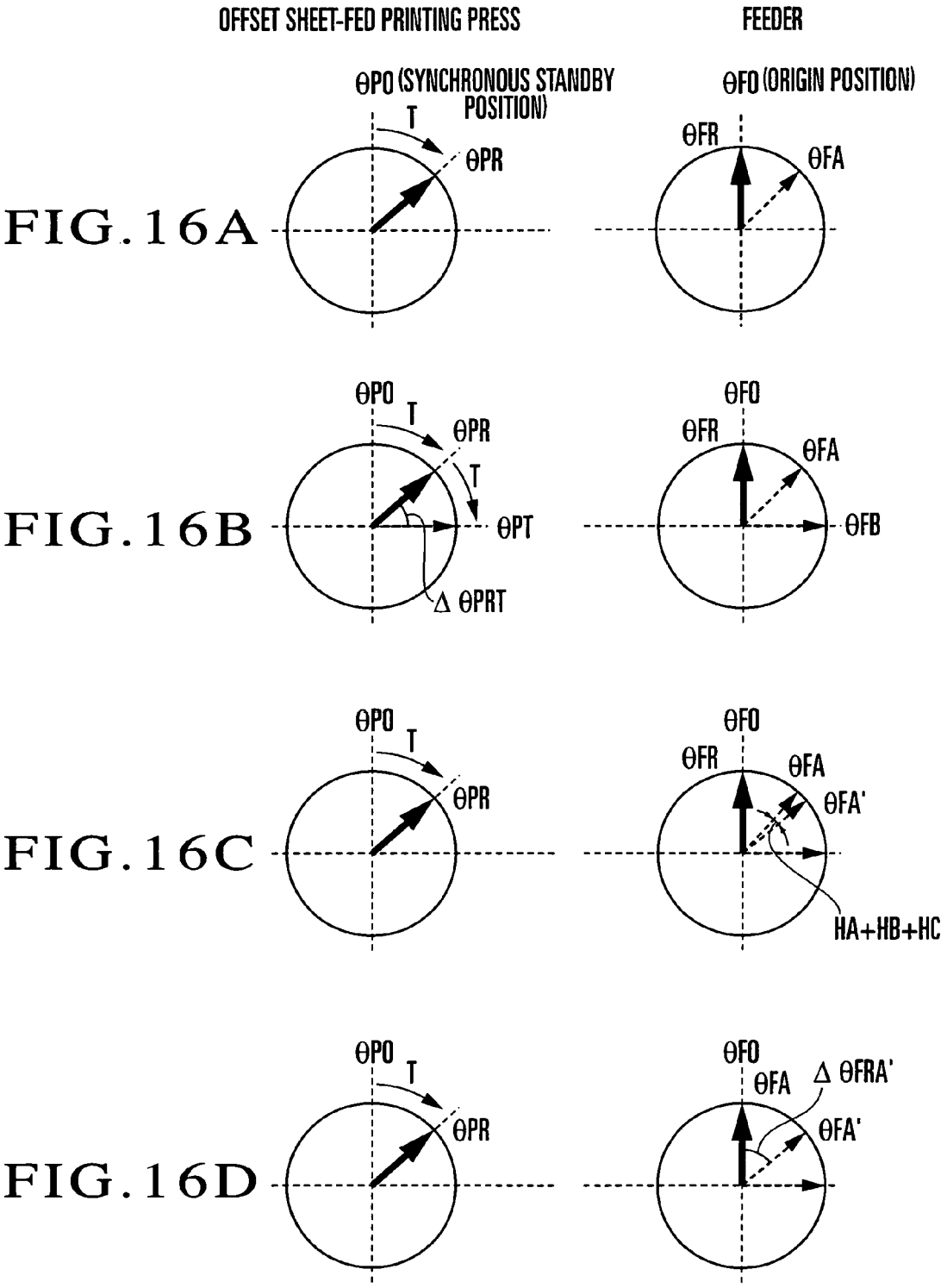
FIGS. 16A to 16D are views for explaining the process of calculating the commanded rotational speed and the current virtual rotary phase of the feeder by the drive control device of the offset sheet-fed printing press shown in FIG. 1.

After reading out the conversion table for converting the rotary phase of the offset sheet-fed printing press into the reference rotary phase of the feeder from the memory M23 (step S64), the CPU 1 reads out the current rotary phase θPR of the offset sheet-fed printing press from the memory M18 (step S65). The CPU 1 then obtains a current reference rotary phase θFA of the feeder corresponding to the current rotary phase θPR of the offset sheet-fed printing press using the conversion table for converting the rotary phase of the offset sheet-fed printing press into the reference rotary phase of the feeder, which table is read out from the memory M23 (see FIG. 16A), and stores it in the memory M24 (step S66). The reference rotary phase of the feeder which is converted from the rotary phase of the offset sheet-fed printing press using the above table serves as the reference value in calculation of the rotary phase of the feeder.

The CPU 1 also reads out the rotary phase θPT of the offset sheet-fed printing press for the next transmission from the memory M22 (step S67), obtains a reference rotary phase θFB of the feeder for the next transmission corresponding to the rotary phase θPT of the offset sheet-fed printing press for the next transmission using the conversion table for converting the rotary phase of the offset sheet-fed printing press into the reference rotary phase of the feeder, which table is read out from the memory M23 (see FIG. 16B), and stores the obtained reference rotary phase θFB in the memory M25 (step S68).

Then, the CPU 1 subtracts the current reference rotary phase θFA of the feeder from the reference rotary phase θFB of the feeder for the next transmission to obtain a rotary phase ΔθFAB (ΔθFAB=θFB−θFA) for which the feeder advances until the next transmission, and stores the rotary phase ΔθFAB in the memory M26 (step S69). If the rotary phase ΔθFAB for which the feeder advances until the next transmission is less than 0° (YES in step S70), the CPU 1 adds 3600 to the rotary phase ΔθFAB for which the feeder advances until the next transmission, and overwrites the obtained rotary phase in the memory M26 as the ΔθFAB for which the feeder advances until the next transmission (step S71).

Figure 6E:
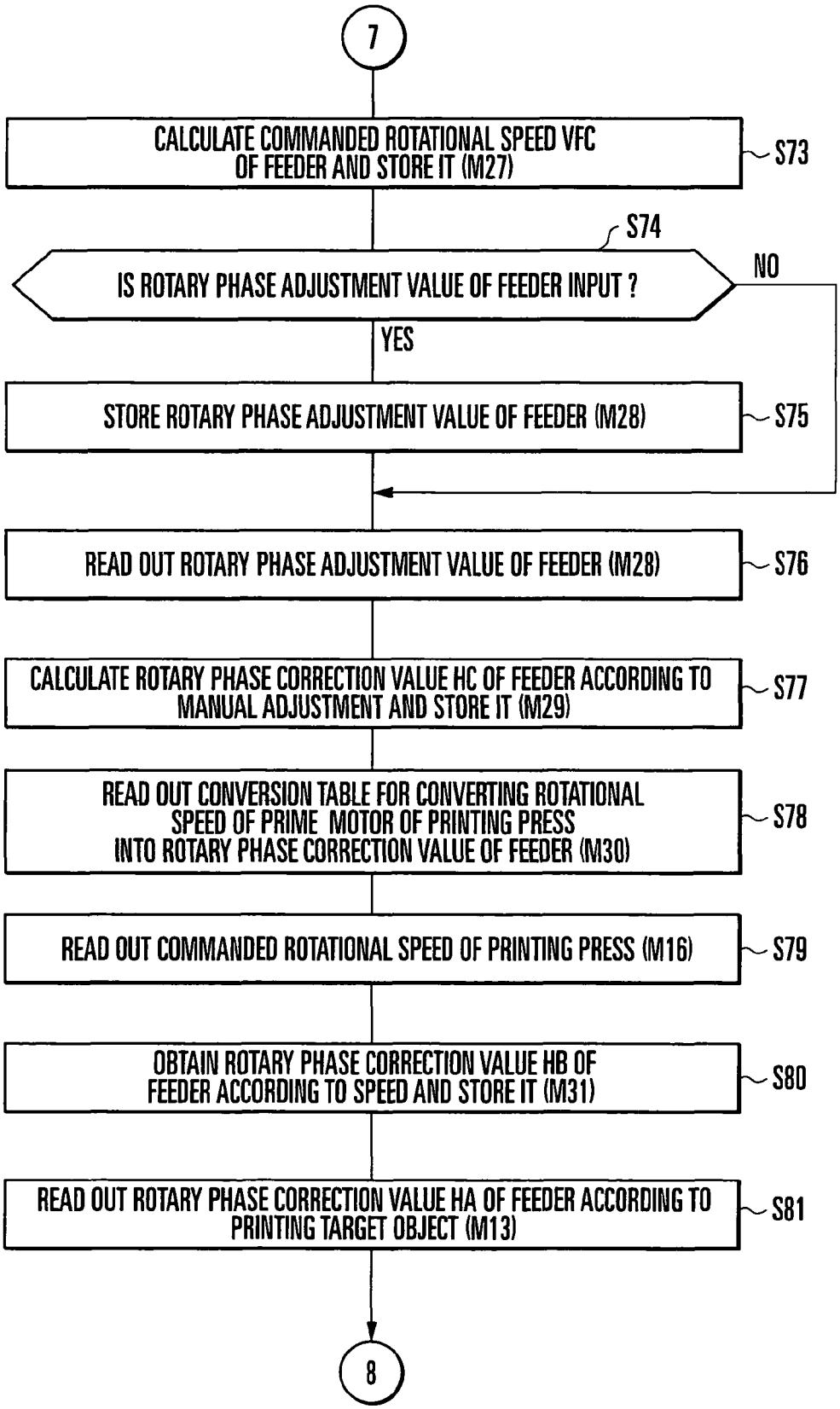
Figure 6F:
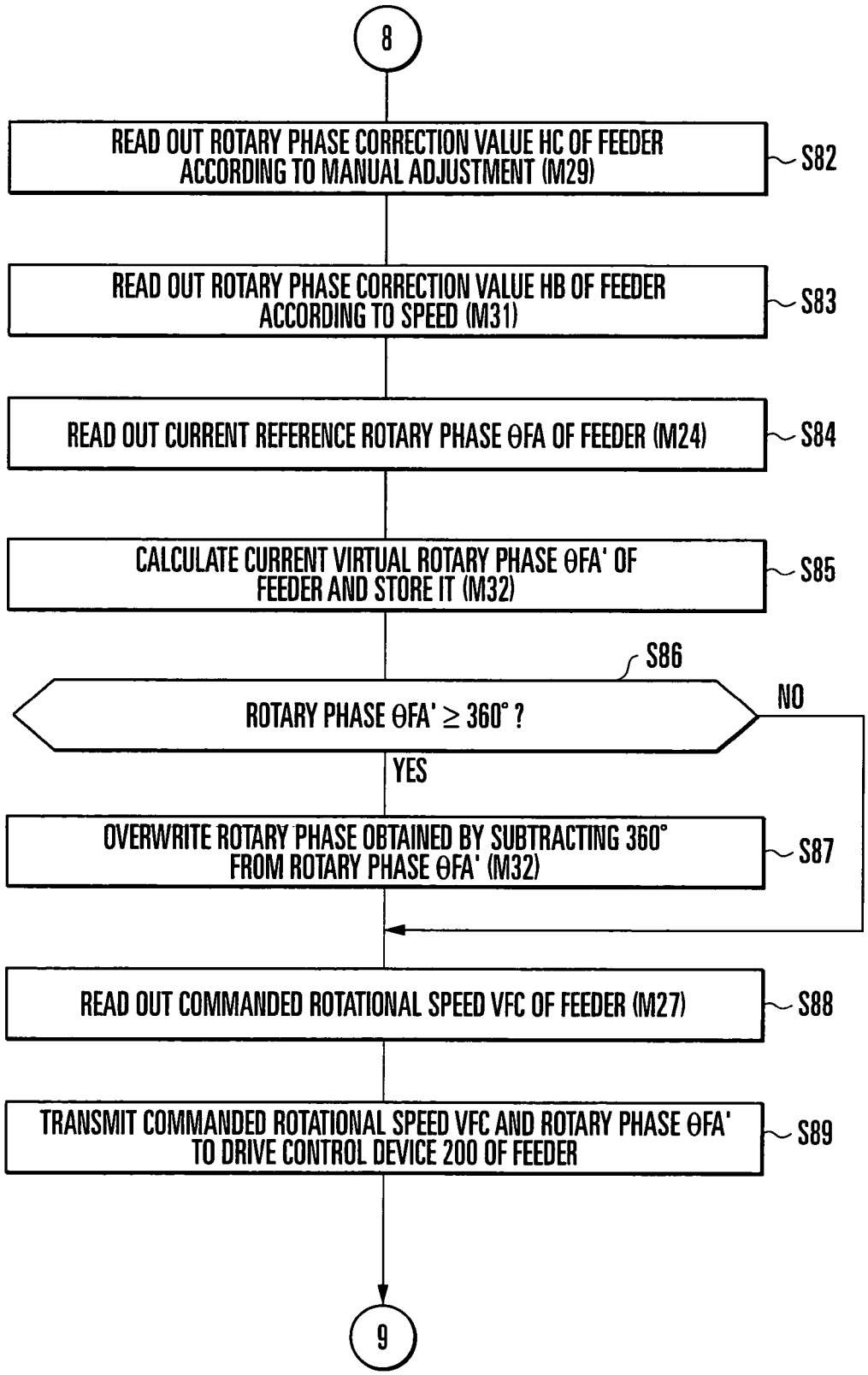
Figure 6G:
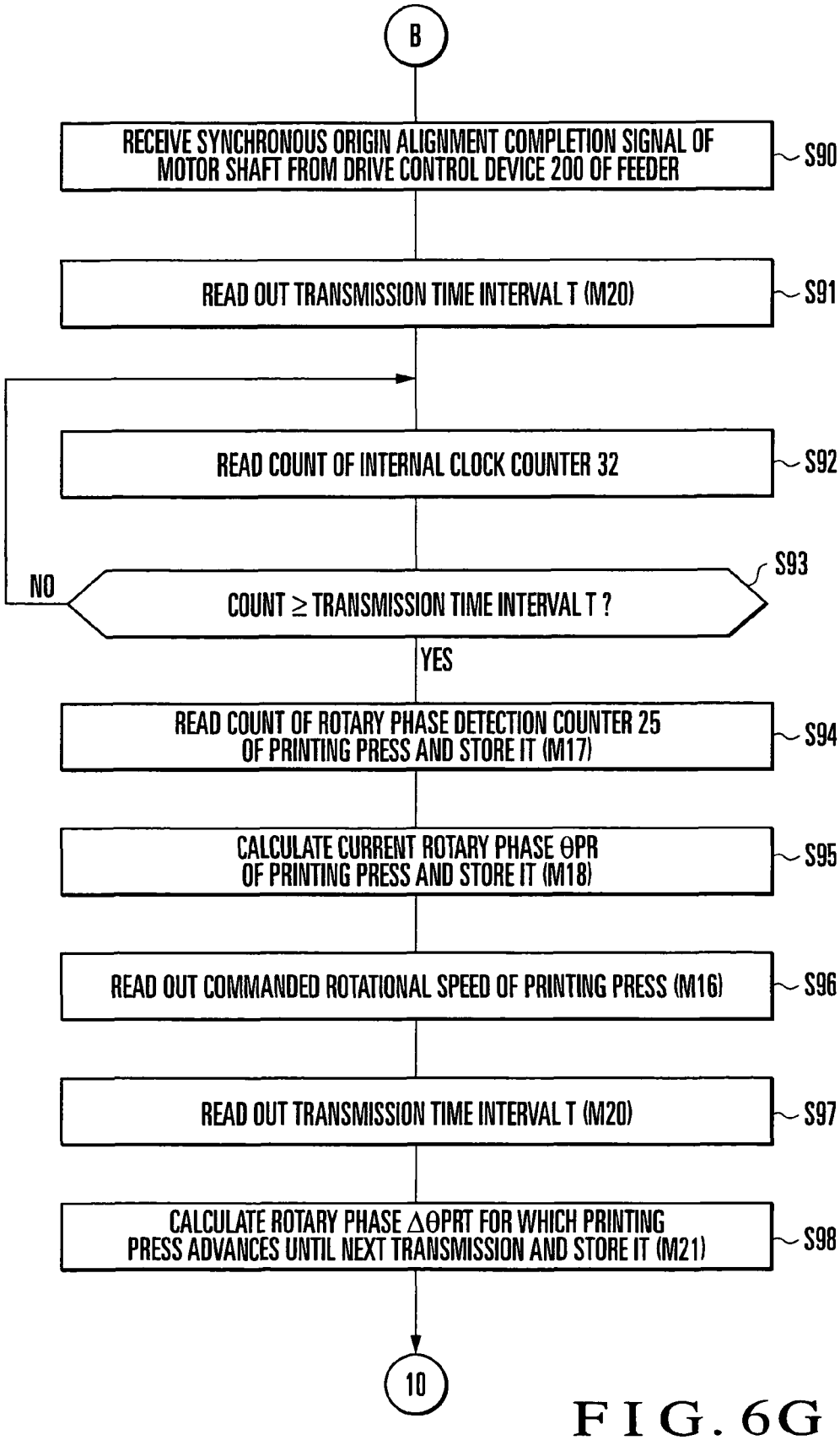
Figure 6H:
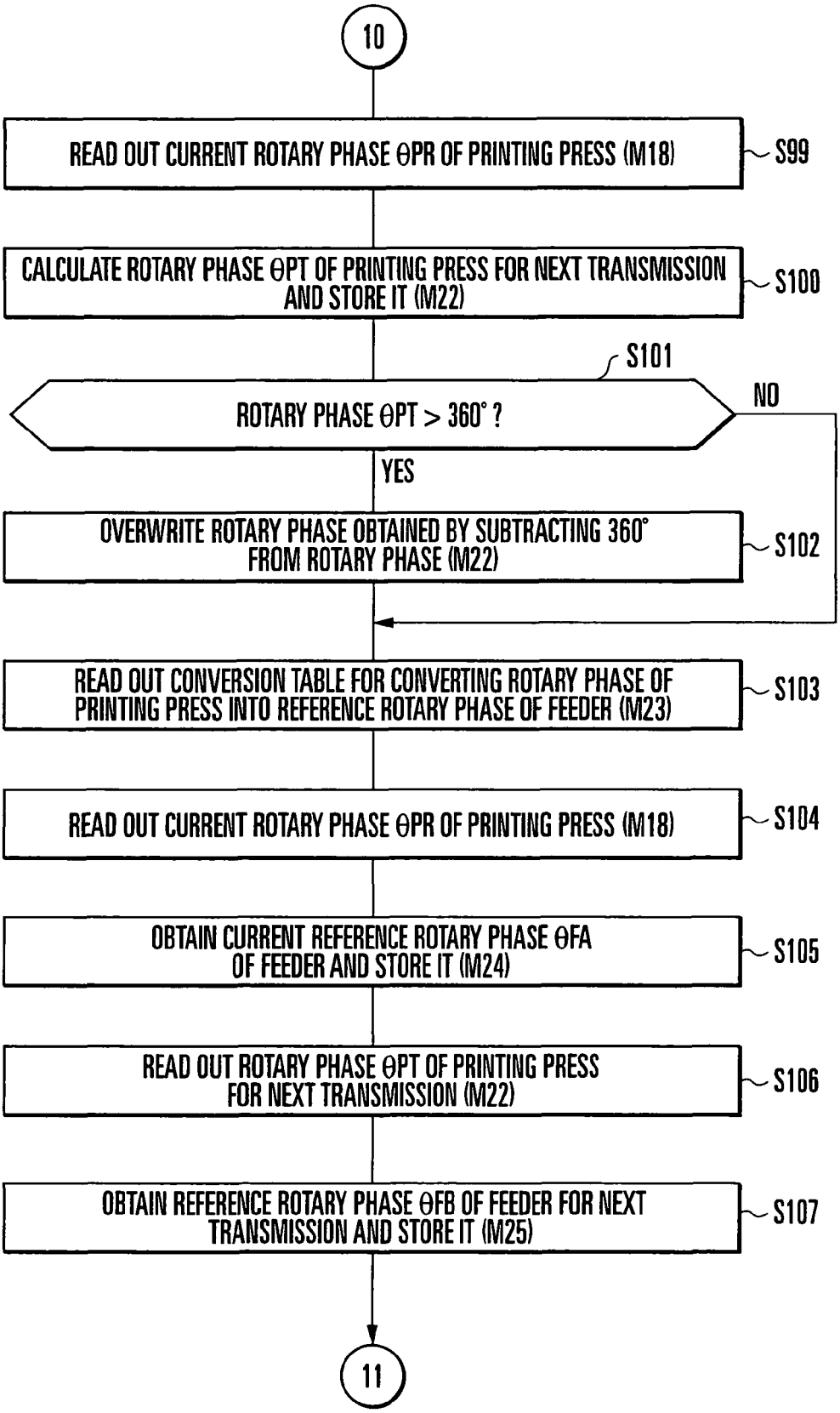
Figure 6I:
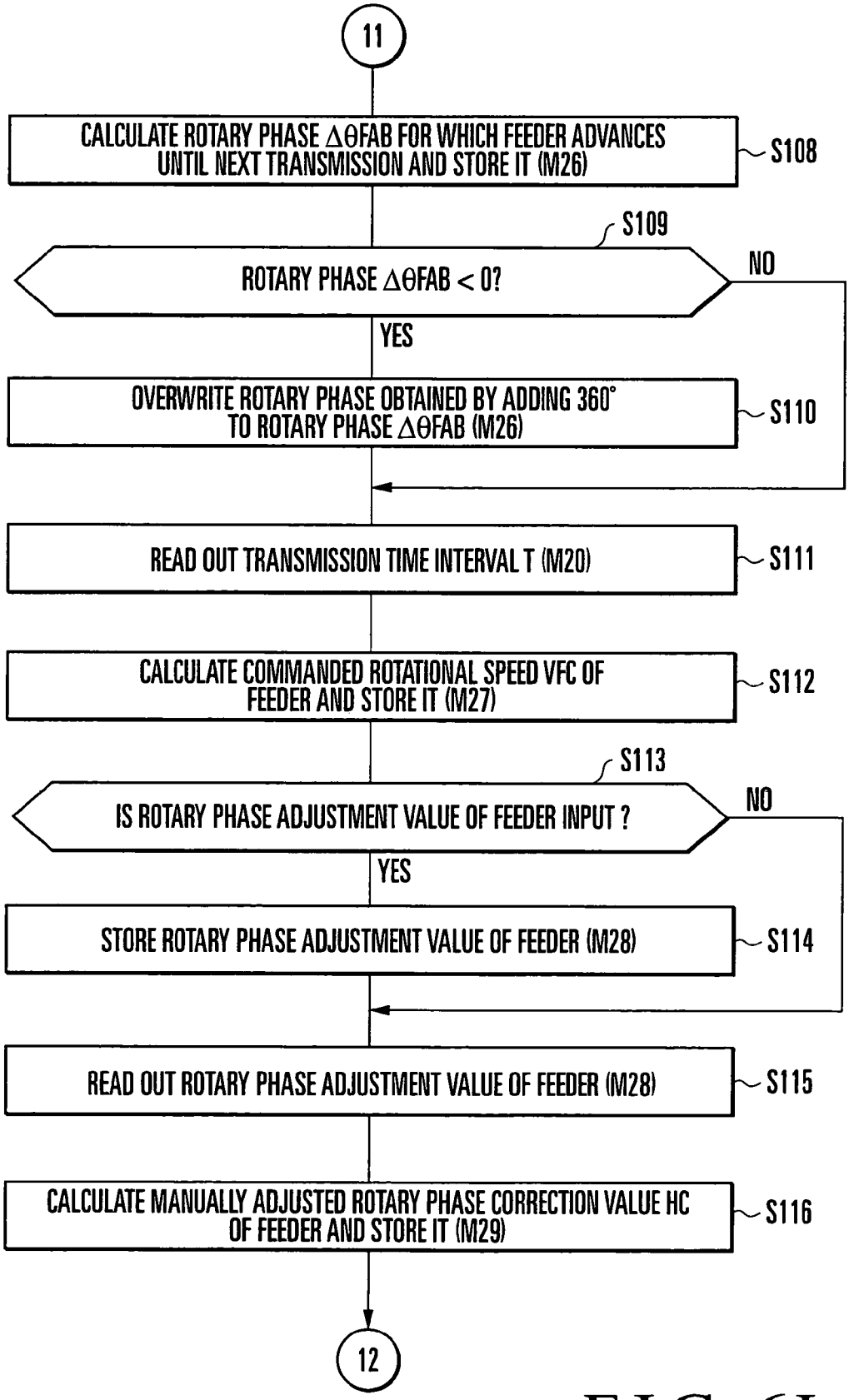
Figure 6J:
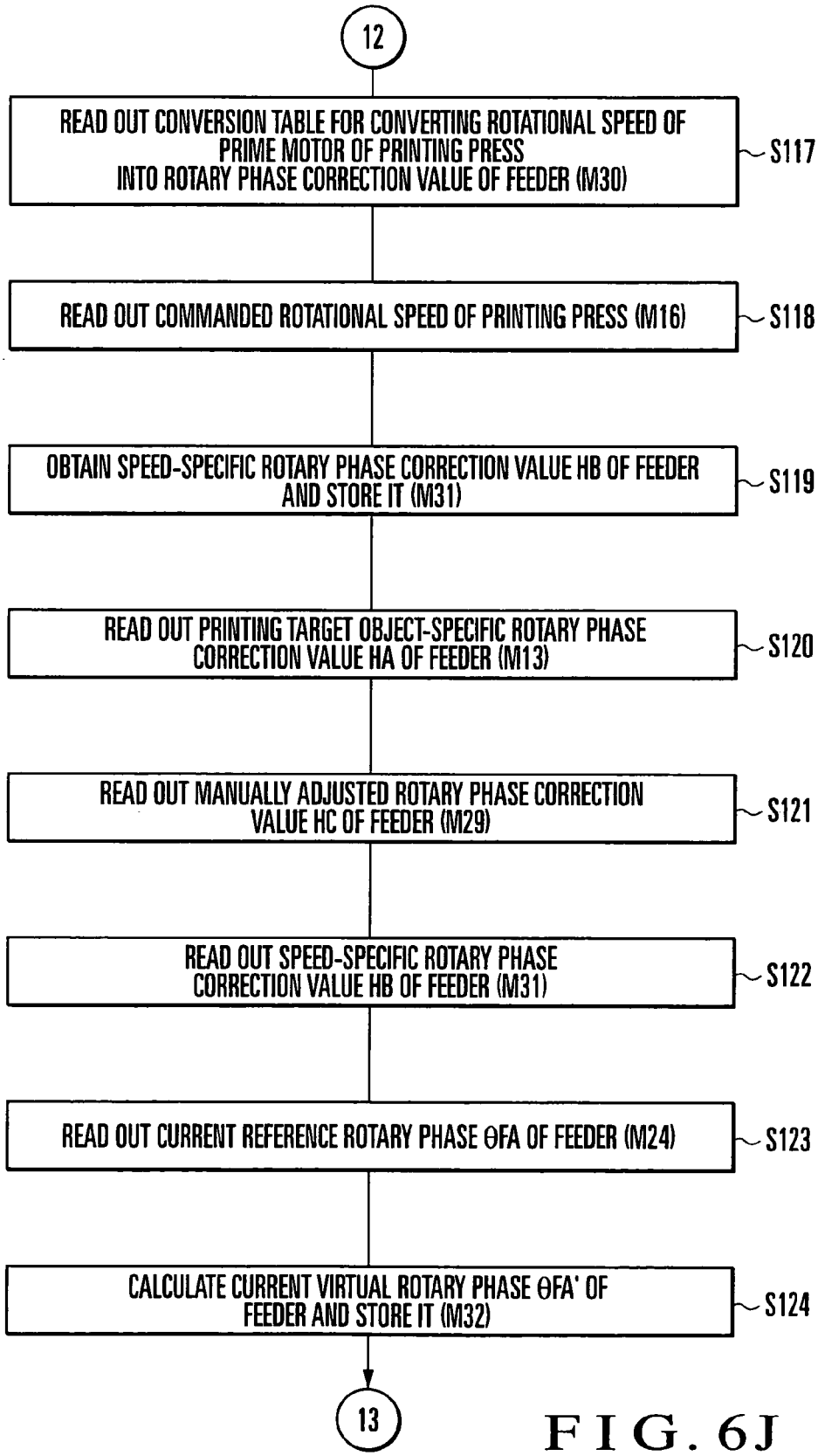

Then, the CPU 1 reads out the time interval T of transmission to the drive control device 200 of the feeder from the memory M20 (step S72), divides the rotary phase ΔθFAB, for which the feeder advances until the next transmission, by the transmission time interval T, and stores the division result in the memory M27 as the commanded rotational speed VFC (VFC=ΔθFAB/T) of the feeder (step S73 in FIG. 6E).

Then, the CPU 1 checks whether or not the rotary phase adjustment value (manual adjustment value) of the feeder is input from the feeder rotary phase setter 14 (step S74). If the rotary phase adjustment value of the feeder is input (YES in step S74), the CPU 1 reads out the rotary phase adjustment value of the feeder from the feeder rotary phase adjustment value setter 14 and stores it in the memory M28 (step S75). In this example, assume that the rotary phase adjustment value of the feeder is not yet input from the feeder rotary phase adjustment value setter 14, and that the rotary phase adjustment value of the feeder in the memory M28 is zero (initial value).

Then, the CPU 1 reads out the rotary phase adjustment value of the feeder from the memory M28 (step S76), calculates a manually adjusted rotary phase correction value HC of the feeder from the readout rotary phase adjustment value of the feeder, and stores the rotary phase correction value HC in the memory M29 (step S77). In this example, since the rotary phase adjustment value of the feeder which is read out from the memory M28 is zero, the manually adjusted rotary phase correction value HC of the feeder is also zero.

Then, the CPU 1 reads out the conversion table for converting the rotational speed of the prime motor of the offset sheet-fed printing press into the rotary phase correction value of the feeder from the memory M30 (step S78). The conversion table for converting the rotational speed of the prime motor of the offset sheet-fed printing press into the rotary phase correction value of the feeder is a table showing the relationship between the rotational speed of the prime motor of the offset sheet-fed printing press and the rotary phase correction value of the feeder, and is determined through repeated experiments.

Then, the CPU 1 reads out the commanded rotational speed VPC (slower rotational speed VPL) of the offset sheet-fed printing press from the memory M16 (step S79), obtains the rotary phase correction value of the feeder corresponding to the commanded rotational speed VPC of the offset sheet-fed printing press using the conversion table for converting the rotational speed of the prime motor of the offset sheet-fed printing press into the rotary phase correction value of the feeder, which table is read out from the memory M30, and stores the obtained rotary phase correction value in the memory M31 as a speed-specific rotary phase correction value HB of the feeder (step S80).

Then, the CPU 1 reads out a rotary phase correction value HA of the feeder which is specific to the printing target object from the memory M13 (step S81), the manually adjusted rotary phase correction value HC of the feeder from the memory M29 (step S82 in FIG. 6F), the speed-specific rotary phase correction value HB of the feeder from the memory M31 (step S83), and the current reference rotary phase θFA of the feeder from the memory M24 (step S84).

Then, the CPU 1 adds the rotary phase correction value HA of the feeder which is specific to the printing target object, the speed-specific rotary phase correction value HB of the feeder, and the manually adjusted rotary phase correction value HC of the feeder to the current reference rotary phase θFA of the feeder, and stores the addition result in the memory M32 as a current virtual rotary phase θFA' (θFA'=θFA+HA+HB+HC) (see FIG. 16C) of the feeder (step S85).

If the current virtual rotary phase θFA' of the feeder is equal to or more than 360° (YES in step S86), the CPU 1 subtracts 360° from the current virtual rotary phase θFA' of the feeder, and overwrites the obtained rotary phase in the memory M32 as the current virtual rotary phase θFA' of the feeder (step S87).

Figure 15C:
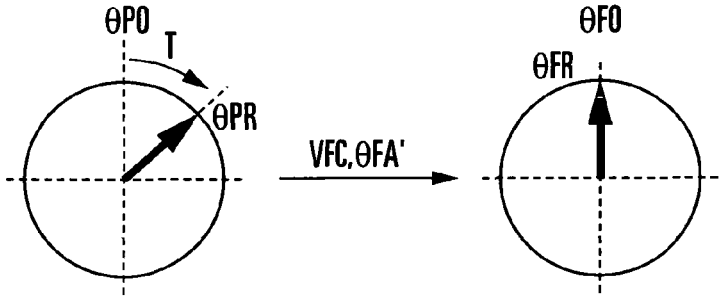

Then, the CPU 1 reads out the commanded rotational speed VFC of the feeder from the memory M27 (step S88) and transmits the commanded rotational speed VFC and current virtual rotary phase θFA' of the feeder to the drive control device 200 of the feeder (step S89; see FIG. 15C). After transmitting the commanded rotational speed VFC and current virtual rotary phase θFA' of the feeder, the CPU 1 returns to the process of step S48 (FIG. 6B).

When the commanded rotational speed VFC and current virtual rotary phase θFA' of the feeder are transmitted from the drive control device 100 of the offset sheet-fed printing press (YES in step S412, FIG. 12A), the CPU 51 receives them and stores them in the memories M52 and M53, respectively (step S413).

Then, the CPU 51 reads the count of the feeder rotary phase detection counter 66 and stores it in the memory M54 (step S414). The CPU 51 calculates a current rotary phase θFR of the feeder from this count and stores it in the memory M55 (step S415). The CPU 51 then reads out the current virtual rotary phase θFA' of the feeder which is transmitted from the CPU 51 of the drive control device 200 of the feeder and stored in the memory M53 (step S416).

If the current virtual rotary phase θFA' of the feeder satisfies θFA'>340° (YES in step S417, FIG. 12B) and the current rotary phase θFR of the feeder satisfies θFR<20° (step S418, YES in S419), the CPU 51 adds 360° to the current rotary phase θFR of the feeder, and overwrites the obtained rotary phase in the memory M55 as the current rotary phase θFR of the feeder (step S420).

If the current virtual rotary phase θFA' of the feeder satisfies θFA'<20° (YES in step S421) and the current rotary phase θFR of the feeder satisfies θFR>340° (step S422, YES in S423), the CPU 51 adds 360° to the current virtual rotary phase θFA of the feeder, and overwrites the obtained rotary phase in the memory M53 as the current virtual rotary phase θFA' of the feeder (step S424).

Figure 12A:
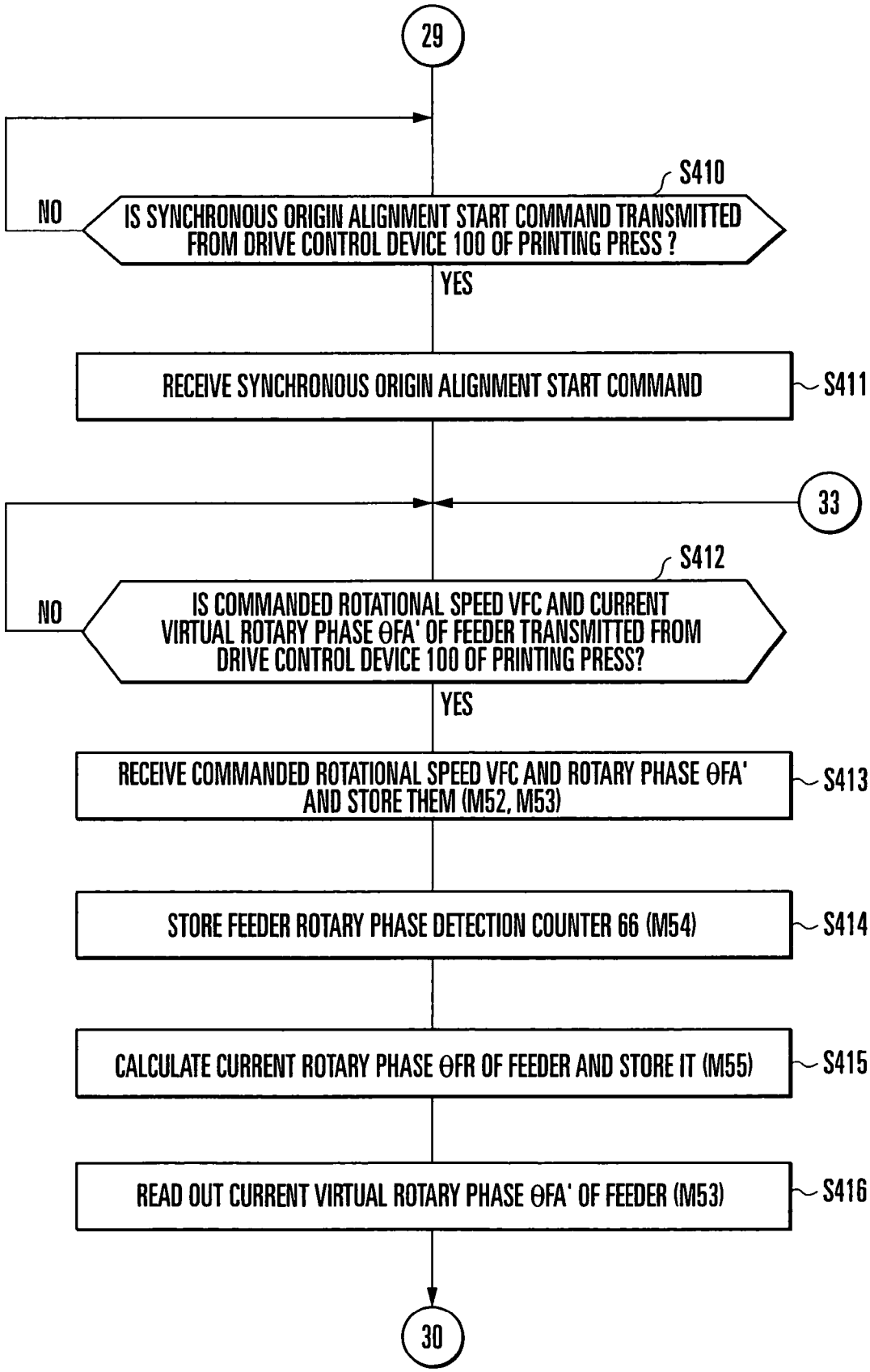
FIGS. 12A to 12D are flowcharts showing the processing operation of synchronous origin alignment of the offset sheet-fed printing press and feeder.
Figure 12B:
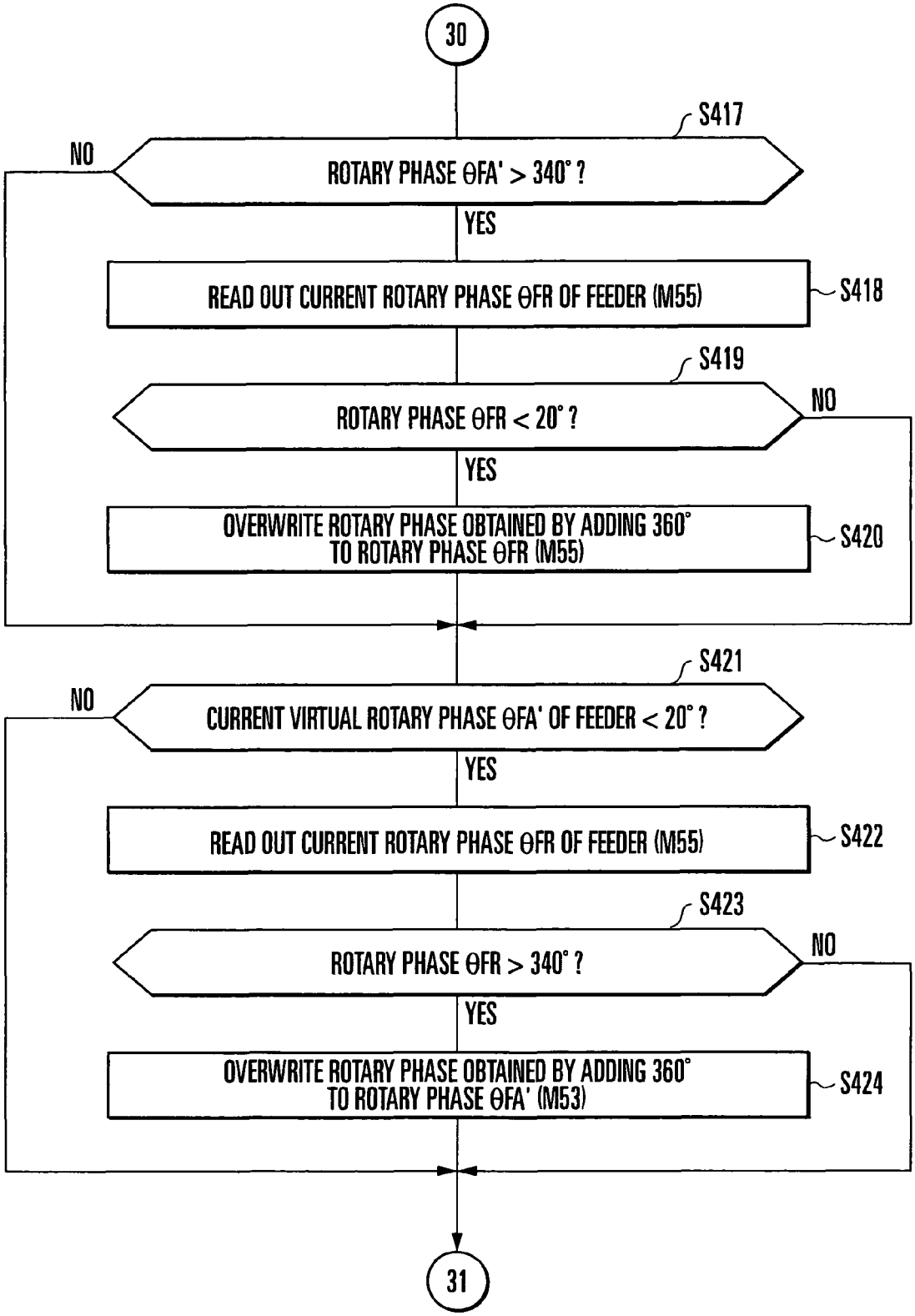
Figure 12C:
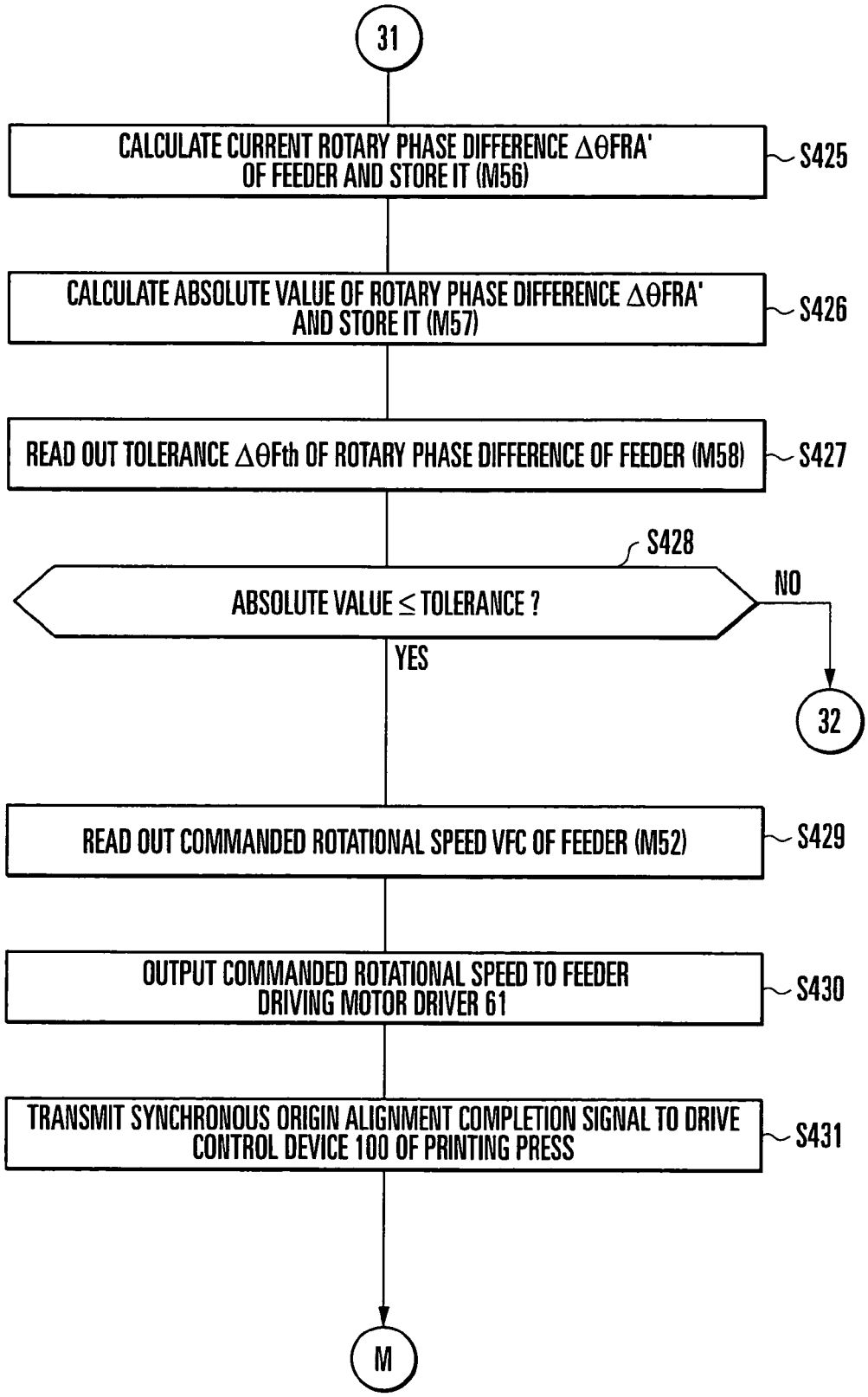
Figure 12D:
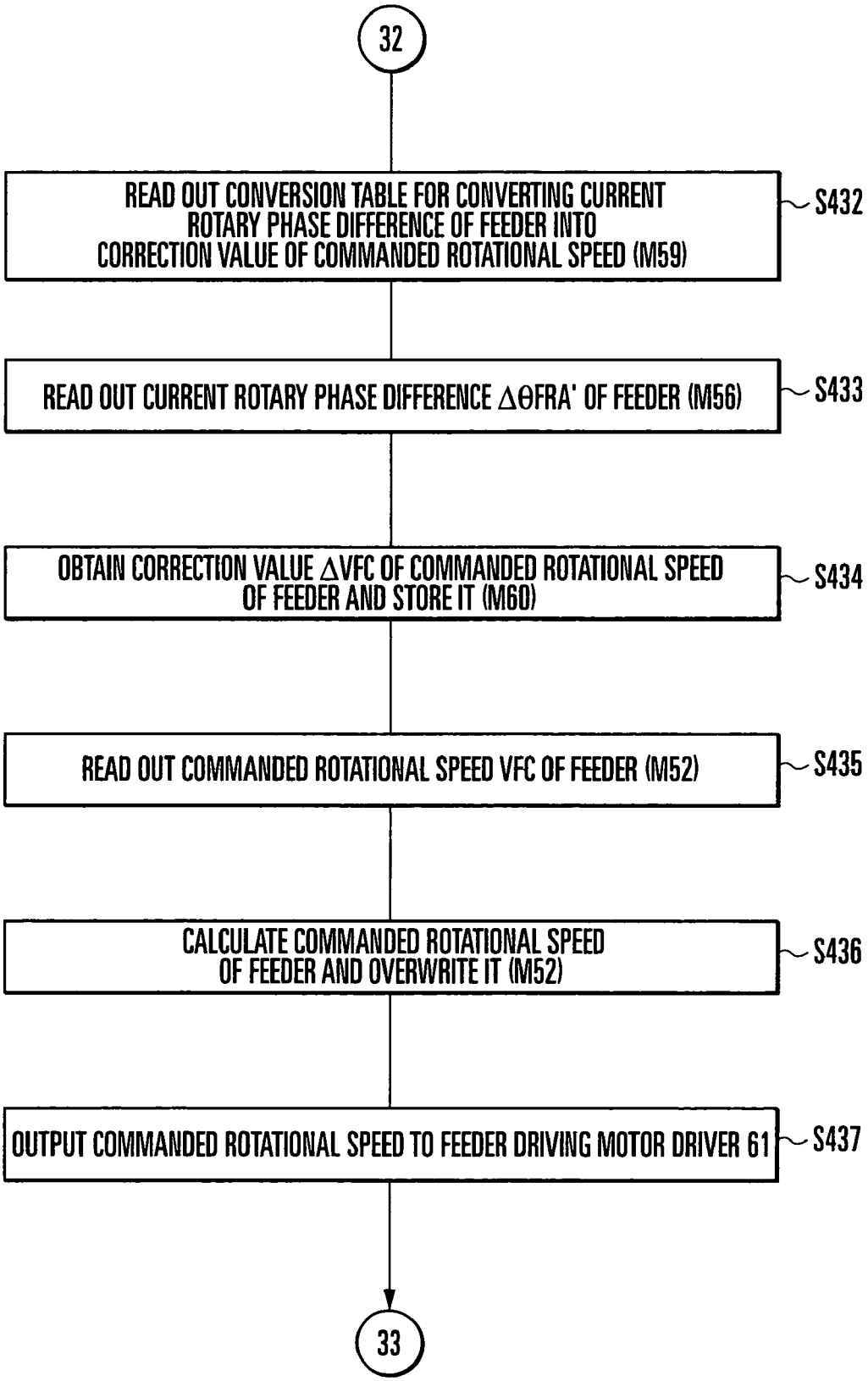
Figure 13A:
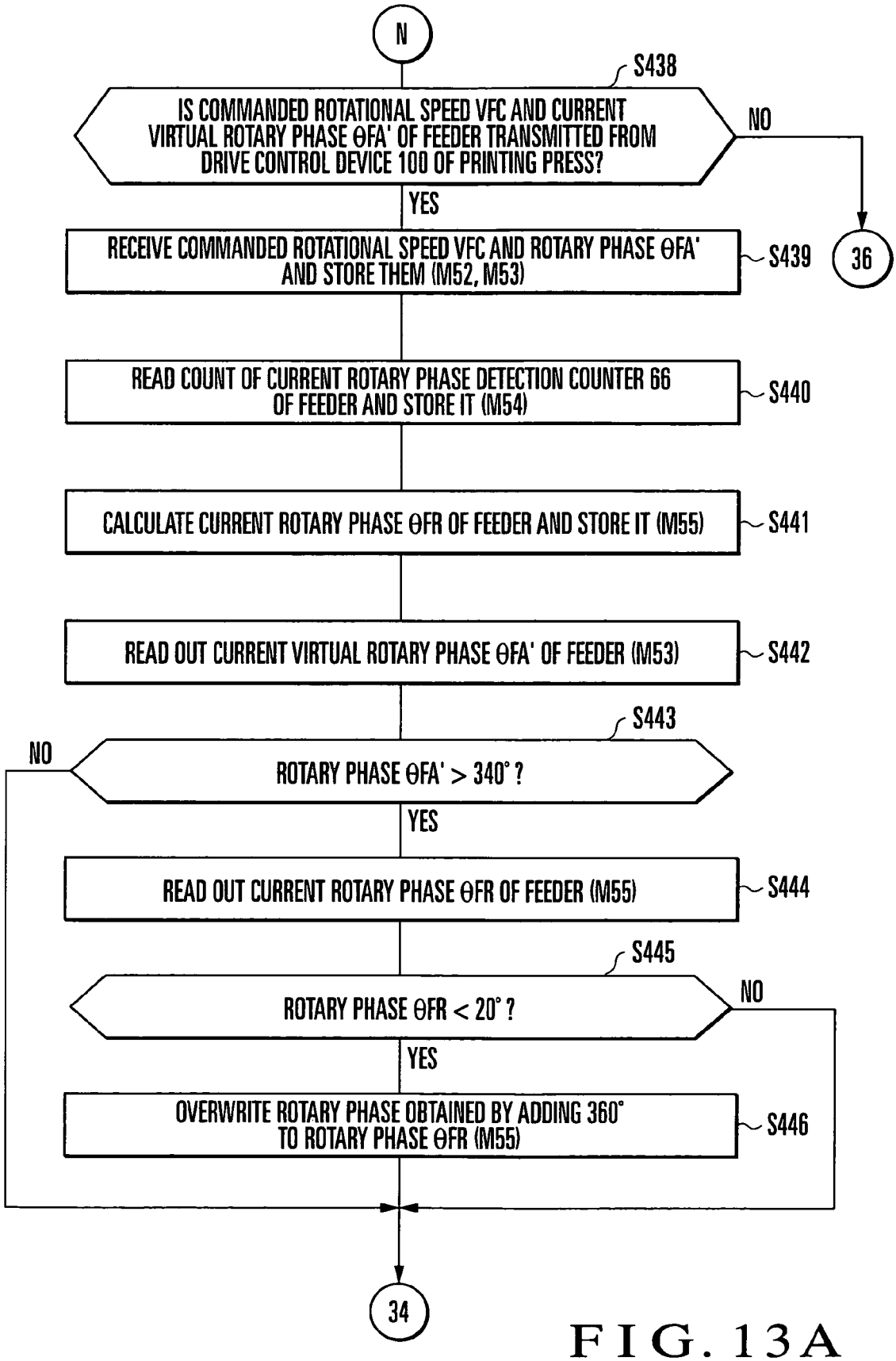
FIGS. 13A to 13C are flowcharts showing the processing operation including acceleration, deceleration, normal printing speed, and stopping the offset sheet-fed printing press.
Figure 13B:
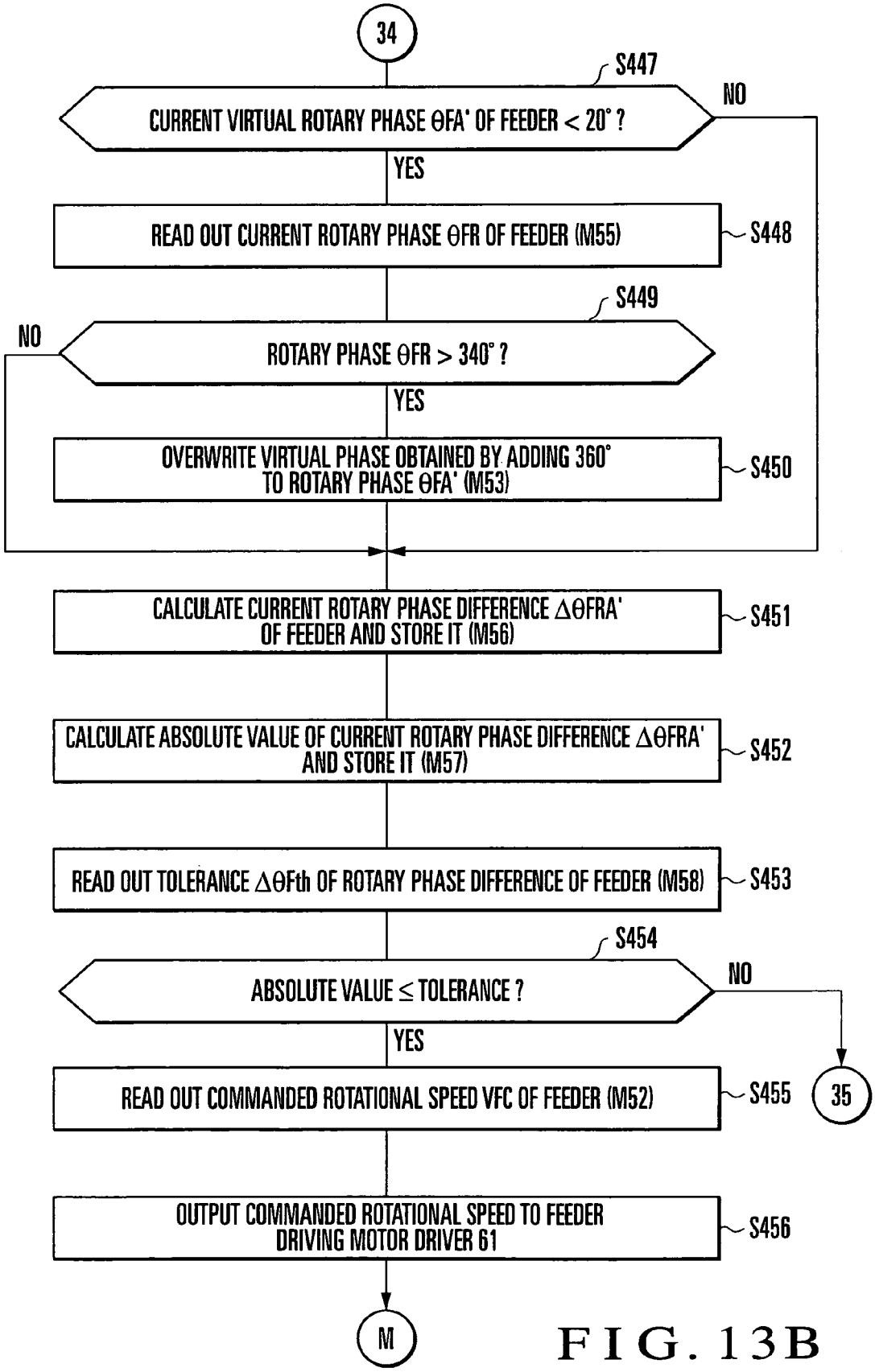
Figure 13C:
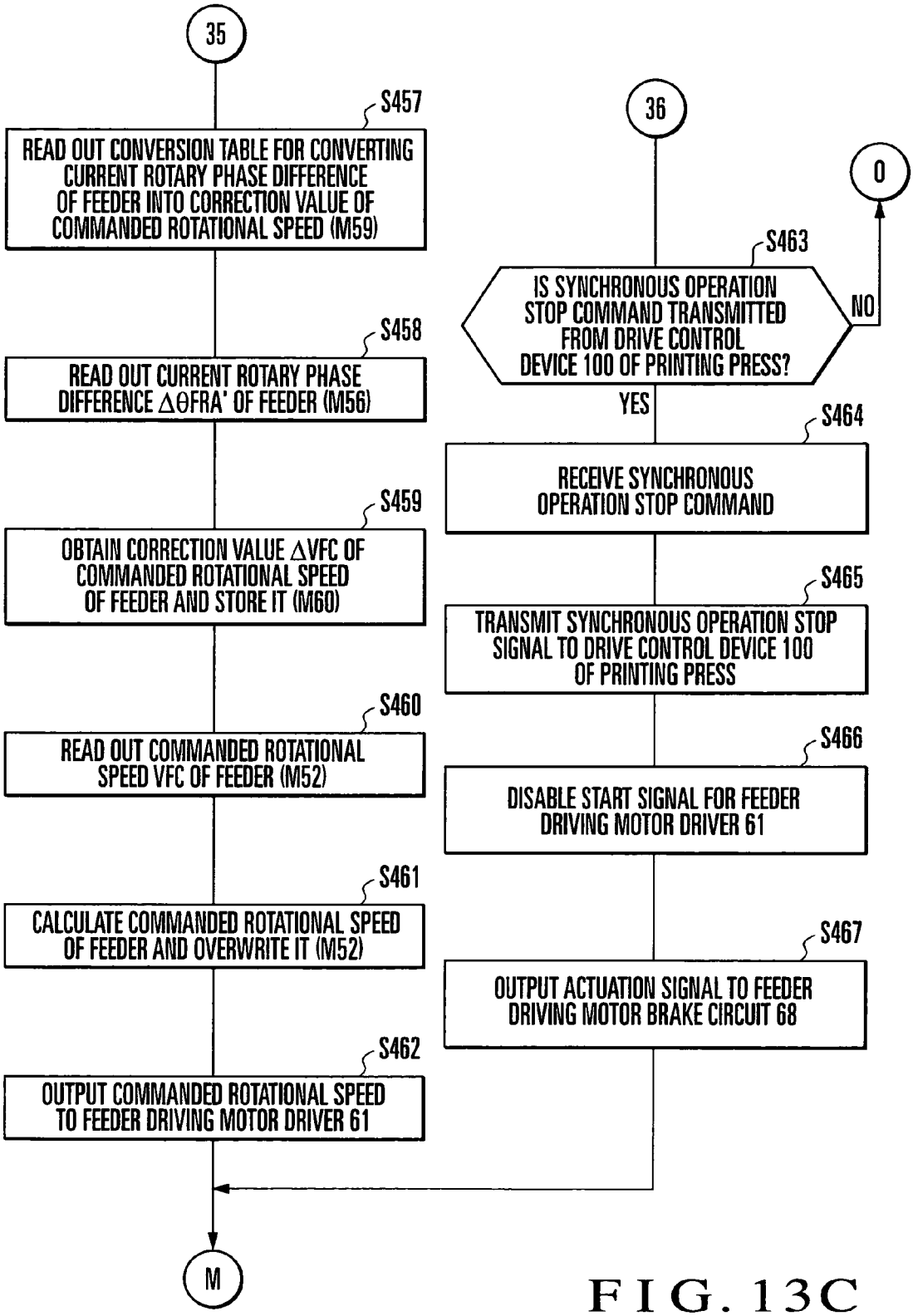
Figure 14:
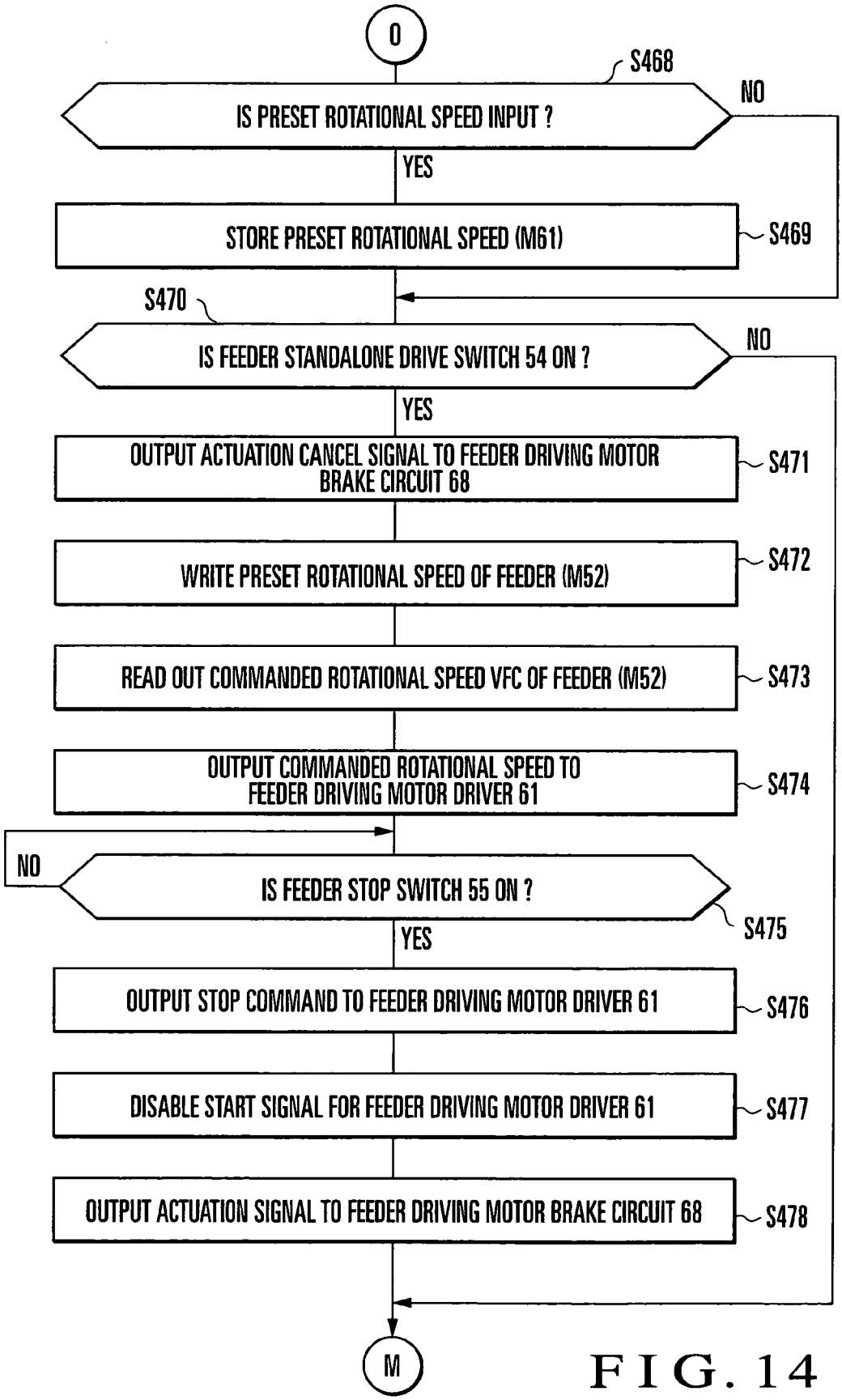

Then, the CPU 51 subtracts the current rotary phase θFR of the feeder from the current virtual rotary phase θFA' of the feeder to obtain a current rotary phase difference ΔθFRA' of the feeder (see FIG. 16D), and stores the obtained current rotary phase difference ΔθFRA' of the feeder in the memory M56 (step S425 in FIG. 12C). The CPU 51 also obtains the absolute value of the current rotary phase difference ΔθFRA' of the feeder from the current rotary phase difference ΔθFRA' of the feeder and stores it in the memory M57 (step S426). The CPU 51 then reads out a tolerance ΔθFth of the rotary phase difference of the feeder which is set in the memory M58

(step S427) and compares it with the absolute value of the current rotary phase difference ΔθFRA' of the feeder (step S428).

If the absolute value of the current rotary phase difference ΔθFRA' of the feeder is larger than the tolerance ΔθFth of the rotary phase difference of the feeder (NO in step S428), the CPU 51 reads out the conversion table for converting the current rotary phase difference of the feeder into the correction value of the commanded rotational speed from the memory M59 (step S432 in FIG. 12D) and the current rotary phase difference ΔθFRA' of the feeder from the memory M56 (step S433). The CPU 51 obtains a correction value ΔVFC of the commanded rotational speed corresponding to the current rotary phase difference ΔθFRA' of the feeder using the conversion table for converting the current rotary phase difference of the feeder into the correction value of the commanded rotational speed, and stores it in the memory M60 (step S434).

Then, the CPU 51 reads out the commanded rotational speed VFC of the feeder from the memory M52 (step S435), adds the correction value ΔVFC of the commanded rotational speed of the feeder to the commanded rotational speed VFC of the feeder, overwrites the obtained rotational speed in the memory M52 as the commanded rotational speed VFC (step S436), and outputs the commanded rotational speed VFC to the feeder driving motor driver 61 (step S437). Thus, the feeder driving motor 62 starts to rotate at the corrected commanded rotational speed VFC.

As described above, after the rotary phase θPR of the offset sheet-fed printing press reaches the synchronous standby position θP0, when the transmission time interval T elapses, the CPU 1 of the drive control device 100 of the offset sheet-fed printing press transmits the commanded rotational speed VFC and current virtual rotary phase θFA' of the feeder to the drive control device 200 of the feeder. If a synchronous origin alignment completion signal (to be described later) is not sent back from the drive control device 200 of the feeder until the next transmission time interval T elapses (NO in steps S52, S53, and S54 in FIG. 6B), the CPU 1 repeats the processes of steps S55 (FIG. 6B) to S89 (FIG. 6F), to repeatedly transmit the commanded rotational speed VFC and current virtual rotary phase θFA' of the feeder to the drive control device 200 of the feeder.

Every time the commanded rotational speed VFC and current virtual rotary phase θFA' of the feeder are transmitted from the drive control device 100 of the offset sheet-fed printing press (YES in step S412, FIG. 12A), the CPU 51 repeats the processes from step S413.

Figure 15D:
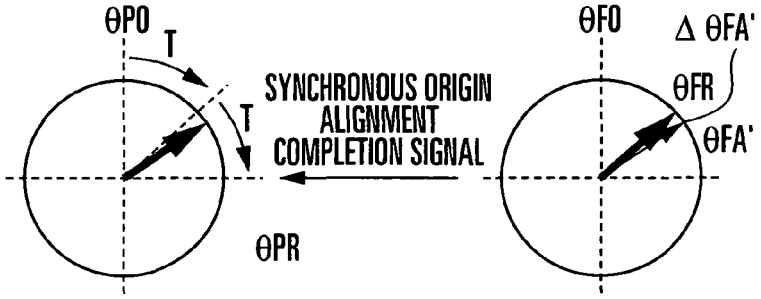

During these processes, when the absolute value of the current rotary phase difference θFRA' of the feeder becomes equal to or less than the tolerance θFth of the rotary phase difference of the feeder (YES in step S428, FIG. 12C), the CPU 51 reads out the commanded rotational speed VFC of the feeder from the memory M52 (step S429) and outputs it to the feeder driving motor driver 61 (step S430). The CPU 51 then transmits the synchronous origin alignment completion signal to the drive control device 100 of the offset sheet-fed printing press (step S431). FIG. 15D shows this state.

Figure 15E:
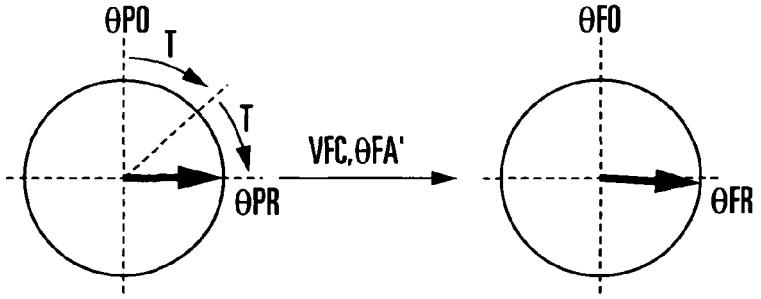

When the synchronous origin alignment completion signal is transmitted from the drive control device 200 of the feeder while counting the transmission time interval T (YES in step S53, FIG. 6B), the CPU 1 of the drive control device 100 of the offset sheet-fed printing press receives it from the drive control device 200 of the feeder (step S90 in FIG. 6G), reads out the time interval T of transmission to the drive control device 200 of the feeder from the memory M20 (step S91), and reads the count of the internal clock counter 32 (step S92). When the count of the internal clock counter 32 becomes equal to or more than the transmission time interval T (YES in step S93), the CPU 1 advances to step S94 and performs the processes of steps S94 (FIG. 6G) to S128 (FIG. 6K) similar to those of steps S55 (FIG. 6B) to S89 (FIG. 6F) to transmit the commanded rotational speed VFC and current virtual rotary phase θFA' of the feeder to the drive control device 200 of the feeder (see FIG. 15E).

Then, the CPU 1 reads out the commanded rotational speed VPC (slower rotational speed VPL) of the offset sheet-fed printing press from the memory M16 (step S129), outputs the commanded rotational speed VPC to the prime motor driver 17 of the offset sheet-fed printing press (step S130), and writes the commanded rotational speed VPC in the memory M33 as a previous commanded rotational speed VPCold of the offset sheet-fed printing press (step S131).

Then, the CPU 1 outputs a reset signal and enable signal to the internal clock counter 32 (step S132 in FIG. 7A) and stops outputting the reset signal to the internal clock counter 32 (step S133), so that the internal clock counter 32 starts counting clock pulses from zero.

[Acceleration]

Then, the CPU 1 checks whether or not a rotational speed VP is input to the rotational speed setter 15 (step S134). If the rotational speed VP is input (YES in step S134), the CPU 1 reads it from the rotational speed setter 15 and stores it in the memory M15 as the preset rotational speed VPS (step S135). In this example, assume that a speed of final printing is input as the rotational speed VP. Hence, in response to YES in step S134, the CPU 1 advances to step S135 and stores the speed of final printing in the memory M15 as the preset rotational speed VPS.

Then, the CPU 1 reads out the preset rotational speed VPS of the offset sheet-fed printing press from the memory M15 (step S136) and the previous commanded rotational speed VPCold of the offset sheet-fed printing press from the memory M33 (step S137), and compares the former with the latter (step S138).

Figure 7A:
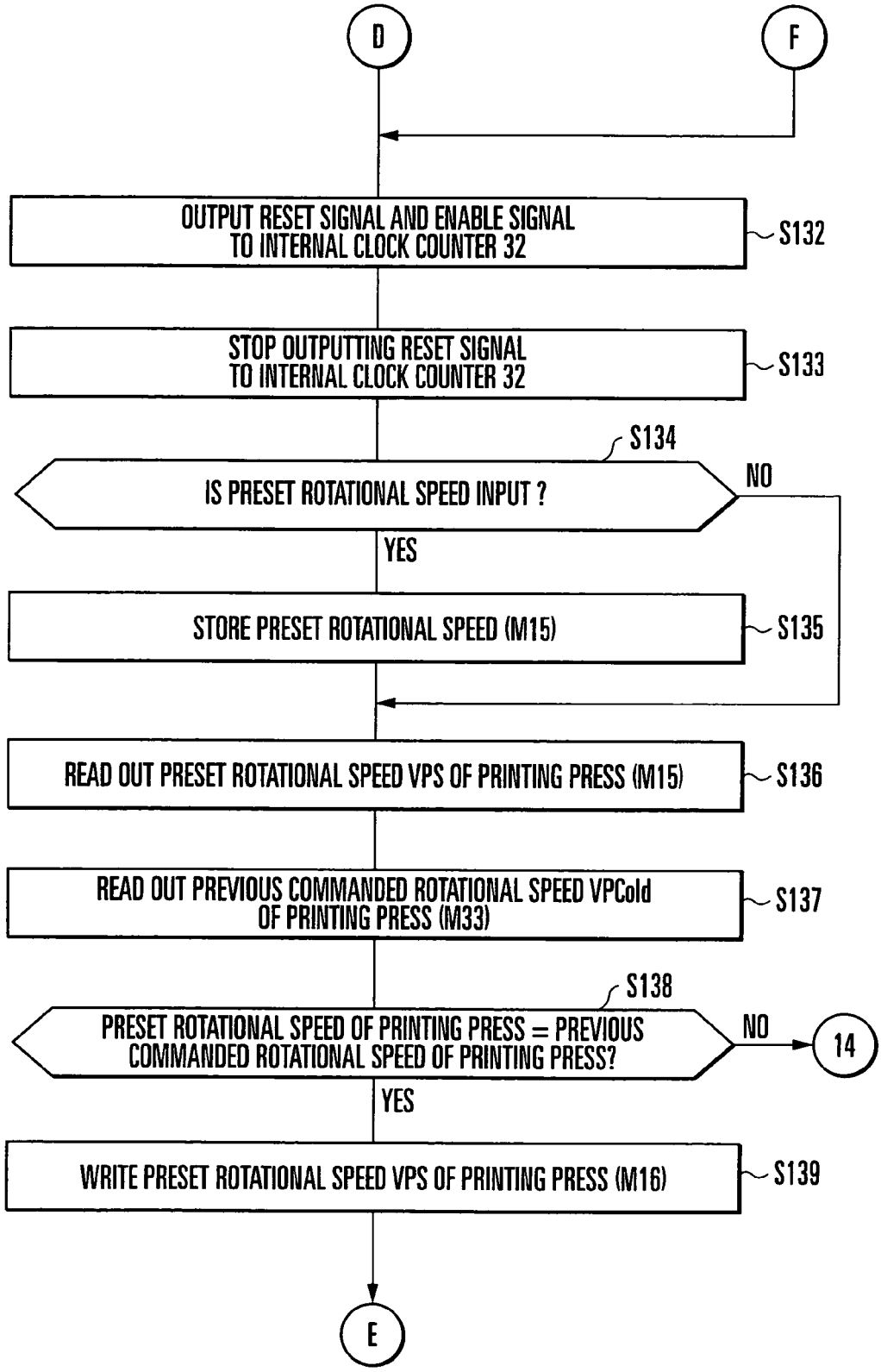
FIGS. 7A to 7G are flowcharts showing the processing operation including acceleration, deceleration, and normal printing speed.
Figure 7B:
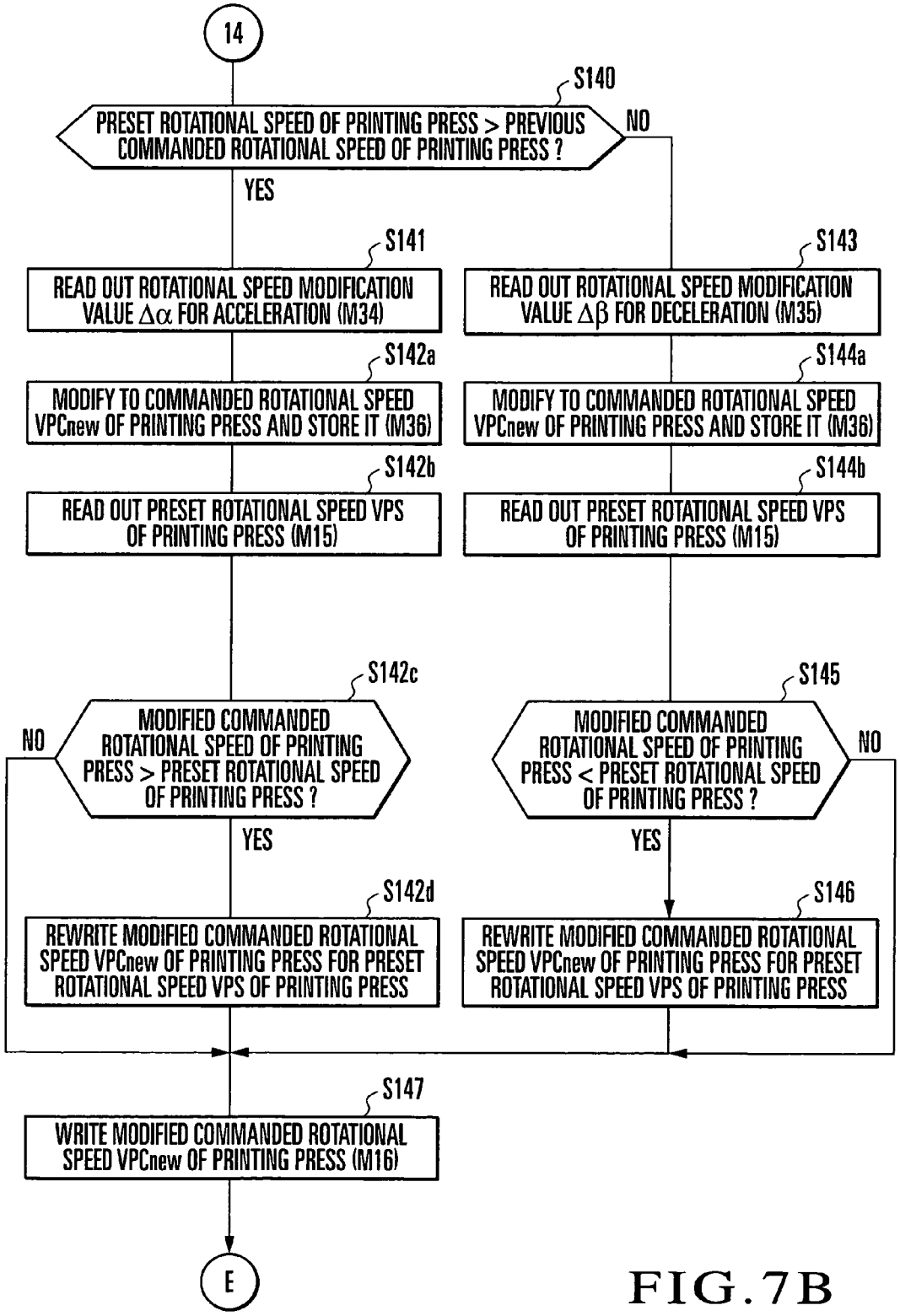
Figure 7C:
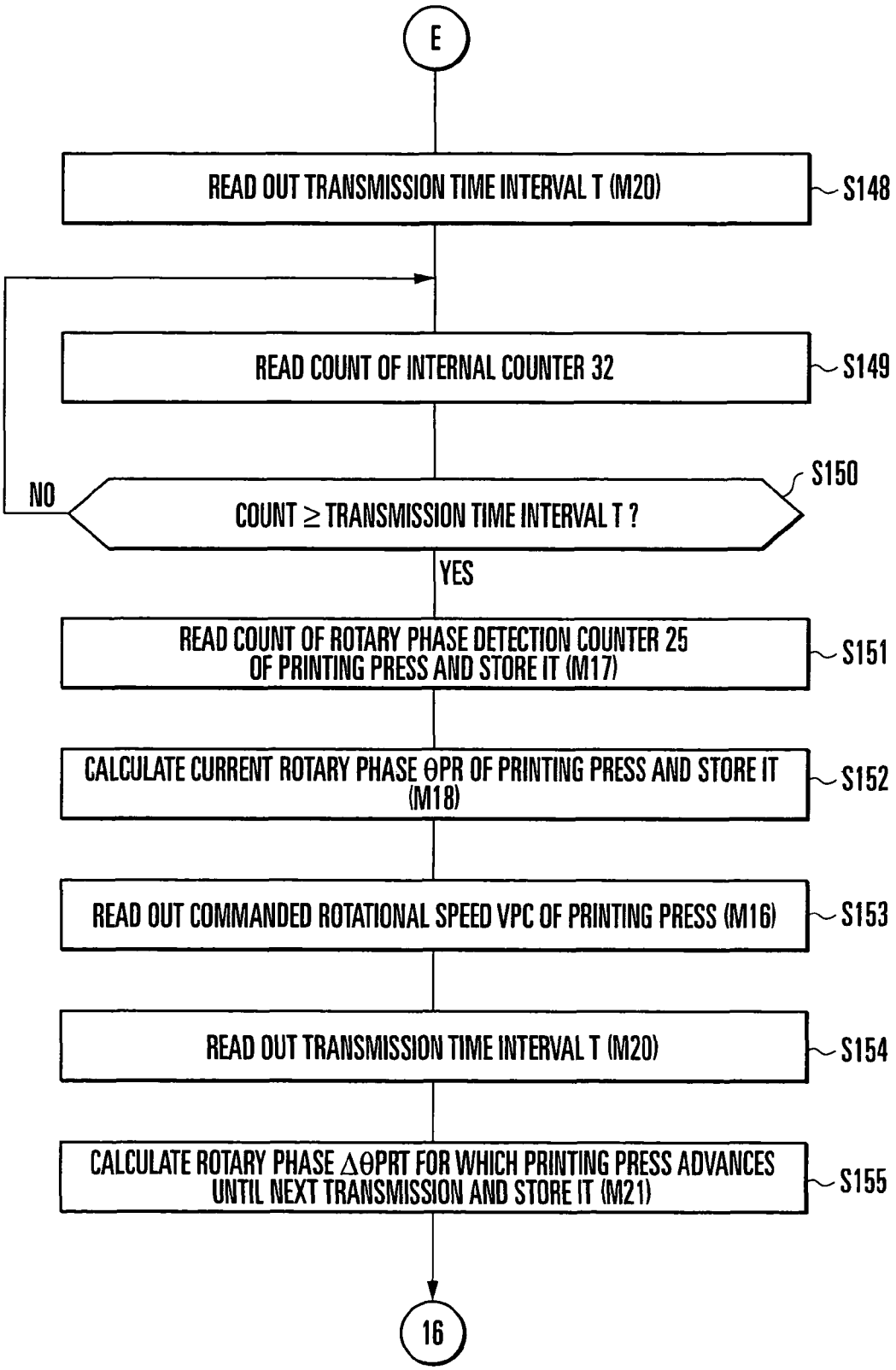
Figure 7D:
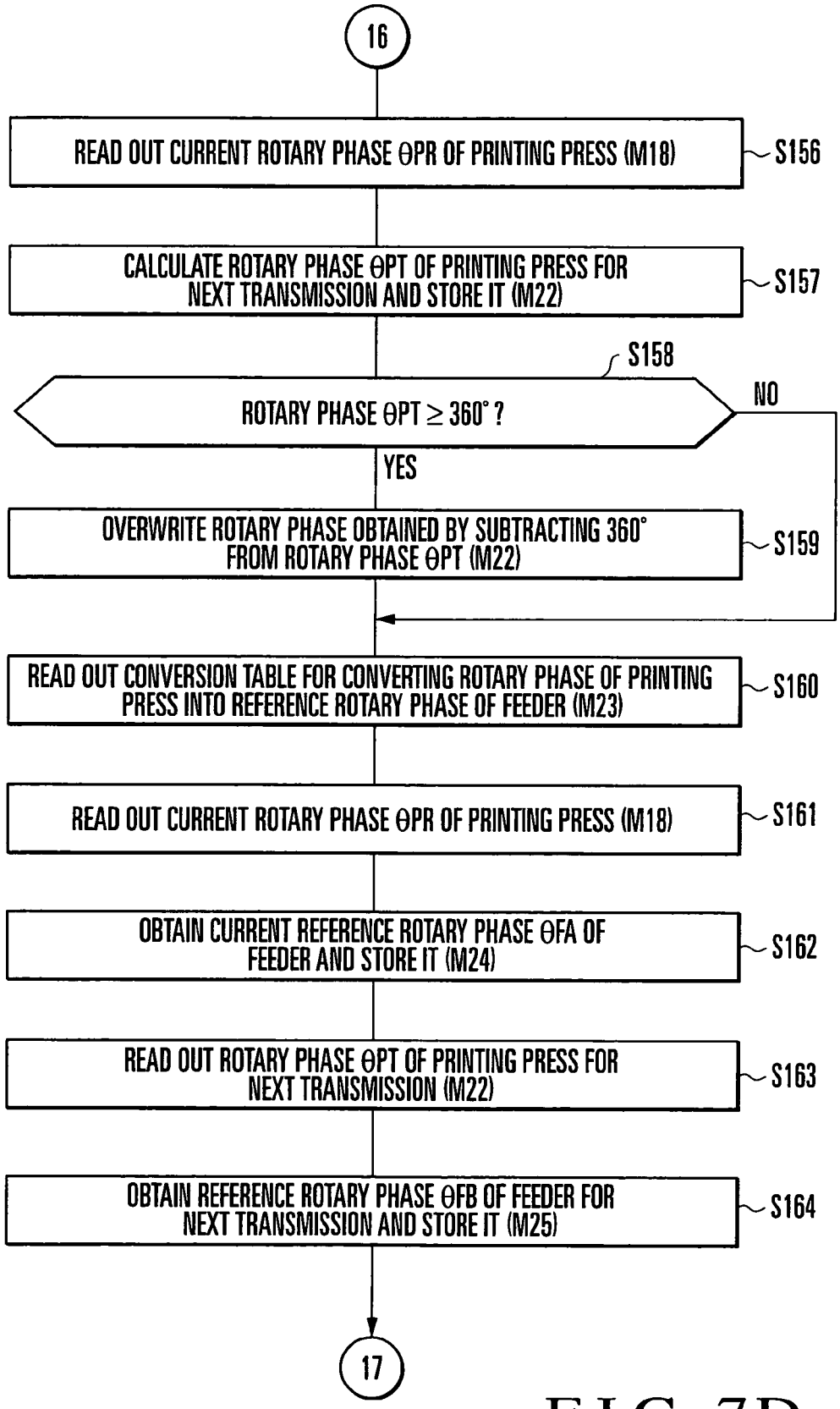
Figure 7E:
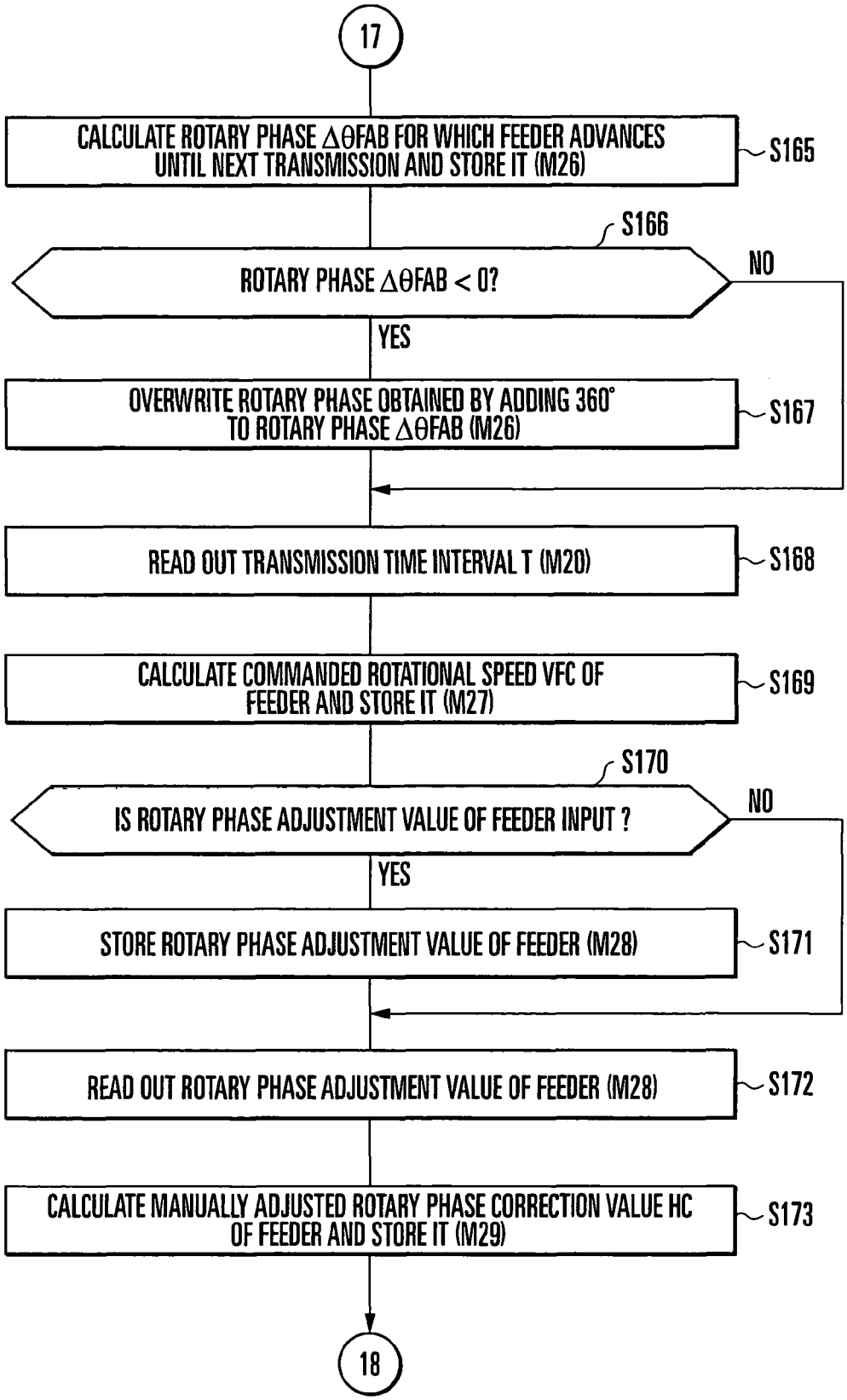
Figure 7F:
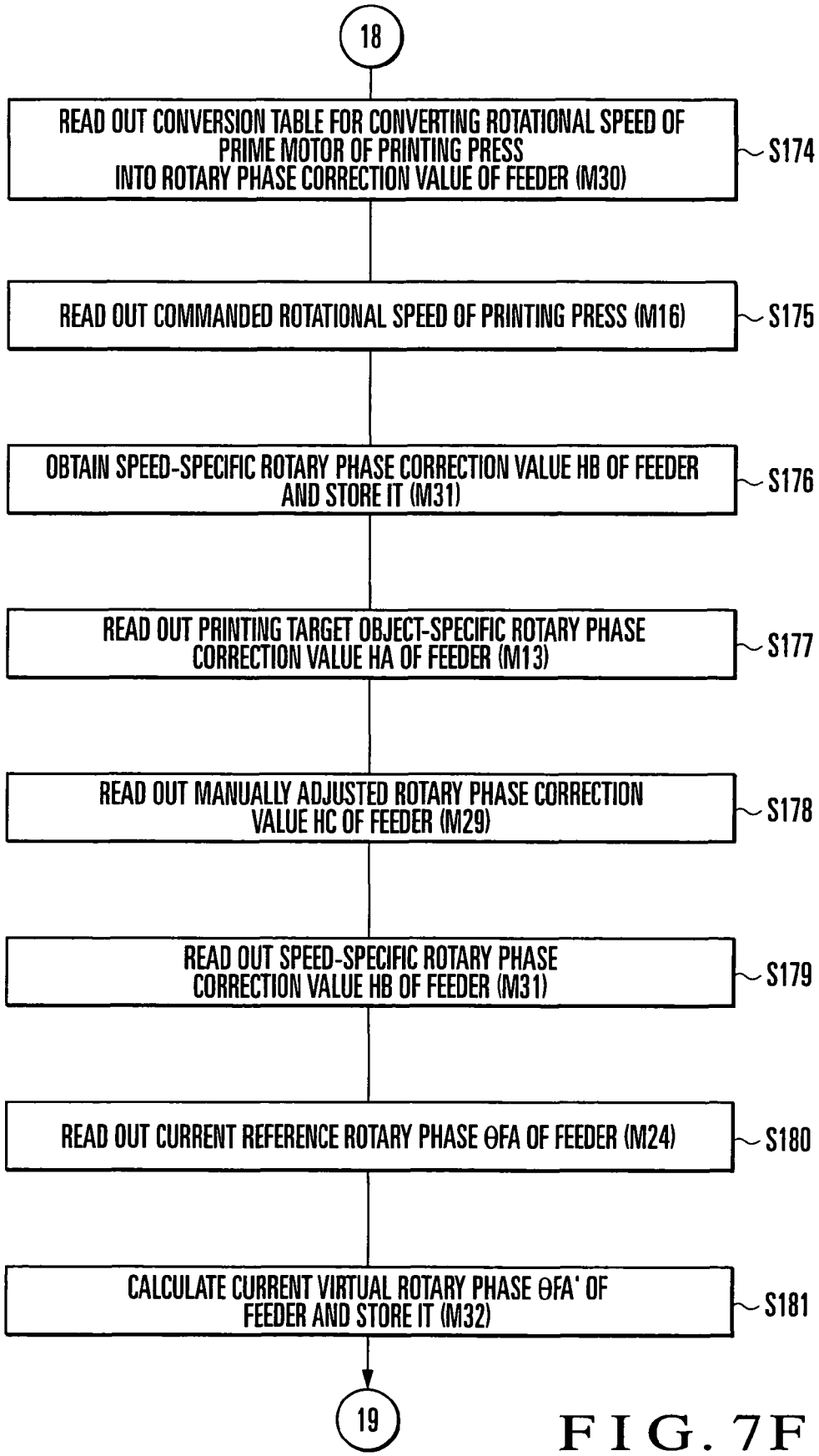
Figure 7G:
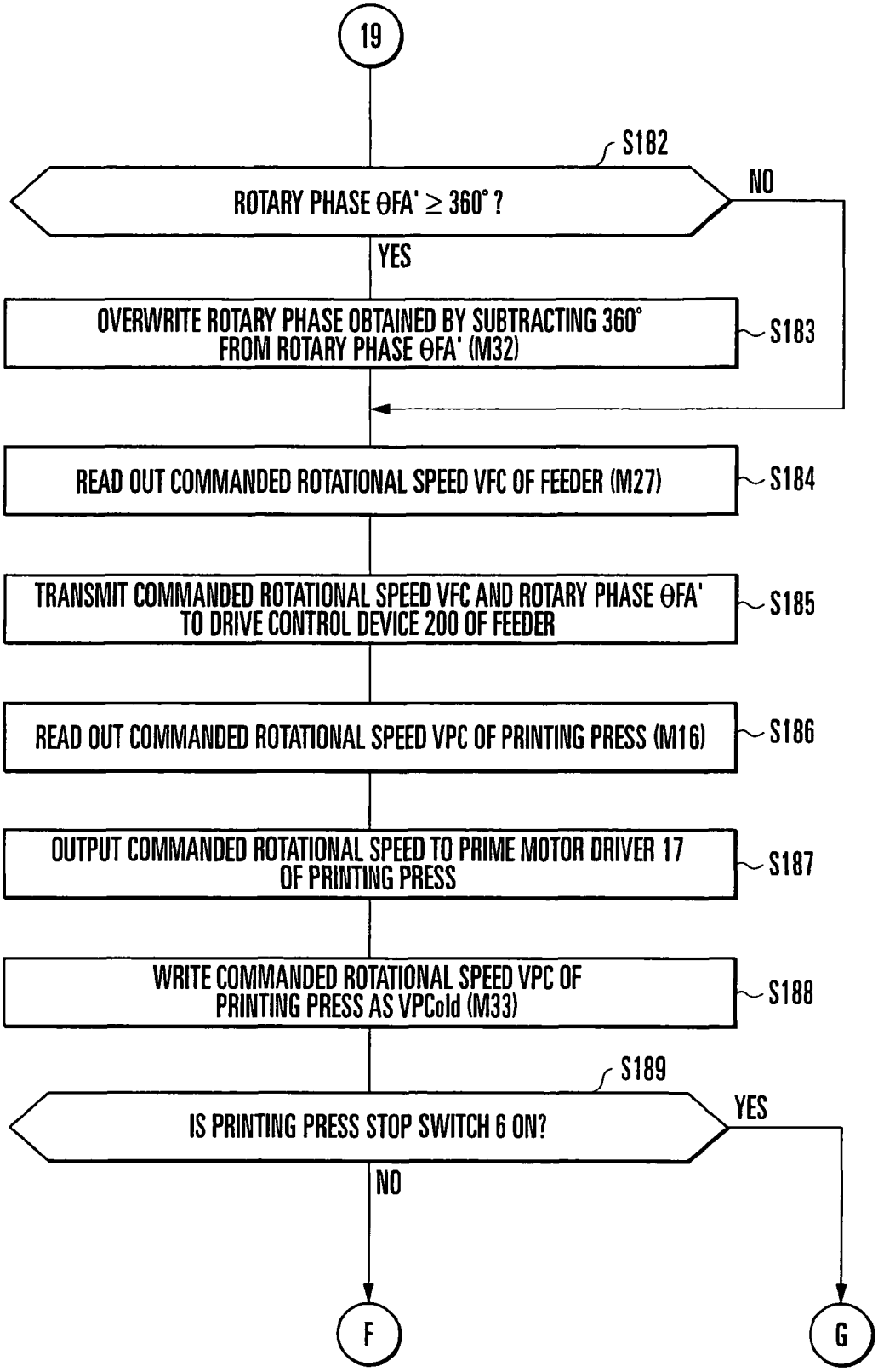
Figure 8A:
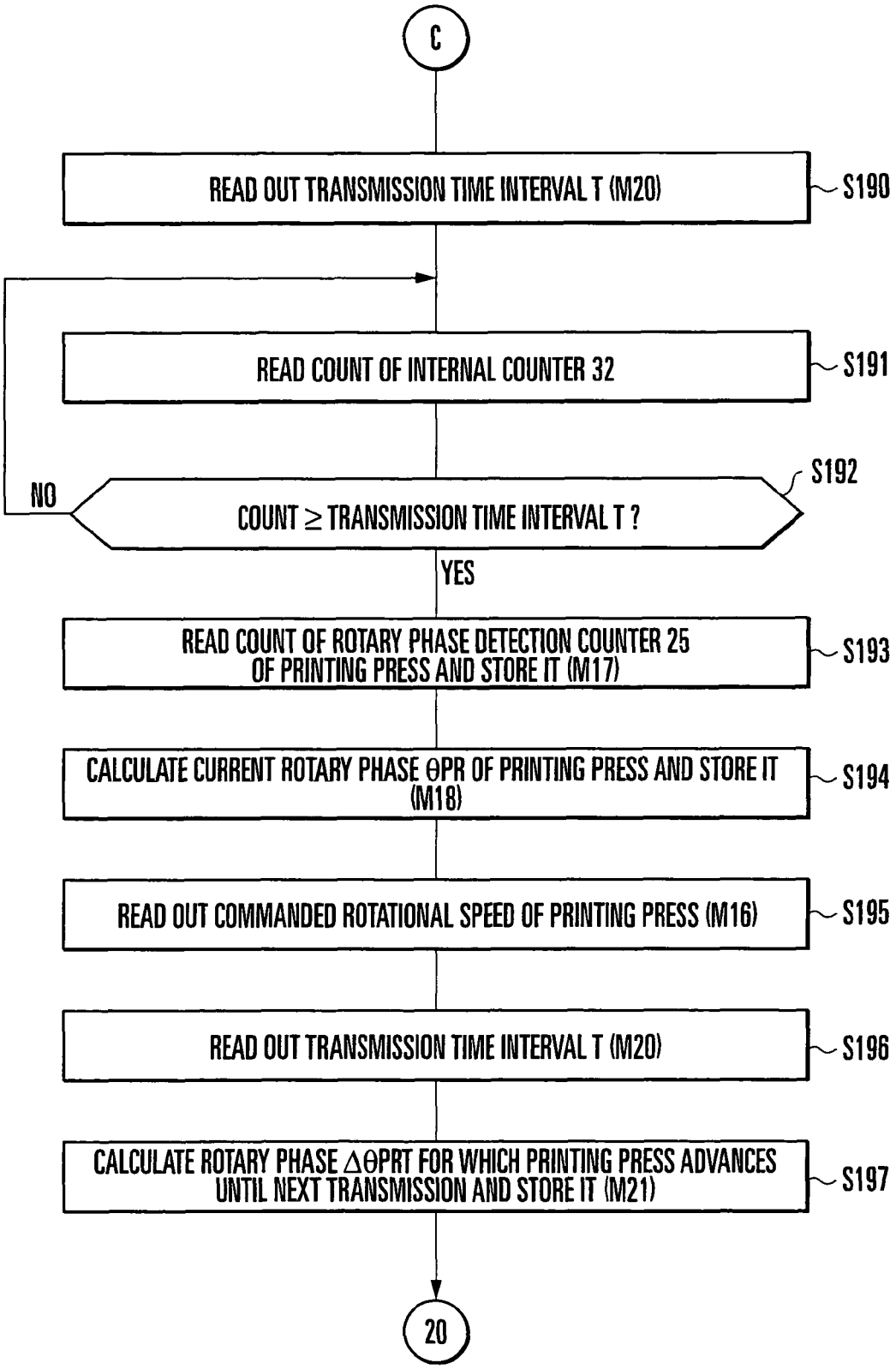
FIGS. 8A to 8E are flowcharts showing the processing operation that takes place before stop of the offset sheet-fed printing press when terminating printing during synchronous origin alignment.
Figure 8B:
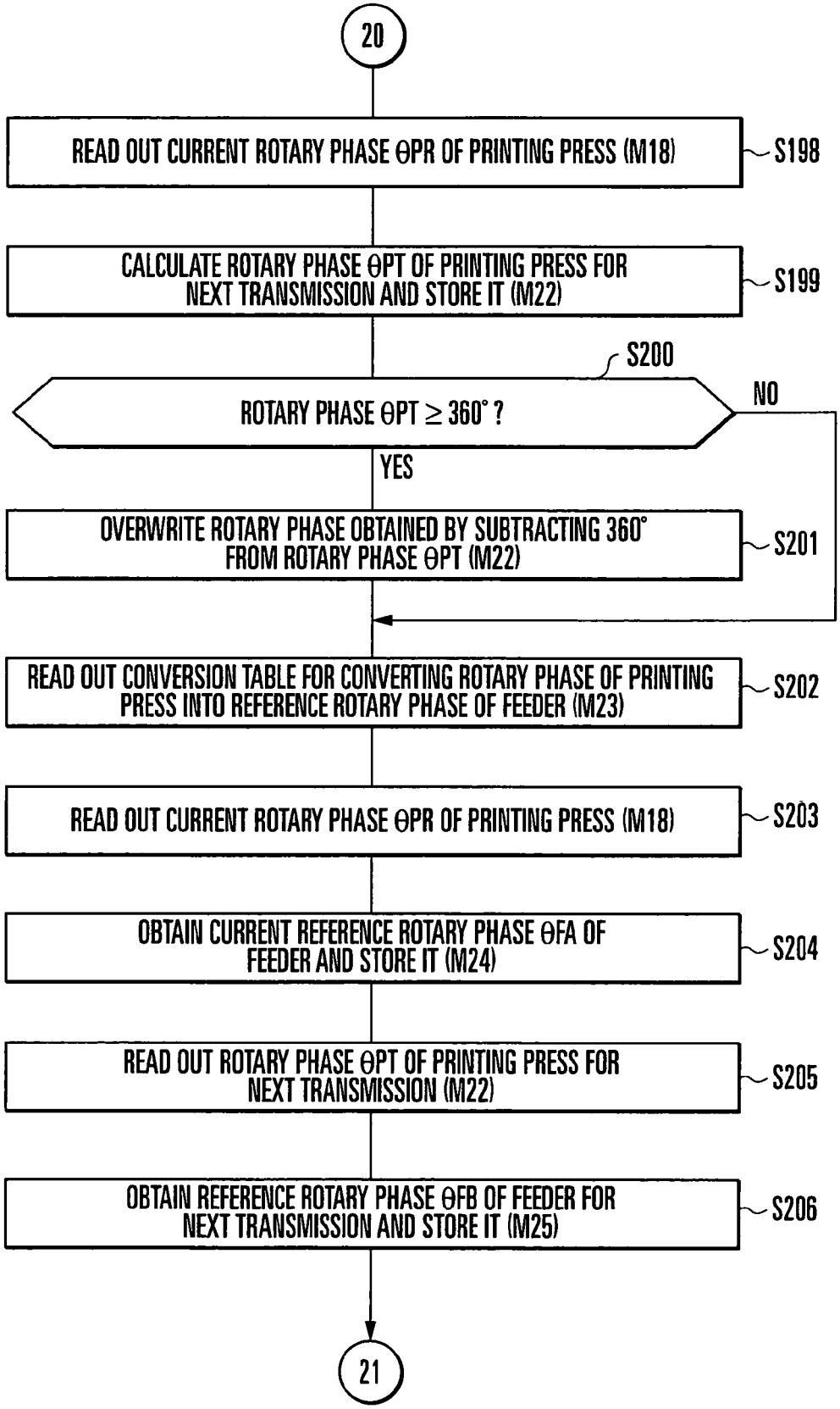
Figure 8C:
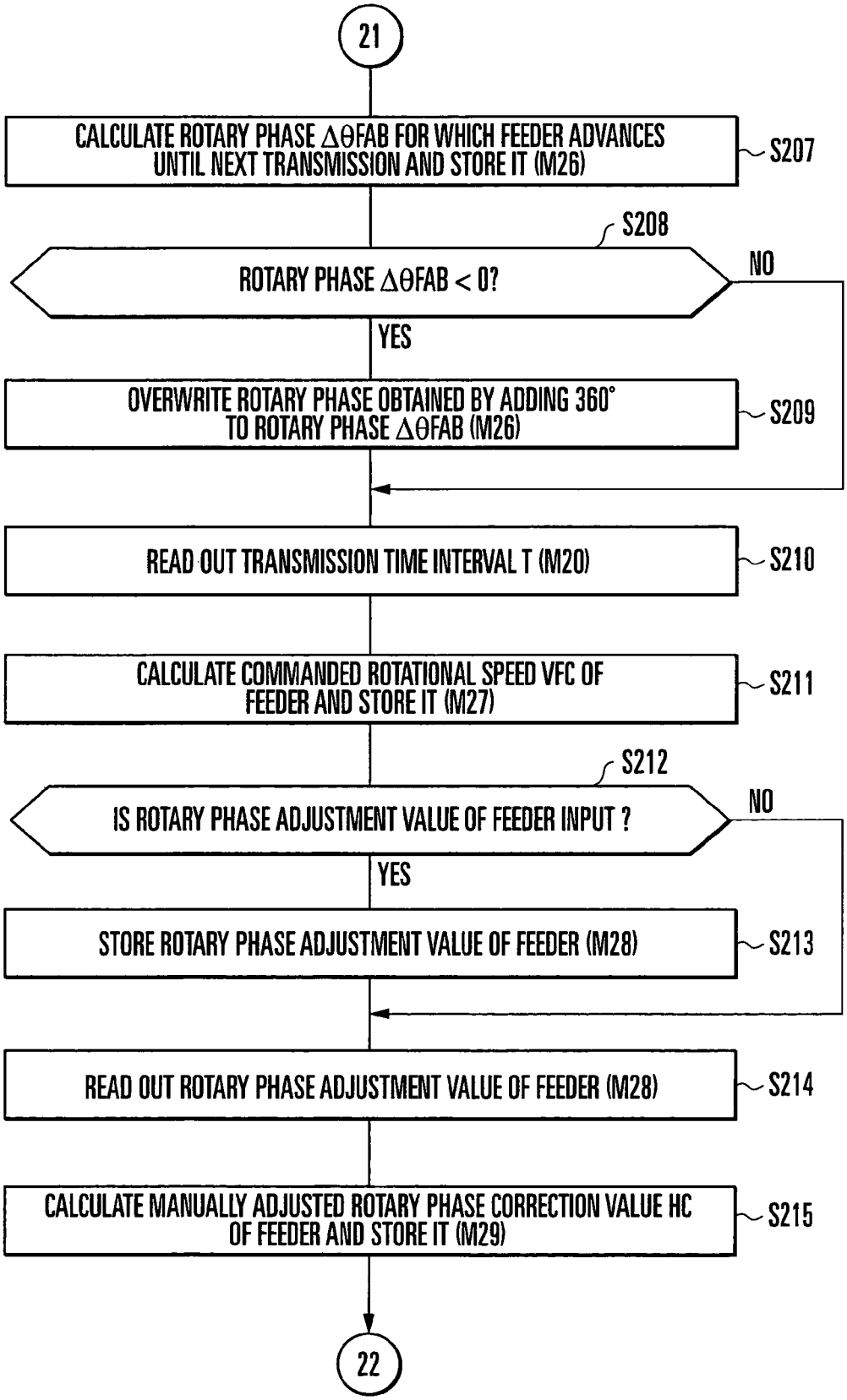
Figure 8D:
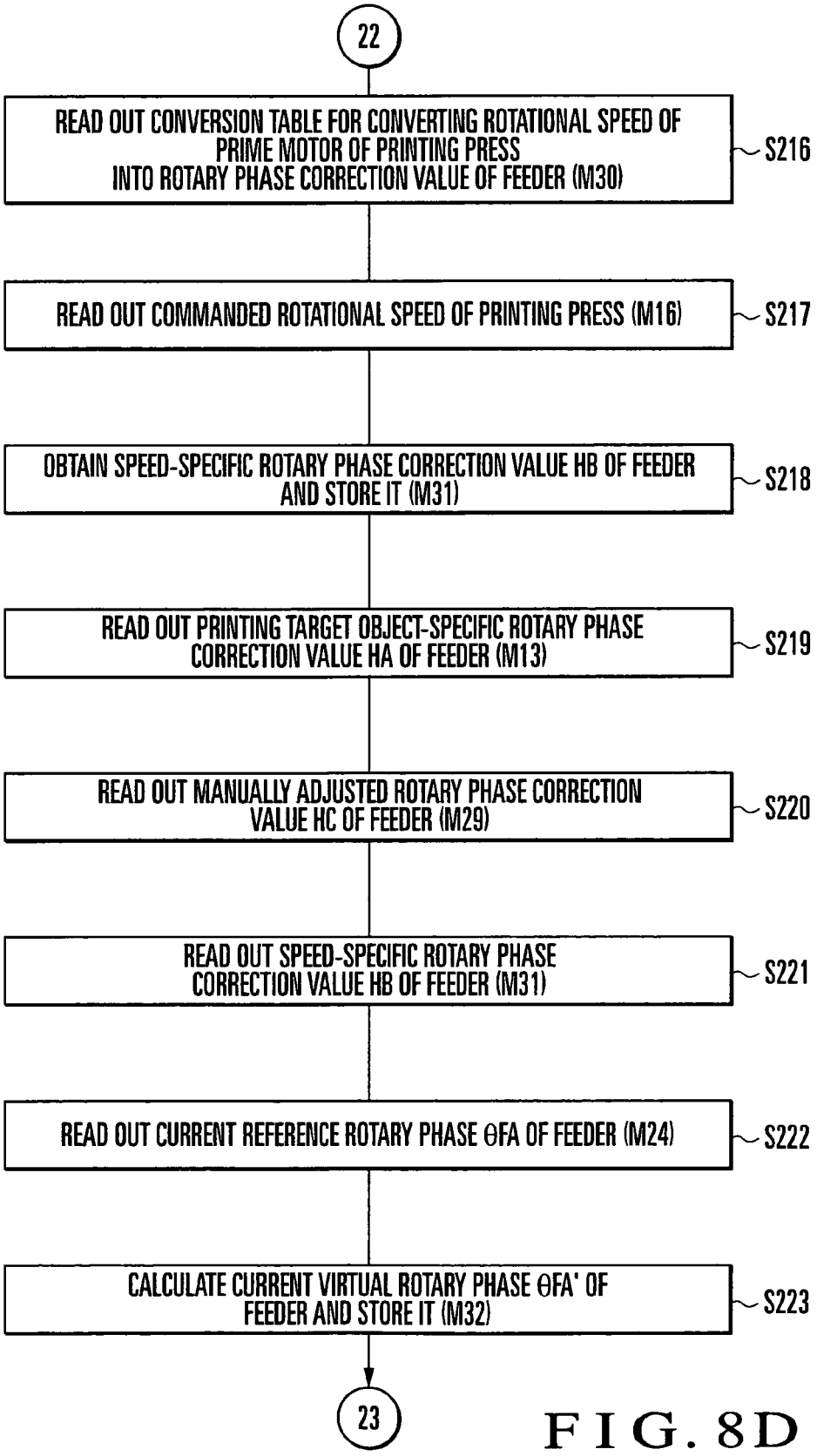
Figure 8E:
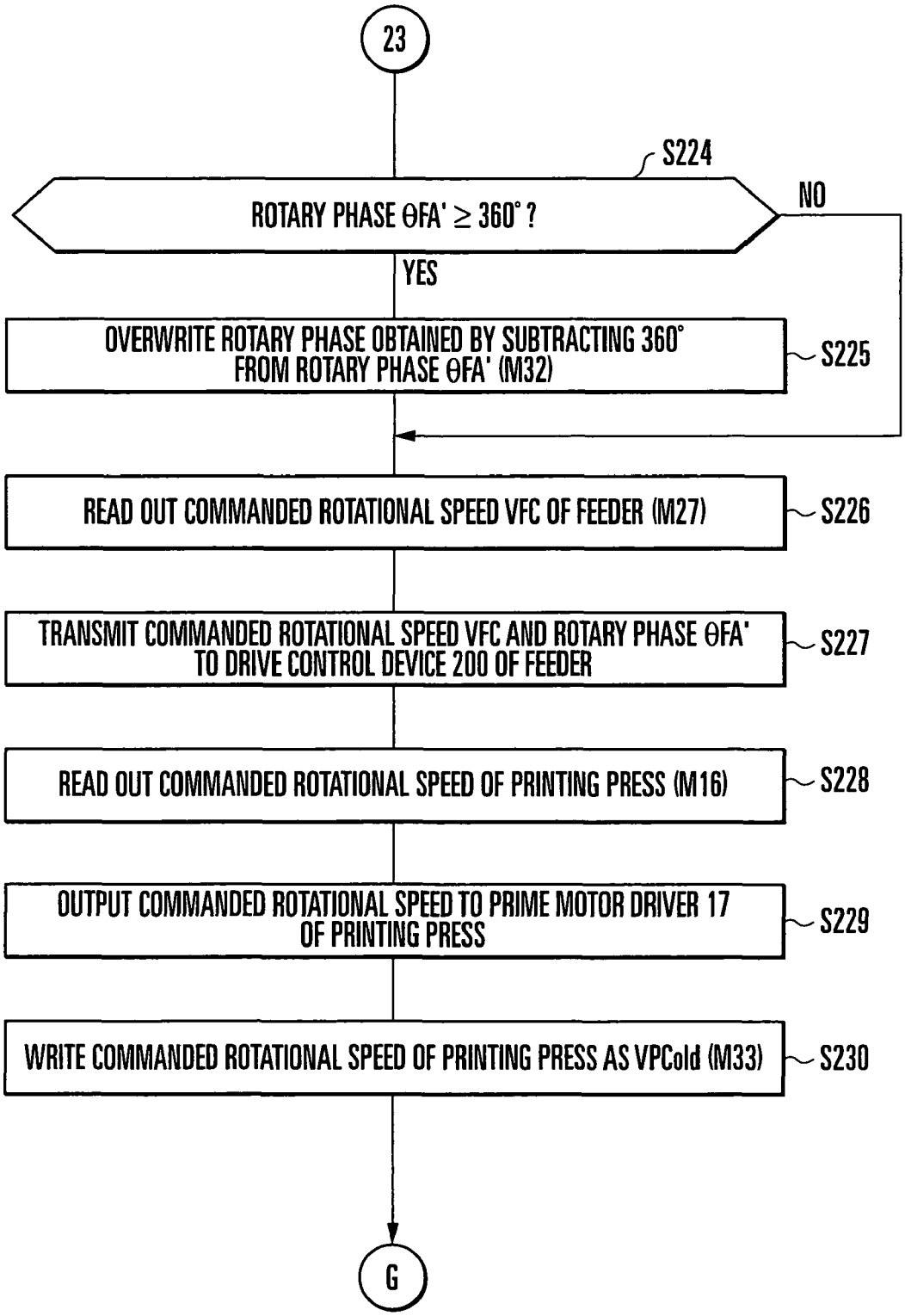

In this case, the previous commanded rotational speed VPCold is the slower rotational speed VPL, and the preset rotational speed VPS is larger than the previous commanded rotational speed VPCold (NO in step S138, YES in step S140, FIG. 7B). Hence, the CPU 1 reads out a rotational speed modification value Δα for acceleration from the memory M34 (step S141), adds it to the previous commanded rotational speed VPCold, and writes the addition result in the memory M36 as a modified commanded rotational speed VPCnew (step S142*a*). The CPU 1 then reads out the preset rotational speed VPS of the offset sheet-fed printing press from the memory M15 (step S142*b*). If the modified commanded rotational speed VPCnew is larger than the preset rotational speed VPS (YES in step S142*c*), the CPU 1 rewrites the modified commanded rotational speed VPCnew for the preset rotational speed VPS of the offset sheet-fed printing press (step S142*d*). The CPU 1 then rewrites the commanded rotational speed VPC in the memory M16 for the modified commanded rotational speed VPCnew (step S147).

Then, the CPU 1 reads out the time interval T of transmission to the drive control device 200 of the feeder from the memory M20 (step S148 in FIG. 7C), and reads the count of the internal clock counter 32 (step S149). When the count of the internal clock counter 32 becomes equal to or more than the transmission time interval T (YES in step S150), the CPU 1 advances to step S151. The CPU 1 performs the processes of steps S151 (FIG. 7C) to S185 (FIG. 7G) similar to those of steps S55 (FIG. 6B) to S89 (FIG. 6F) to transmit the commanded rotational speed VFC and current virtual rotary phase θFA' of the feeder to the drive control device 200 of the feeder.

In these processes, as the commanded rotational speed of the offset sheet-fed printing press, the new commanded rotational speed VPC (VPCnew) which is rewritten in step S147 is employed.

When the commanded rotational speed VFC and current virtual rotary phase θFA' of the feeder are transmitted from the drive control device 100 of the offset sheet-fed printing press (YES in step S438, FIG. 13A), the CPU 51 of the drive control device 200 of the feeder performs the processes of steps S439 (FIG. 13A) to S462 (FIG. 13C) similar to those of steps S413 (FIG. 12A) to S437 (FIG. 12D) described above to control the rotation of the feeder driving motor 62. In these processes, no step corresponding to step S431 exists after step S456, and no synchronous alignment completion signal is transmitted.

The CPU 1 of the drive control device 100 of the offset sheet-fed printing press reads out the commanded rotational speed VPC (VPCnew) of the offset sheet-fed printing press from the memory M16 (step S186 in FIG. 7G), outputs the commanded rotational speed VPC to the prime motor driver 17 of the offset sheet-fed printing press (step S187), and writes the commanded rotational speed VPC in the memory M33 as the previous commanded rotational speed VPCold of the offset sheet-fed printing press (step S188). If NO in step S189, the CPU 1 returns to step S132 (FIG. 7A) and repeats the same processes. Thus, the speed of the prime motor 18 of the offset sheet-fed printing press and that of the driving motor 62 of the feeder increase while maintaining the relationship that the absolute value of the current rotary phase difference ΔθFRA' of the feeder is equal to or less than the tolerance ΔθFth of the rotary phase difference of the feeder.

[Deceleration]

If the previous commanded rotational speed VPCold of the offset sheet-fed printing press increases the preset rotational speed VPS of the offset sheet-fed printing press because, e.g., the latter is changed (NO in step S140, FIG. 7B), the CPU 1 reads out a rotational speed modification value Δβ for deceleration from the memory M35 (step S143). The CPU 1 subtracts the rotational speed modification value Δβ for deceleration from the previous commanded rotational speed VPCold, and writes the subtraction result in the memory M36 as the modified commanded rotational speed VPCnew (step S144*a*). The CPU 1 then reads out the preset rotational speed VPS of the offset sheet-fed printing press from the memory M15 (step S144*b*). If the modified commanded rotational speed VPCnew is smaller than the preset rotational speed VPS (YES in step S145), the CPU 1 rewrites the modified commanded rotational speed VPCnew for the preset rotational speed VPS of the offset sheet-fed printing press (step S146). The CPU 1 then advances to step S147, and rewrites the commanded rotational speed VPC in the memory M16 for the modified commanded rotational speed VPCnew.

Then, the CPU 1 reads out the time interval T of transmission to the drive control device 200 of the feeder from the memory M20 (step S148 in FIG. 7C), and reads the count of the internal clock counter 32 (step S149). When the count of the internal clock counter 32 becomes equal to or more than the transmission time interval T (YES in step S150), the CPU 1 advances to step S151. The CPU 1 performs the processes of steps S152 to S185 described above to transmit the commanded rotational speed VFC and current virtual rotary phase θFA' of the feeder to the drive control device 200 of the feeder.

When the commanded rotational speed VFC and current virtual rotary phase θFA' of the feeder are transmitted from the drive control device 100 of the offset sheet-fed printing press (YES in step S438, FIG. 13A), the CPU 51 of the drive control device 200 of the feeder performs the processes of steps S439 to S462 described above to control the rotation of the driving motor 62 of the feeder.

The CPU 1 of the drive control device 100 of the offset sheet-fed printing press reads out the commanded rotational speed VPC (VPCnew) of the offset sheet-fed printing press from the memory M16 (step S186 in FIG. 7G), outputs the commanded rotational speed VPC to the prime motor driver 17 of the offset sheet-fed printing press (step S187), and writes the commanded rotational speed VPC in the memory M33 as the previous commanded rotational speed VPCold of the offset sheet-fed printing press (step S188). In response to NO in step S189, the CPU 1 returns to step S132 (FIG. 7A), and repeats the same processes. Thus, the speed of the prime motor 18 of the offset sheet-fed printing press and that of the driving motor 62 of the feeder decrease while maintaining the relationship of ΔθFRA'≦ΔθFth.

[Normal Printing Speed]

When the preset rotational speed VPS of the offset sheet-fed printing press becomes equal to the previous commanded rotational speed VPCold of the offset sheet-fed printing press (YES in step S138, FIG. 7A), the CPU 1 rewrites the commanded rotational speed VPC in the memory M16 for the preset rotational speed VPS (step S139). The CPU 1 advances to the process of step S148 (FIG. 7C), and performs the processes of steps S149 to S188. If NO in step S189, the CPU 1 returns to step S132 (FIG. 7A), and repeats the same processes.

When the commanded rotational speed VFC and current virtual rotary phase θFA' of the feeder are transmitted from the drive control device 100 of the offset sheet-fed printing press (YES in step S438, FIG. 13A), the CPU 51 of the drive control device 200 of the feeder performs the processes of steps S439 to S462 to control the rotation of the driving motor 62 of the feeder.

Thus, the prime motor 18 of the offset sheet-fed printing press and the driving motor 62 of the feeder continue driving at the speed of final printing (normal printing speed) while maintaining the relationship of ΔθFRA'≦ΔθFth.

[Automatic Adjustment of Rotary Phase of Feeder]

In the processing operation described above, the CPU 1 adds the rotary phase correction value HA of the feeder which is specific to the printing target object, the speed-specific rotary phase correction value HB of the feeder, and the manually adjusted rotary phase correction value HC of the feeder to the current reference rotary phase θFA of the feeder to obtain the current virtual rotary phase θFA' of the feeder.

The rotary phase correction value HA of the feeder which is specific to the printing target object is automatically obtained from the size, thickness, and quality of the sheet, and the speed-specific rotary phase correction value HB of the feeder is automatically obtained from the speed of the printing press. Thus, the rotary phase of the feeder is automatically adjusted. Therefore, the operator only needs to input these printing conditions at the start of printing, and need not adjust the rotary phase of the feeder in accordance with the printing conditions. This reduces the load to the operator and improves the register accuracy.

[Manual Adjustment of Rotary Phase of Feeder]

According to this embodiment, the rotary phase of the feeder can be adjusted manually as well. Manual adjustment can be performed freely without stopping the operation of the printing press. When the operator wishes to manually adjust the rotary phase of the feeder, in the drive control device 100 of the offset sheet-fed printing press, he inputs the rotary phase adjustment value (manual adjustment value) of the feeder to the feeder rotary phase adjustment value setter 14. The CPU 1 obtains the manually adjusted rotary phase correction value HC of the feeder from the rotary phase adjustment value of the feeder and uses it to calculate the current virtual rotary phase θFA' of the feeder. Thus, the rotary phase of the feeder is adjusted without stopping the operation of the printing press. This reduces the down time of the printing press, improves the operation efficiency, and reduces the load to the operator.

In this manner, according to this embodiment, the rotary phase of the feeder can be adjusted easily within a short period of time without stopping the operation of the printing press. Thus, the first conventional problem can be solved. The rotary phase of the feeder is automatically adjusted in accordance with the printing conditions such as the speed of the printing press (speed of final printing), and the size, thickness and quality of the sheet. Every time the printing conditions are changed, the rotary phase of the feeder need not be adjusted in accordance with the new printing conditions. Thus, the second conventional problem can be solved.

[Stop of Printing Press]

When the operator wishes to stop the printing press, he turns on the printing press stop switch 6. During rotation at an ordinary speed, if the printing press stop switch 6 is turned on, in response to YES in step S189 (FIG. 7G), the CPU 1 of the drive control device 100 of the offset sheet-fed printing press advances to step S231 (FIG. 9A), and resets the preset rotational speed VPS stored in the memory M15 to zero. The CPU 1 outputs a reset signal and enable signal to the internal clock counter 32 (step S232) and stops the reset signal for the internal clock counter 32 (step S233), so that the internal clock counter 32 starts counting clock pulses from zero.

Then, the CPU 1 reads out the previous commanded rotational speed VPCold of the offset sheet-fed printing press from the memory M33 (step S234). Upon confirmation of the fact that the previous commanded rotational speed VPCold is not zero (NO in step S235), the CPU 1 reads out the rotational speed modification value Δβ for deceleration from the memory M35 (step S236). The CPU 1 then subtracts the rotational speed modification value Δβ for deceleration from the previous commanded rotational speed VPCold, and writes the subtraction result in the memory M36 as the modified commanded rotational speed VPCnew (step S237). If the modified commanded rotational speed VPCnew is less than zero (YES in step S238), the CPU 1 resets it to zero (step S239) and rewrites the commanded rotational speed VPC in the memory M16 for the modified commanded rotational speed VPCnew (step S240). The CPU 1 also writes the modified commanded rotational speed VPCnew in the memory M33 as VPCold (step S241).

Then, the CPU 1 reads out the time interval T of transmission to the drive control device 200 of the feeder from the memory M20 (step S243 in FIG. 9B) and reads the count of the internal clock counter 32 (step S244). When the count of the internal clock counter 32 becomes equal to or more than the transmission time interval T (YES in step S245), the CPU 1 advances to step S246. The CPU 1 performs the processes of steps S246 (FIG. 9B) to S280 (FIG. 9F) similar to those of steps S55 (FIG. 6B) to S89 (FIG. 6F) to transmit the commanded rotational speed VFC and current virtual rotary phase θFA' of the feeder to the drive control device 200 of the feeder. In these processes, as the commanded rotational speed of the offset sheet-fed printing press, the new commanded rotational speed VPC (VPCnew) which is rewritten in step S240 is employed.

Then, the CPU 1 reads out the commanded rotational speed VPC (VPCnew) of the offset sheet-fed printing press from the memory M16 (step S281 in FIG. 9F), outputs the commanded rotational speed VPC to the prime motor driver 17 of the offset sheet-fed printing press (step S282), and writes the commanded rotational speed VPC in the memory M33 as the previous commanded rotational speed VPCold of the offset sheet-fed printing press (step S283).

Then, the CPU 1 reads an output from the F/V converter 20 connected to the prime motor 18 of the offset sheet-fed printing press and an output from the F/V converter 23 connected to the driving motor of the feeder (step S284 in FIG. 9G), and obtains the current rotational speeds of the offset sheet-fed printing press and feeder from the outputs from the F/V converters 20 and 23 (step S285). Upon confirmation of the fact that the current rotational speeds of the offset sheet-fed printing press and feeder are not zero (NO in step S286), the CPU 1 returns to step S232 (FIG. 9A), and repeats the same processes. Thus, the speed of the prime motor 18 of the offset sheet-fed printing press and that of the driving motor 62 of the feeder decrease while maintaining the relationship that the absolute value of the current rotary phase difference ΔθFRA' of the feeder is equal to or less than the tolerance ΔθFth of the rotary phase difference of the feeder.

Figure 9A:
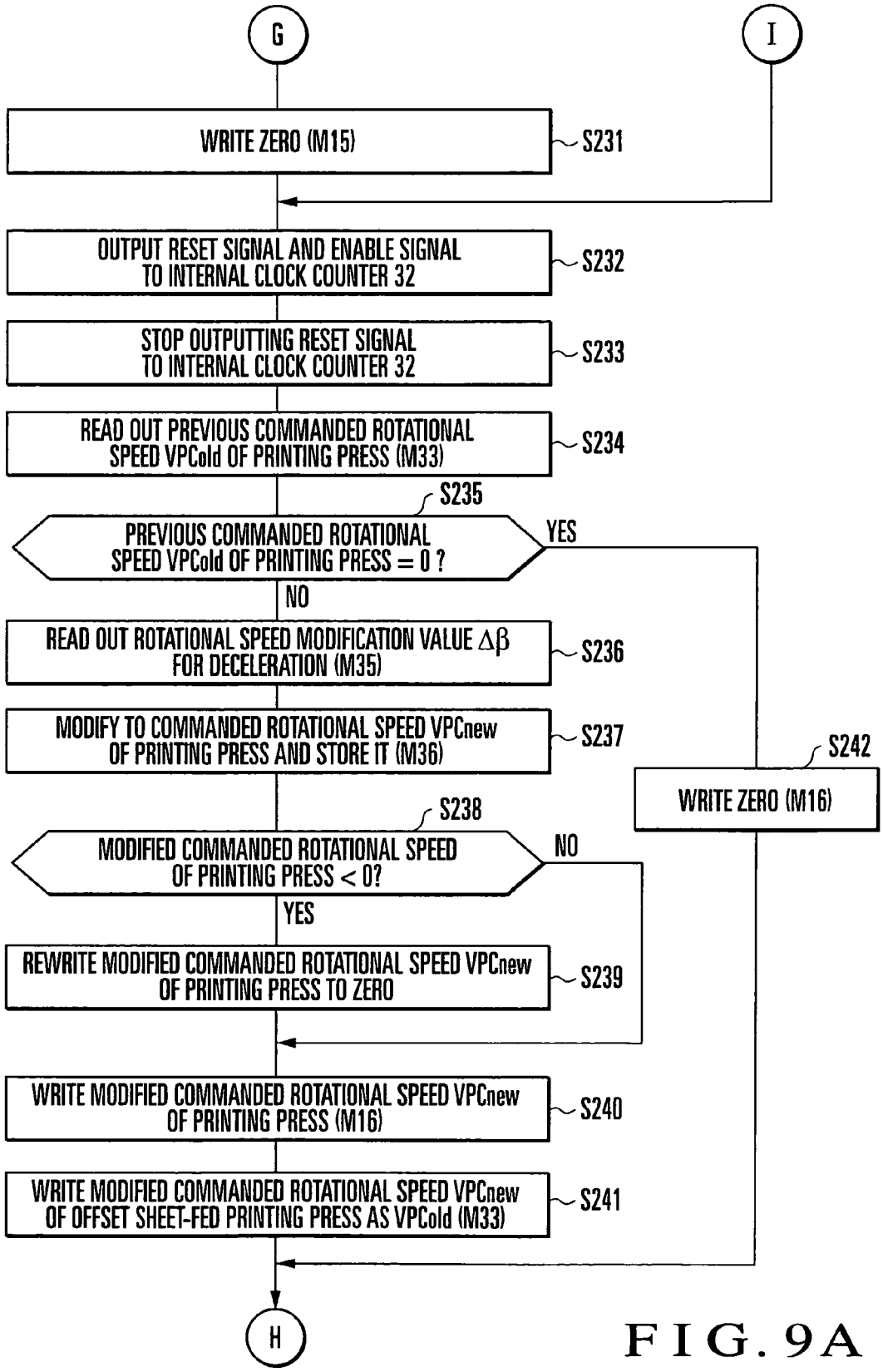
FIGS. 9A to 9G are flowcharts showing the processing operation of stopping the offset sheet-fed printing press.
Figure 9B:
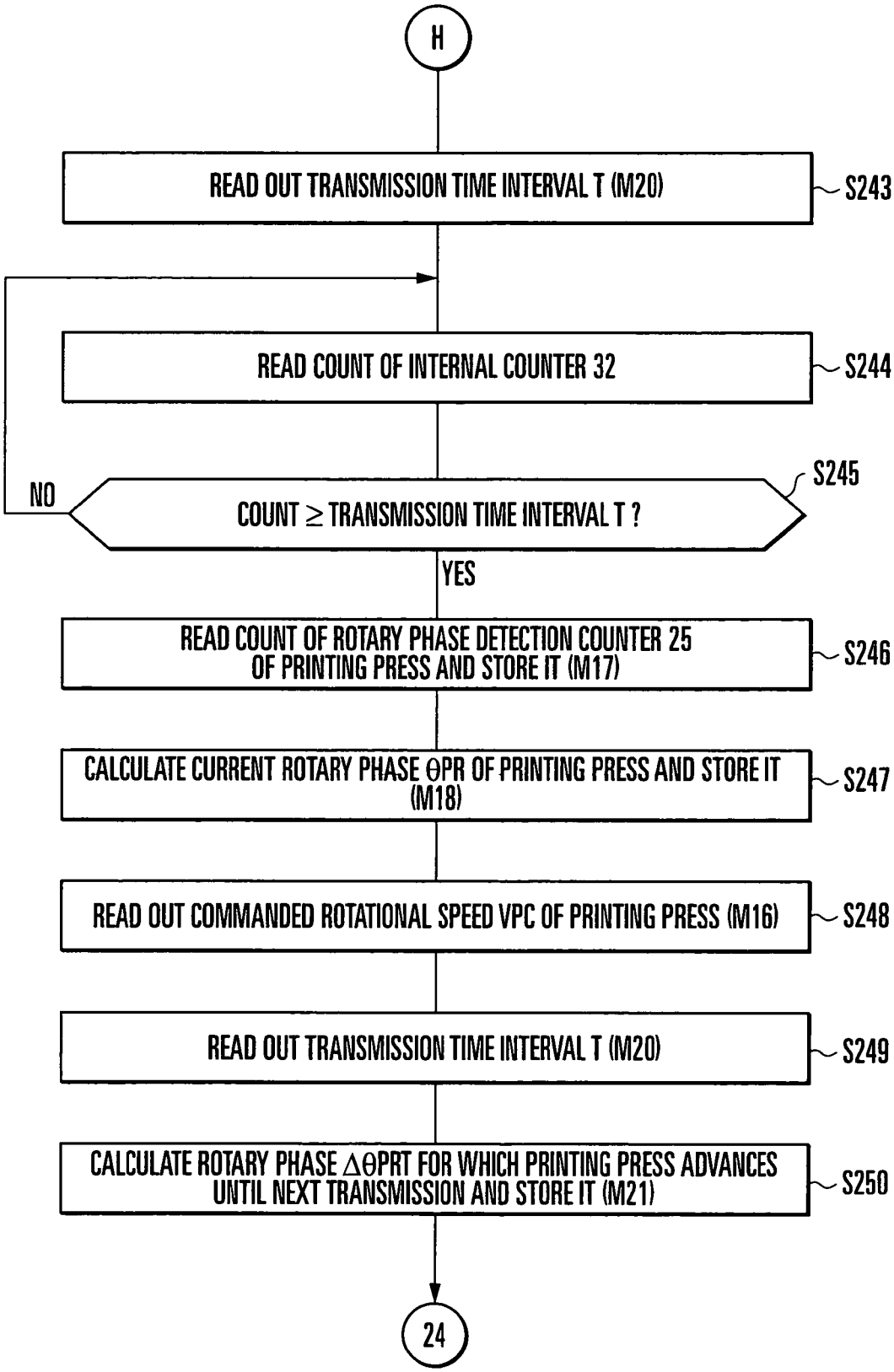
Figure 9C:
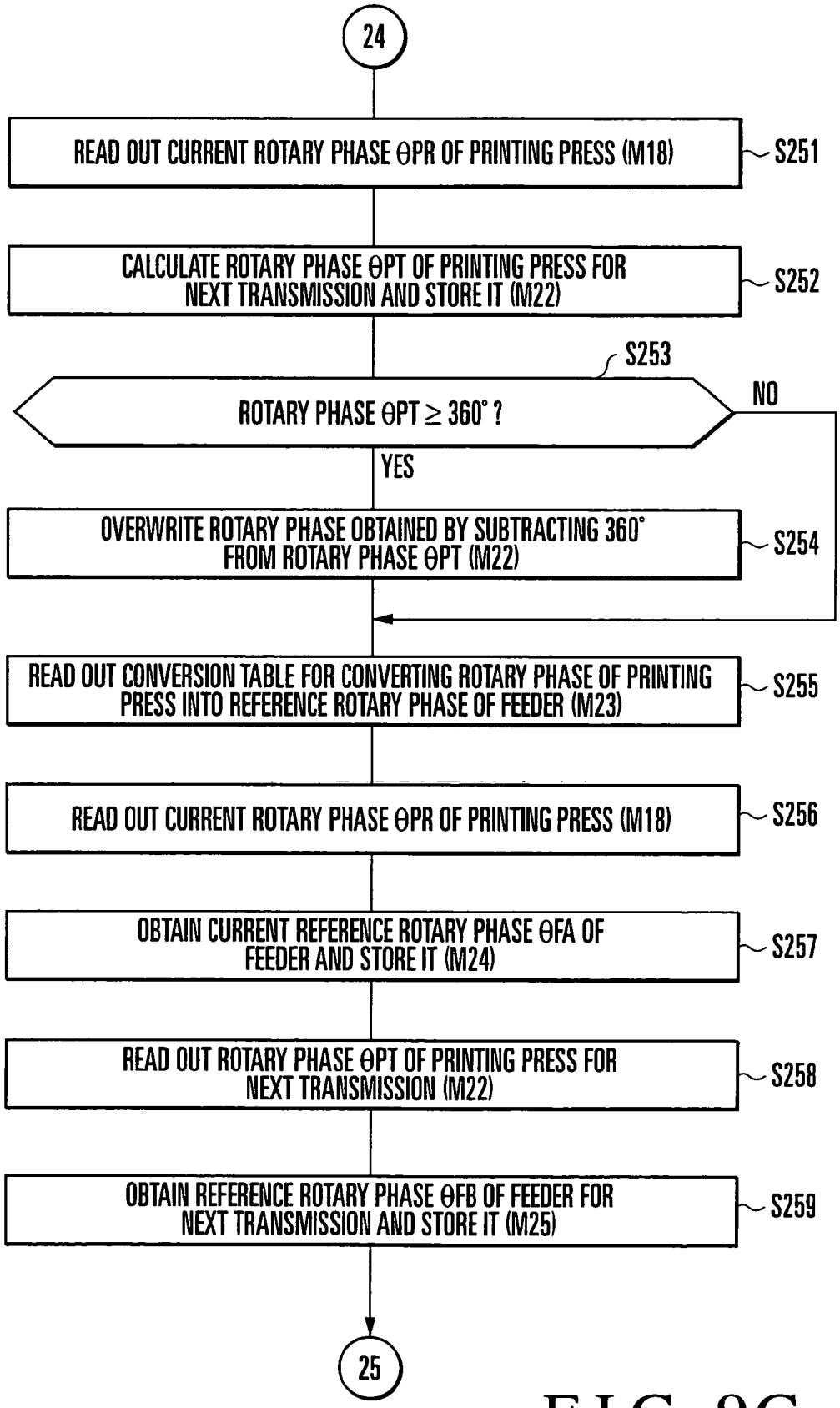
Figure 9D:
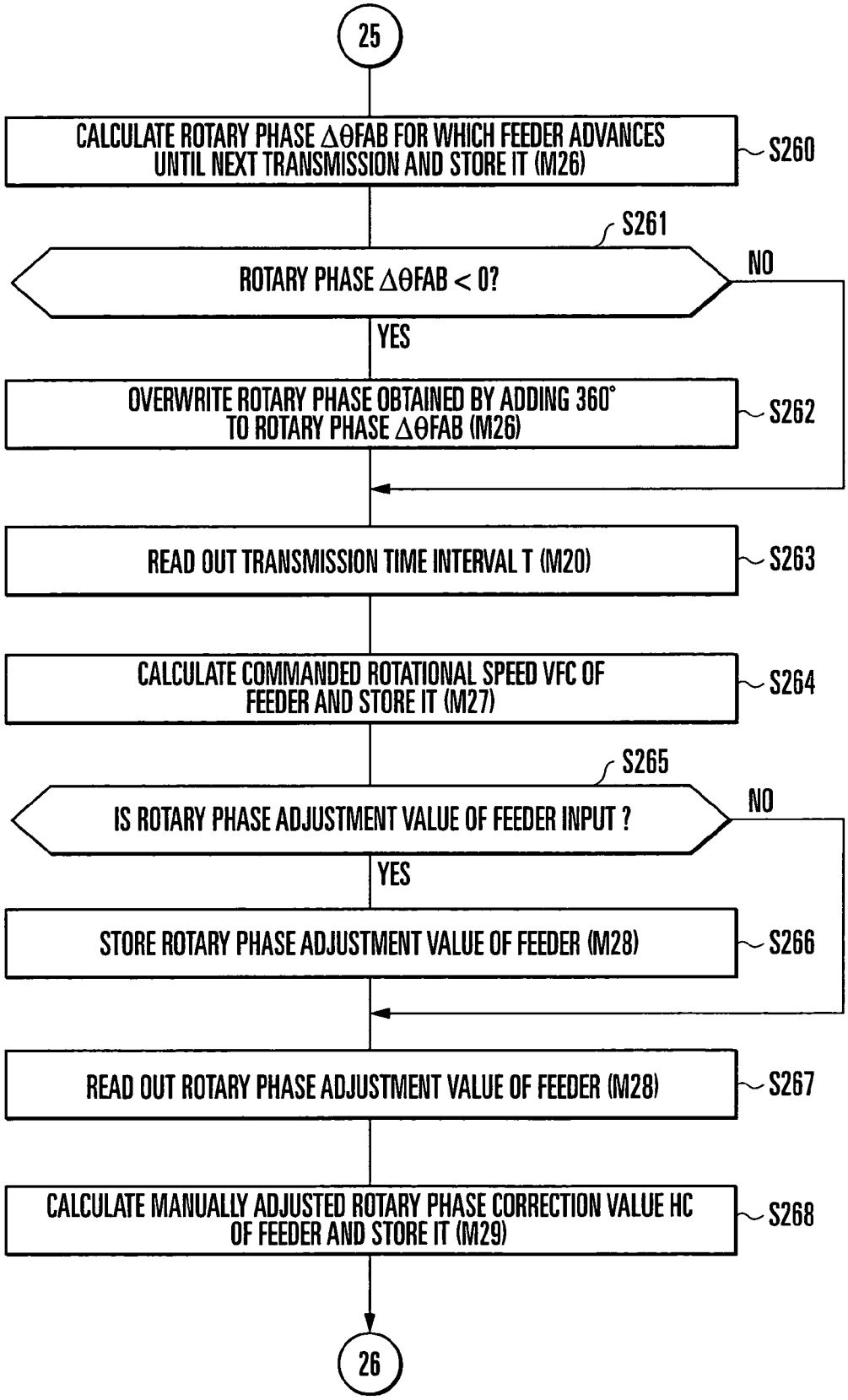
Figure 9E:
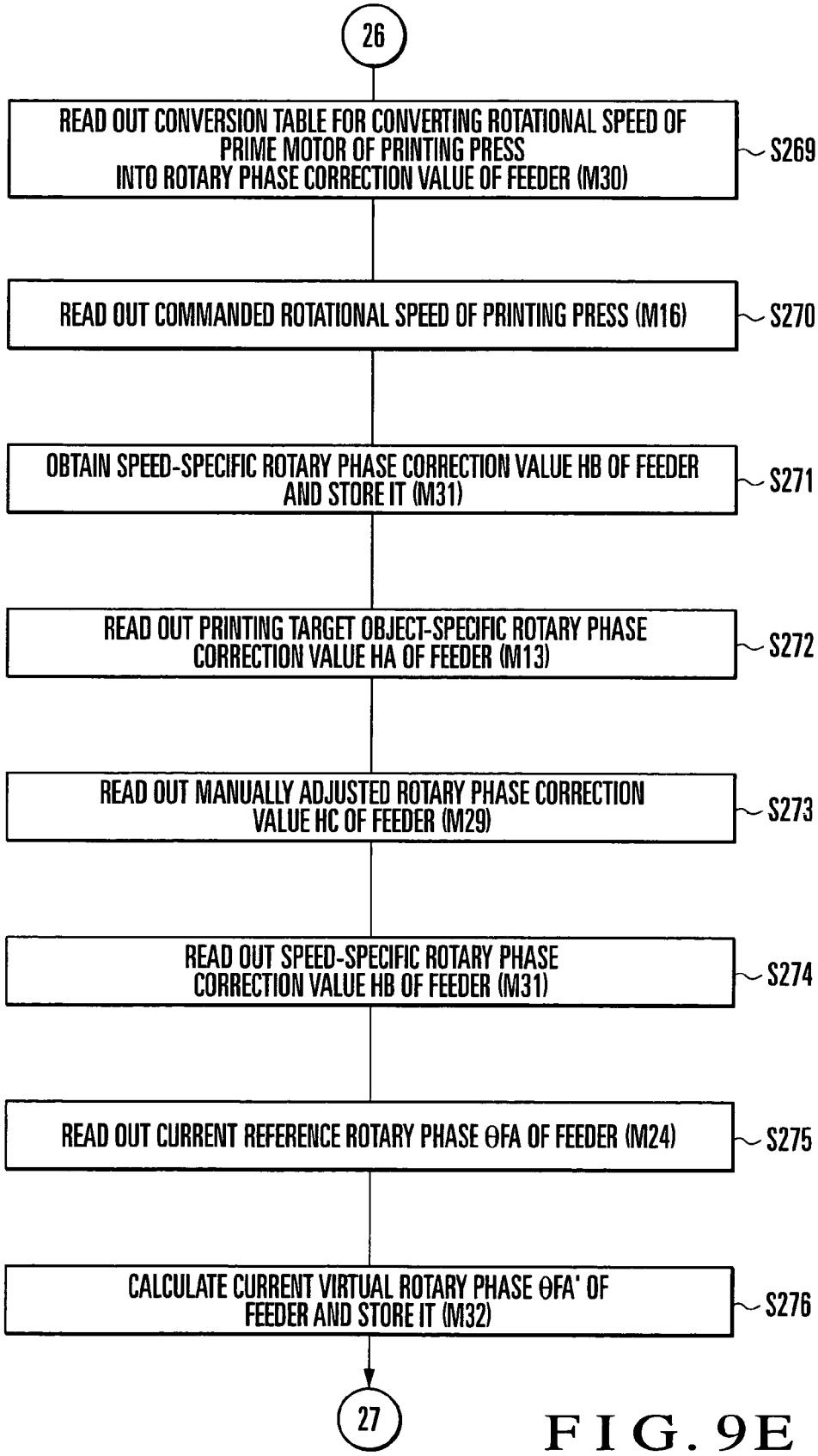
Figure 9F:
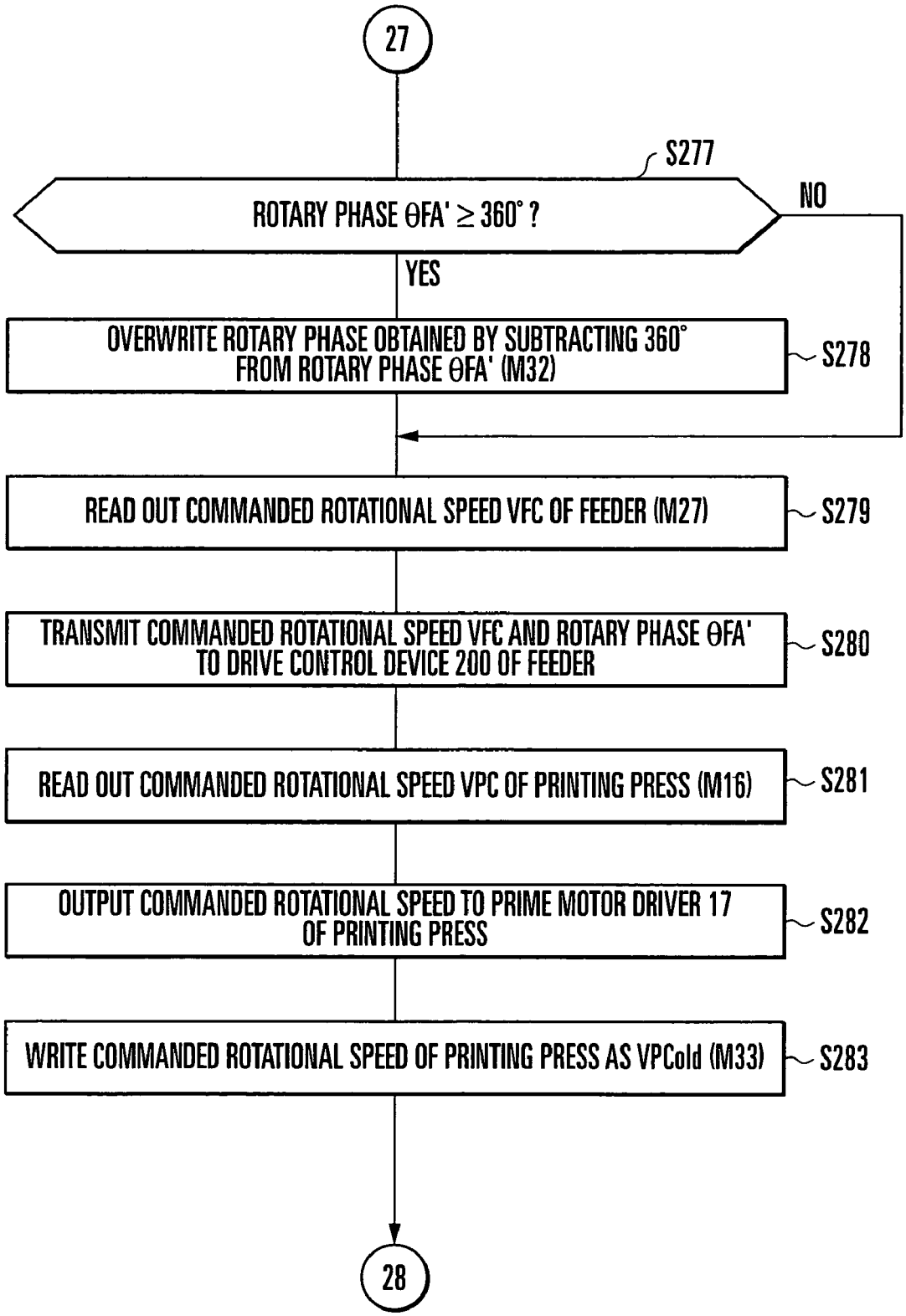

While stopping the printing press, if the previous commanded rotational speed VPCold becomes zero (YES in step S235, FIG. 9A), the CPU 1 sets the commanded rotational speed VPC in the memory 16 to zero (step S242), and advances to step S243 (FIG. 9B). During stopping the printing press, the CPU 1 also reads the outputs from the F/V converters 20 and 23 (step S284 in FIG. 9G), and obtains the current rotational speeds of the offset sheet-fed printing press and feeder from them (step S285). When the current rotational speeds of the offset sheet-fed printing press and feeder become zero (YES in step S286), the CPU 1 transmits a synchronous operation stop command to the drive control device 200 of the feeder (step S287).

When the synchronous operation stop command is transmitted from the drive control device 100 of the offset sheet-fed printing press (YES in step S463, FIG. 13C), the CPU 51 of the drive control device 200 of the feeder receives it from the drive control device 100 of the offset sheet-fed printing press (step S464), and transmits it to the drive control device 100 of the offset sheet-fed printing press (step S465). Also, the CPU 1 disables the start signal for the feeder driving motor driver 61 (step S466) and outputs an actuation signal to the feeder driving motor brake circuit 68 (step S467) to turn on the feeder driving motor brake 69.

When the synchronous operation stop command is sent from the drive control device 200 of the feeder (YES in step S288, FIG. 9G), the CPU 1 of the drive control device 100 of the offset sheet-fed printing press receives it from the drive control device 200 of the feeder (step S289), disables the start signal to the prime motor 18 of the offset sheet-fed printing press (step S290), and outputs an actuation signal to the prime motor brake circuit 28 of the offset sheet-fed printing press (step S291) to turn on the prime motor brake 29 of the offset sheet-fed printing press.

In this manner, during printing, when the printing press stop switch 6 is turned on, the printing press is stopped. After stopping the printing press, when the synchronous operation switch 4 is turned off (YES in step S292), the CPU 1 returns to the process of step S1 (FIG. 5A). After the printing press is stopped, when the offset sheet-fed printing press drive switch 5 is turned on (YES in step S293), the CPU 1 returns to the process of step S11 (FIG. 5A).

[To Suspend Printing during Synchronous Origin Alignment]

Usually, as shown in FIG. 15D, the drive control device 200 of the feeder sends the synchronous origin alignment completion signal to the drive control device 100 of the offset sheet-fed printing press. During synchronous origin alignment, however, the operator may notice a setting mistake in, e.g., the type or thickness of the printing target object and wish to suspend the offset sheet-fed printing press during operation.

Figure 6K:
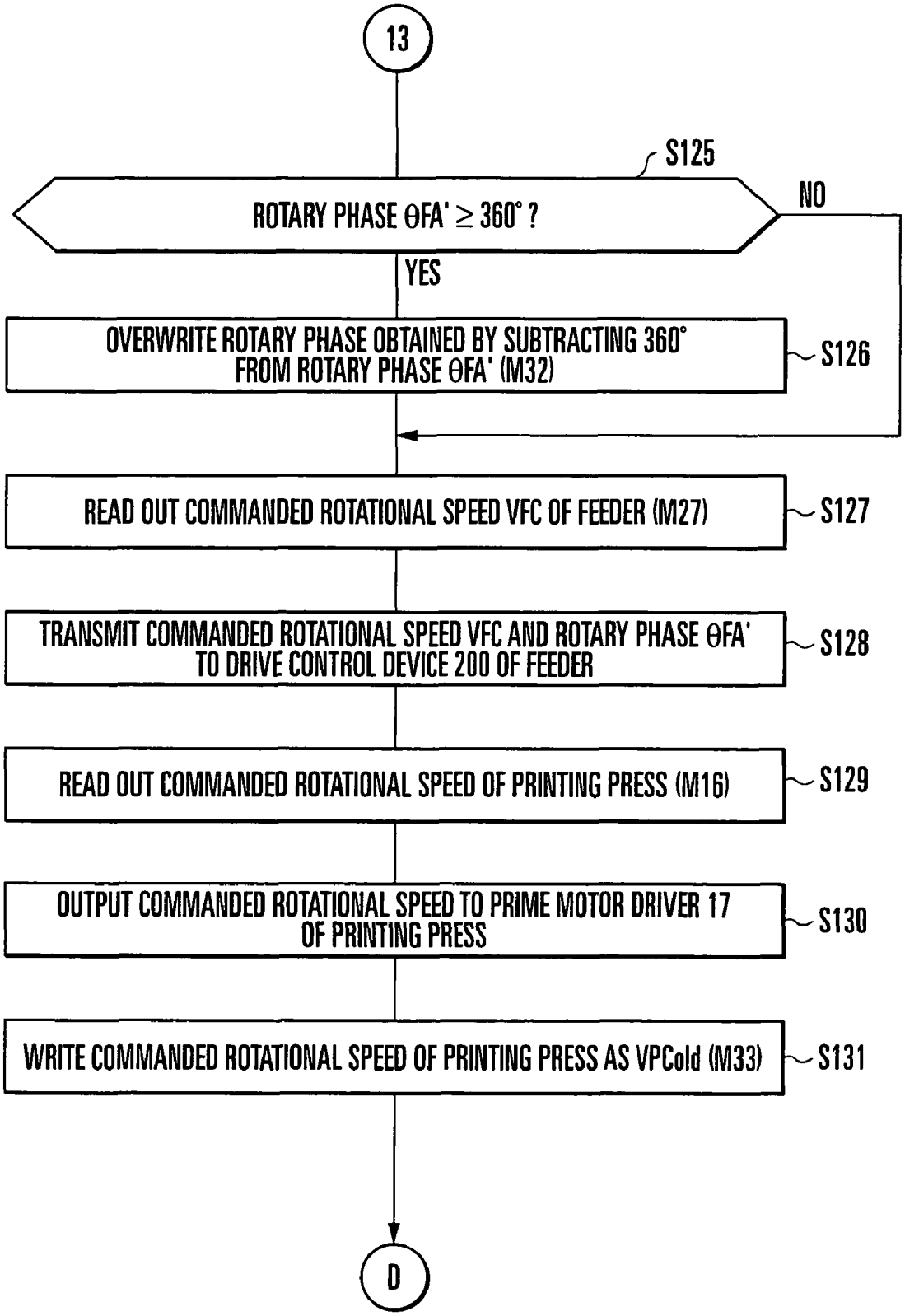
Figure 9G:
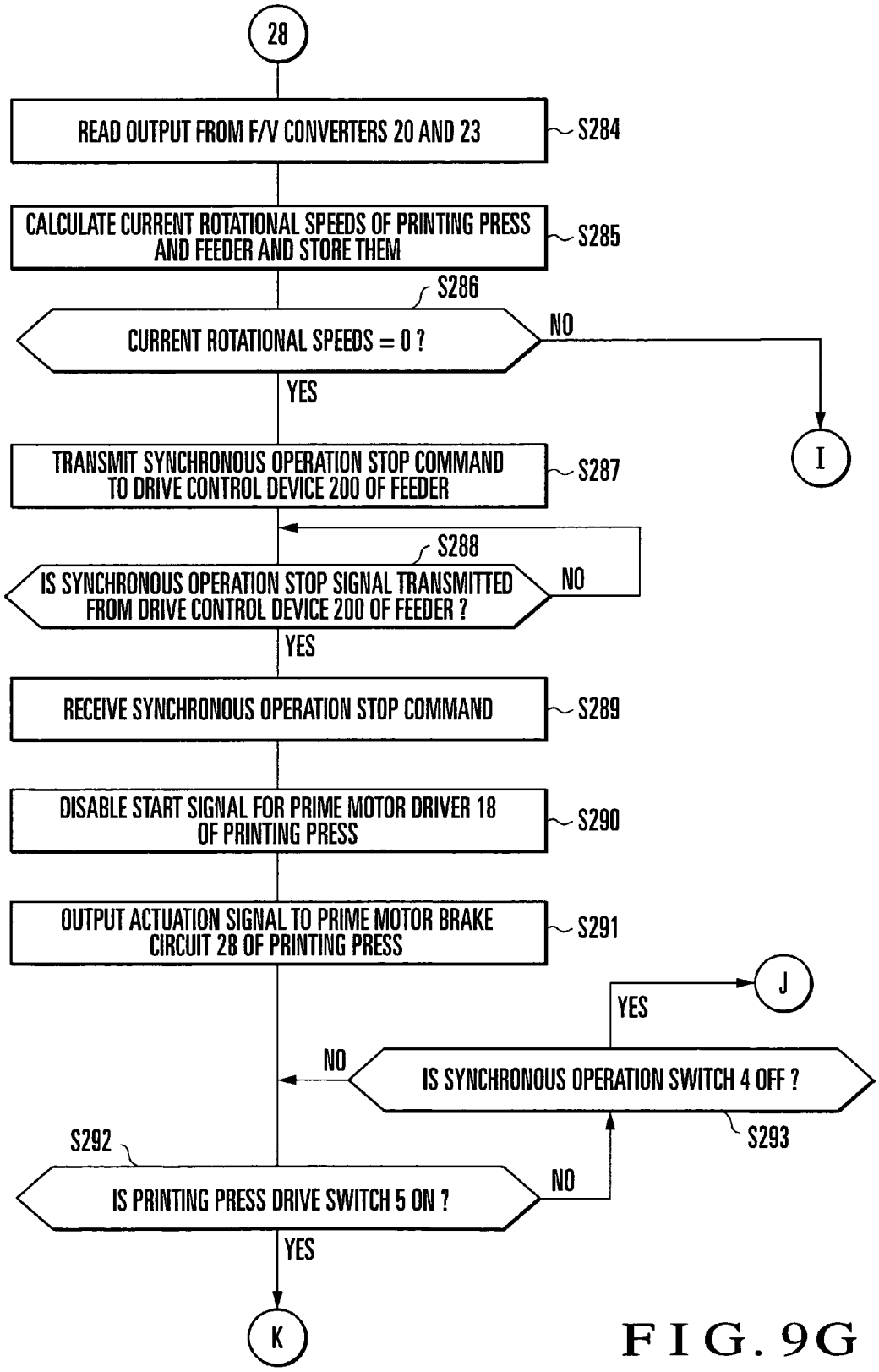
Figure 10:
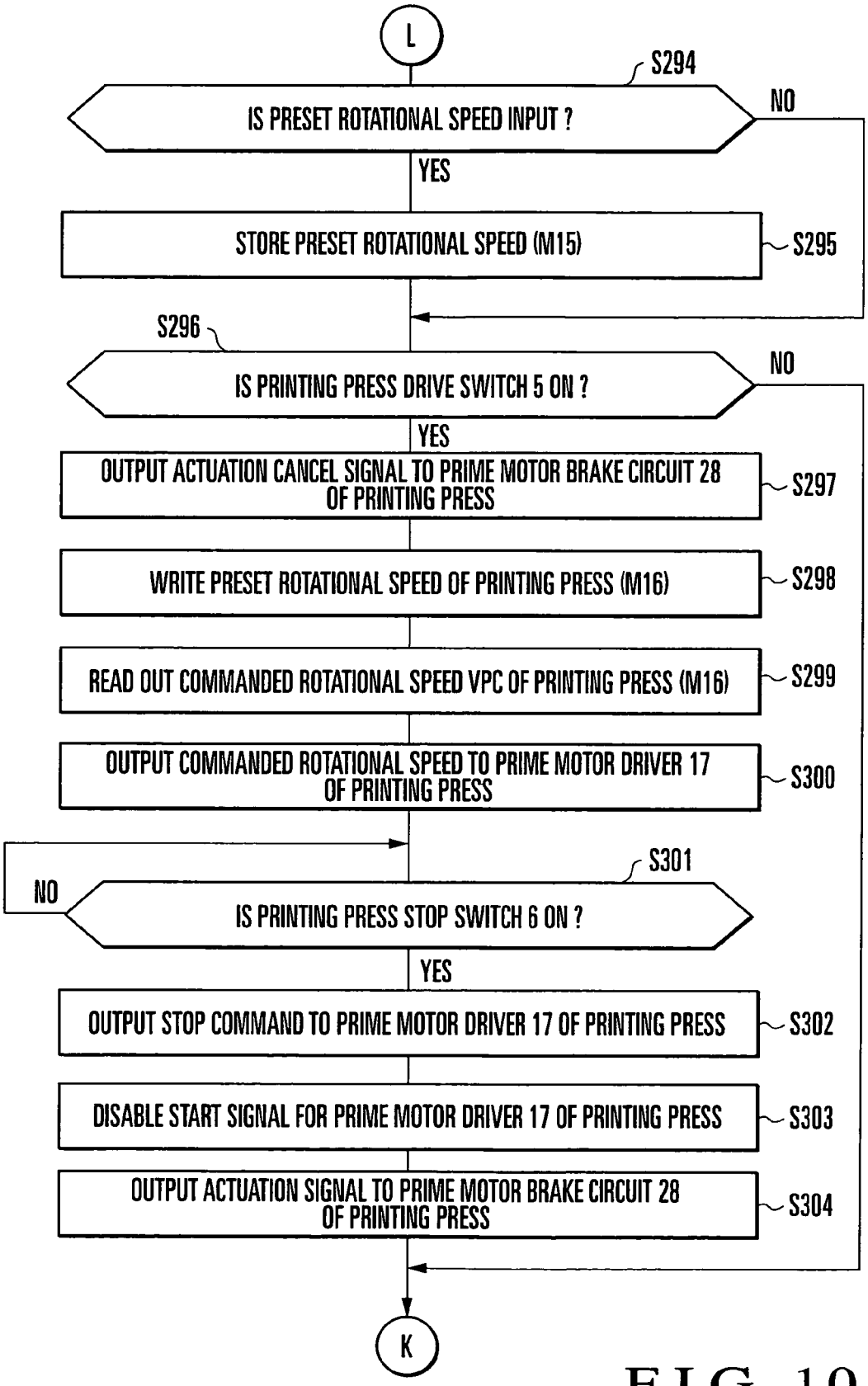
Figure 11:
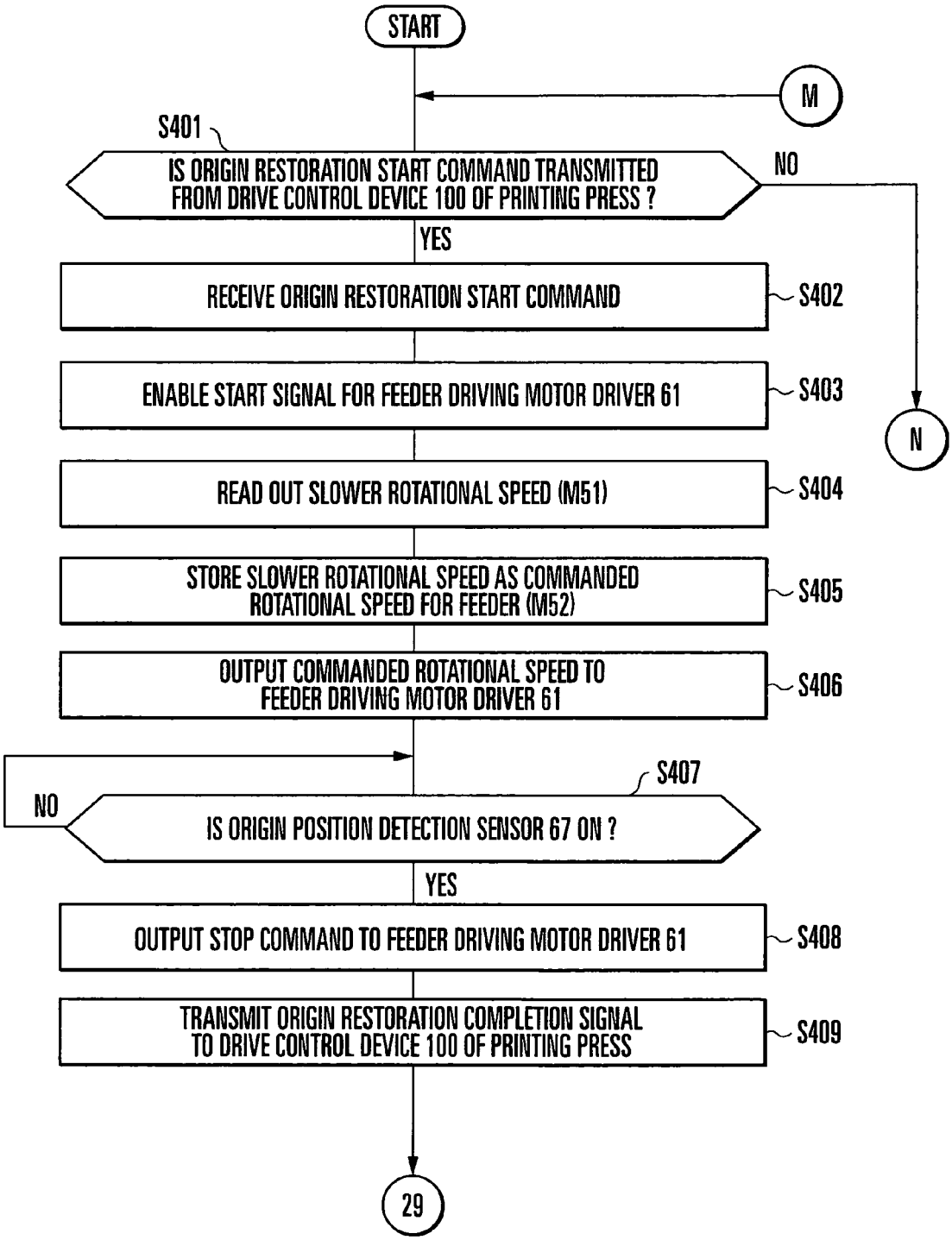

In this case, the operator turns on the printing press stop switch 6. If YES in step S54 (FIG. 6B), the CPU 1 of the drive control device 100 of the offset sheet-fed printing press advances to step S190 (FIG. 8A), and reads out the time interval T of transmission to the drive control device 200 of the feeder from the memory M20. The CPU 1 then reads the count of the internal clock counter 32 (step S191). When the count of the internal clock counter 32 becomes equal to or more than the transmission time interval T (YES in step S192), the CPU 1 advances to step S193, and performs the processes of steps S193 (FIG. 8A) to S230 (FIG. 8E) which are similar to those of steps S94 (FIG. 6G) to S131 (FIG. 6K). After that, the CPU 1 performs the processes of steps S231 (FIG. 9A) to S291 (FIG. 9G). This decreases the speed of the prime motor 18 of the offset sheet-fed printing press and that of the feeder driving motor driver 61 of the feeder to stop the prime motor 18 and feeder driving motor driver 61.

[Standalone Operation of Offset Sheet-Fed Printing Press]

When the synchronous operation switch 4 is turned off and the offset sheet-fed printing press drive switch 5 is turned on, if NO in step S9 (FIG. 5), the CPU 1 of the drive control device 100 of the offset sheet-fed printing press advances to step S294 (FIG. 10), loads the rotational speed VP of the printing press input from the rotational speed setter 15, and stores the rotational speed VP in the memory M15 as the preset rotational speed VPS (step S295).

Upon confirmation of the fact that the offset sheet-fed printing press drive switch 5 is ON (YES in step S296), the CPU 1 sends an actuation cancel signal to the prime motor brake circuit 28 of the offset sheet-fed printing press (step S297) to turn off the prime motor brake 29 of the offset sheet-fed printing press, and writes the preset rotational speed VPS in the memory M16 as the commanded rotational speed VPC (step S298). The CPU 1 also reads out the commanded rotational speed VPC written in the memory M16 (step S299) and outputs it to the prime motor driver 17 of the offset sheet-fed printing press (step S300). Thus, the prime motor 18 of the offset sheet-fed printing press rotates at the commanded rotational speed VPC, that is, the rotational speed VP input from the rotational speed setter 15, so that the printing press main body operates in a standalone state.

When the printing press stop switch 6 is turned on (YES in step S301), the CPU 1 outputs a stop command for the prime motor driver 17 of the offset sheet-fed printing press (step S302), disables a start signal for the prime motor driver 17 of the offset sheet-fed printing press (step S303), and outputs an actuation signal to the prime motor brake circuit 28 of the offset sheet-fed printing press (step S304). Thus, the prime motor brake 29 of the offset sheet-fed printing press is turned on to stop the prime motor 18 of the offset sheet-fed printing press.

[Standalone Operation of Feeder]

When a rotational speed VF of the feeder is input to the feeder rotational speed setter 59 (YES in step S468, FIG. 14), the CPU 51 of the drive control device 200 of the feeder reads it and stores it in the memory M61 as a preset rotational speed VFS (step S469).

When the feeder standalone drive switch 54 is turned on (YES in step S470), the CPU 51 sends an actuation cancel signal to the feeder driving motor brake circuit 68 (step S471) to turn off the feeder driving motor brake 69.

Then, the CPU 51 writes the preset rotational speed VFS in the memory 52 as the commanded rotational speed VFC (step S472), reads out the commanded rotational speed VPC written in the memory M52 (step S473) and outputs it to the feeder driving motor driver 61 (step S474). Thus, the feeder driving motor 62 rotates at the commanded rotational speed VFC, that is, the rotational speed VF input from the feeder rotational speed setter 59, so that the feeder operates in a standalone state.

When the feeder stop switch 55 is turned on (YES in step S475), the CPU 51 outputs a stop command for the feeder driving motor driver 61 (step S475), turns off a start signal for the feeder driving motor driver 61 (step S477), and outputs an actuation signal to the feeder driving motor brake circuit 68 (step S478). Thus, the feeder driving motor brake 69 is turned on to stop the feeder driving motor 62.

Although this embodiment is exemplified by a sheet-fed rotary printing press, the present invention is not limited to a sheet-fed rotary printing press. In the sheet-fed rotary printing press, the offset sheet-fed printing press corresponds to a sheet processing device which processes a sheet, and the feeder corresponds to a sheet feed device which feeds the sheet. The present invention can be applied to any sheet processing machine as far as it comprises such a sheet processing device and sheet feed device.

According to this embodiment, the rotary phase of the driving motor 62 of the feeder with respect to the rotary phase of the printing press main body of the offset sheet-fed printing press is adjusted. Alternatively, the rotary phase of the prime motor 18 of the offset sheet-fed printing press with respect to the rotary phase of the feeder driving motor 62 may be adjusted. In the case of a sheet-fed rotary printing press, if the rotary phase of the prime motor 18 is adjusted, printing misregistration or the like may occur. Hence, it is better to adjust the rotary phase of the feeder driving motor 62 rather than the rotary phase of the prime motor 18 of the offset sheet-fed printing press.

Although this embodiment is exemplified by a feeder (feed device) which employs conveyor tapes, the present invention can also be similarly applied to a roll type feed device which does not employ conveyor tapes. In a roll type feed device, slippage occurs only when a suction device feeds a sheet to a portion between a feed roller and feed roll. A table showing the relationship between the printing conditions and the correction value of the rotary phase may be determined considering the slip amount at this portion. In the roll type feed device, the relationship between the rotary phase of the offset sheet-fed printing press and the reference rotary phase of the feeder is linear. Thus, the process is easier than in a feed device that employs conveyor tapes.

In the embodiment described above, prior to the start of printing, printing conditions such as the type and thickness of the printing target object, the lengths of the printing target object in the convey direction and lateral direction, the rotational speed of the printing press, and the like are set. The printing conditions may be changed during printing. If the printing conditions are changed during printing, the rotary phase correction value HA of the feeder which is specific to the printing target object and the speed-specific rotary phase correction value HB of the feeder are calculated as values in accordance with the changed printing conditions, so that the rotary phase of the feeder is adjusted automatically.

Assume that after the rotary phase of the feeder is manually adjusted, the manually adjusted rotary phase correction value HC of the feeder is stored in accordance with the printing conditions. Then, when printing is to be performed under the same printing conditions, the rotary phase correction value HC is employed from the beginning. This can save the operator manual operation.

According to this embodiment, $\Delta\theta FRA' \leqq \Delta\theta Fth$ is maintained not only in ordinary printing speed but also during acceleration and deceleration. Thus, good printing products free from printing misregistration can be obtained throughout the entire period from the start of printing until the end of printing, so that the frequency of defective printing decreases.

For example, assume a compact offset sheet-fed printing press or the like in which the driving shaft of the prime motor 18 is drive-connected to the driven shaft of the printing press main body of the offset sheet-fed printing press through a gear, and slippage hardly occurs between the two shafts. In this case, the rotary phase of the printing press main body of the offset sheet-fed printing press may be detected indirectly from a signal from the prime motor rotary encoder 21 of the offset sheet-fed printing press.

Figure 18:
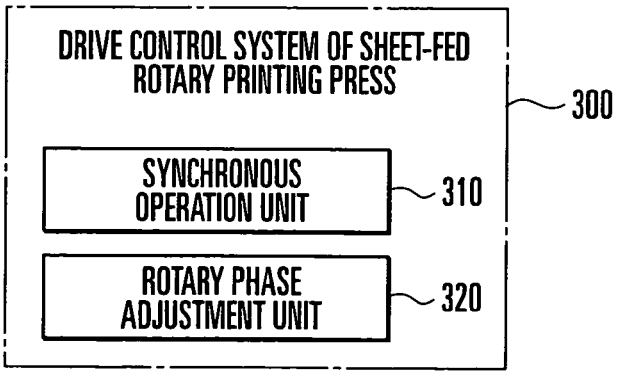
FIG. 18 is a block diagram showing the configuration of the drive control system of the sheet-fed rotary printing press.

The configuration of the main part of the drive control system of the sheet-fed rotary printing press described with reference to FIGS. 1 to 17 can be grasped in the following manner as well. More specifically, as shown in FIG. 18, a drive control system 300 of the sheet-fed rotary printing press comprises a synchronous operation unit 310 and rotary phase adjustment unit 320. The synchronous operation unit 310 operates the feeder driving motor 62 in synchronism with the rotary member of the offset sheet-fed printing press. For example, the synchronous operation unit 310 performs the processes of steps S132 to S169, S182 to S189, and S438 to S462. The rotary phase adjustment unit 320 adjusts the rotary phase of the rotary member of the offset sheet-fed printing press and the rotary phase of the feeder driving motor 62 relative to each other. For example, the rotary phase adjustment unit 320 performs the processes of steps S11 to S30 and S170 to S181.

Figure 19:
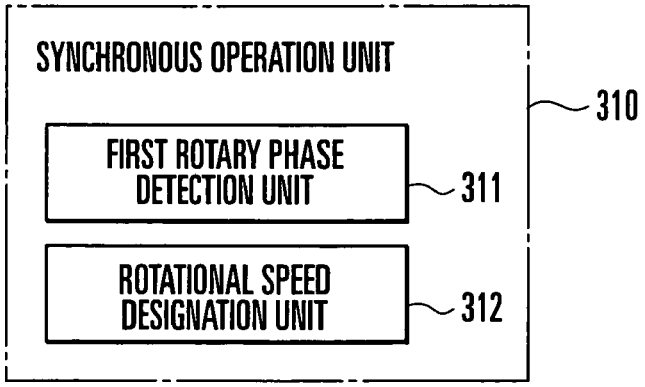
FIG. 19 is a block diagram showing the configuration of a synchronous operation unit in FIG. 18.

As shown in FIG. 19, the synchronous operation unit 310 comprises a first rotary phase detection unit 311 and rotational speed designation unit 312. The first rotary phase detection unit 311 detects the rotary phase of the rotary member of the offset sheet-fed printing press at a predetermined time interval T. For example, the first rotary phase detection unit 311 performs the processes of steps S148 to S152. Every time the rotary phase of the rotary member of the offset sheet-fed printing press is detected, the rotational speed designation unit 312 designates the rotary phase to the feeder driving motor 62 on the basis of the detected rotary phase. For example, the rotational speed designation unit 312 performs the processes of steps S132 to S147, S153 to S169, S182 to S185, and S438 to S462.

Figure 20:
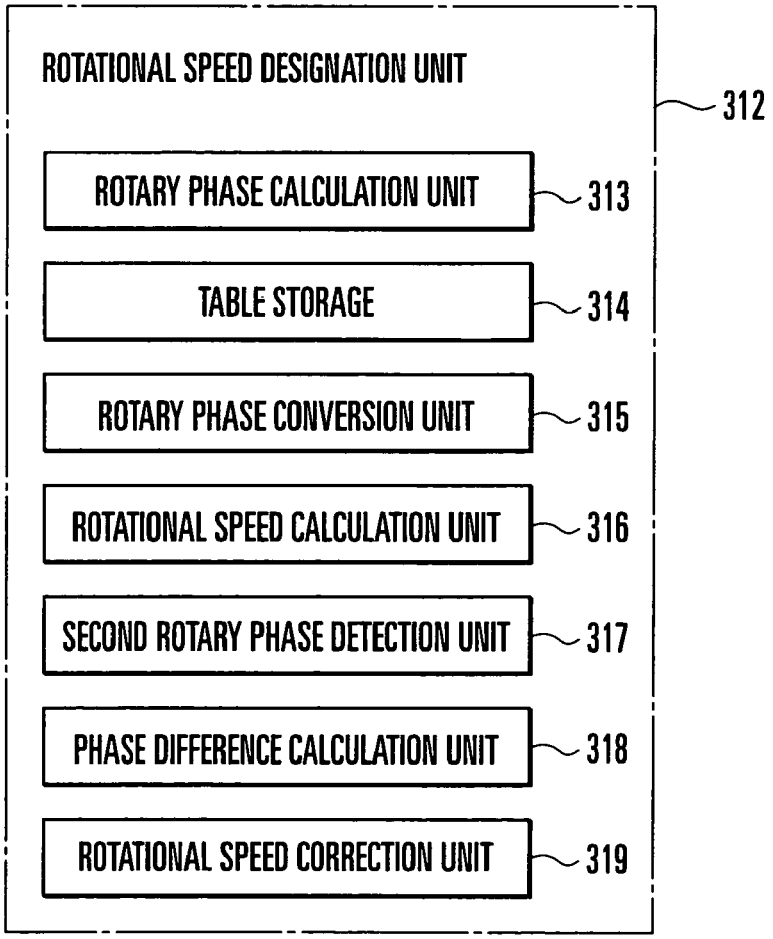
FIG. 20 is a block diagram showing the configuration of a rotational speed designation unit in FIG. 19.

As shown in FIG. 20, the rotational speed designation unit 312 comprises a rotary phase calculation unit 313, table storage 314, rotary phase conversion unit 315, rotational speed calculation unit 316, second rotary phase detection unit 317, phase difference calculation unit 318, and rotational speed correction unit 319.

On the basis of the rotary phase of the rotary member of the offset sheet-fed printing press which is detected by the first rotary phase detection unit 311, the rotary phase calculation unit 313 calculates the rotary phase of the rotary member of the offset sheet-fed printing press which is obtained at a lapse of the predetermined time T since the rotary phase is detected. For example, the rotary phase calculation unit 313 performs the processes of steps S134 to S147 and S153 to S159. The table storage 314 stores a table as shown in FIG. 17 which shows the relationship between the rotary phase of the rotary member of the offset sheet-fed printing press and the rotary phase of the feeder driving motor 62. According to this table, a change in rotary phase of the driving motor 62 of the feeder is small at the sheet feed start and sheet feed end, as described above, thus exhibiting a characteristic curve. The rotary phase conversion unit 315 converts the rotary phase detected by the first rotary phase detection unit 311 and the rotary phase calculated by the rotary phase calculation unit 313 at the lapse of the predetermined period of time T, respectively, into the rotary phases of the feeder driving motor 62 by looking up the table stored in the table storage 314. For example, the rotary phase conversion unit 315 performs the processes of steps S160 to S164. Thus, the rotary phases of the feeder driving motor 62 at a certain time point and a lapse of the time T after that can be obtained. The rotational speed calculation unit 316 calculates the rotational speed of the feeder driving motor 62 from the two rotary phases converted by the rotary phase conversion unit 315, and the predetermined time T. For example, the rotational speed calculation unit 316 performs the processes of steps S165 to S169. The second rotary phase detection unit 317, phase difference calculation unit 318, and rotational speed correction unit 319 will be described later.

Figure 21:
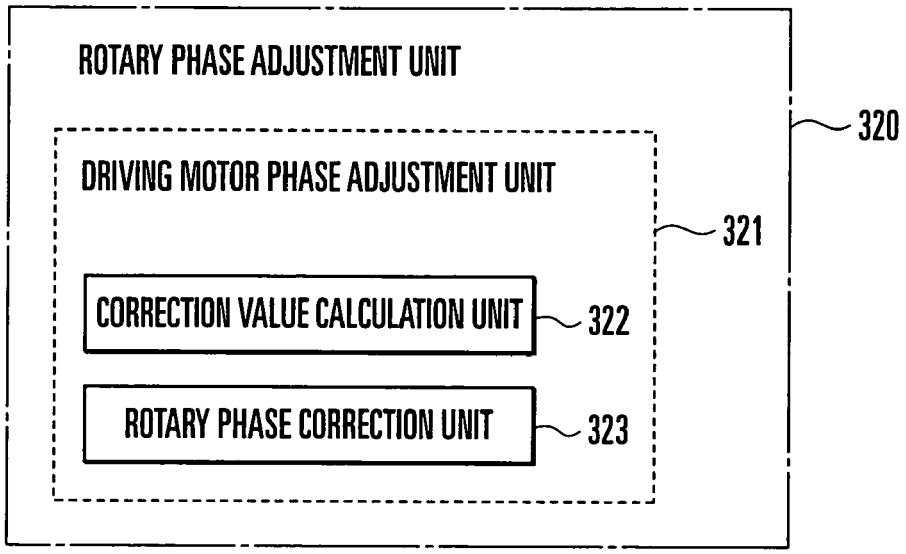
FIG. 21 is a block diagram showing the configuration of a rotary phase adjustment unit in FIG. 18.

As shown in FIG. 21, the rotary phase adjustment unit 320 comprises a driving motor phase adjustment unit 321 which adjusts the rotary phase of the feeder driving motor 62 with respect to the rotary phase of the rotary member of the offset sheet-fed printing press. For example, the rotary phase adjustment unit 320 performs the processes of steps S11 to S30 and S170 to S181.

The driving motor phase adjustment unit 321 comprises a correction value calculation unit 322 and rotary phase correction unit 323. The correction value calculation unit 322 calculates the correction value of the rotary phase of the feeder driving motor 62 with respect to the rotary phase of the rotary member of the offset sheet-fed printing press in accordance with the printing conditions. For example, the correction value calculation unit 322 performs the processes of steps S11 to S30 and S170 to S176.

Figure 22:
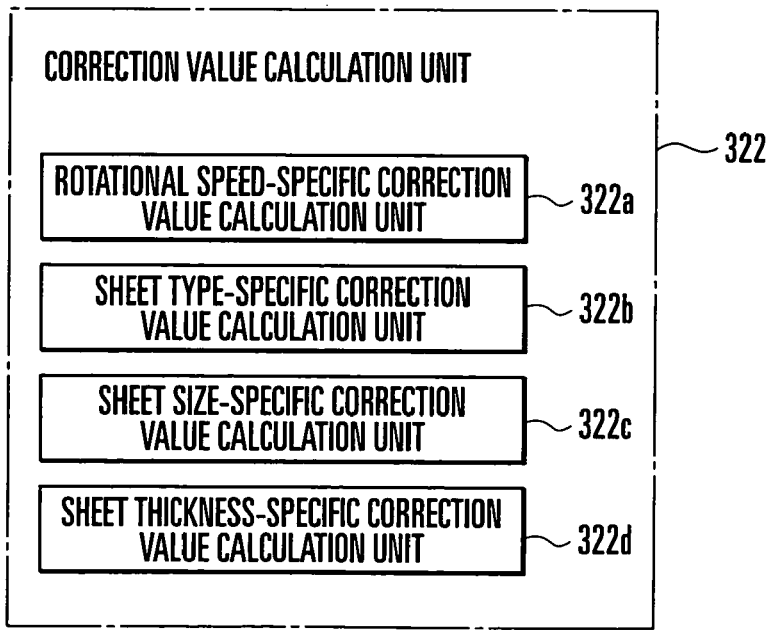
FIG. 22 is a block diagram showing the configuration of a correction value calculation unit in FIG. 21.
Figure 23:
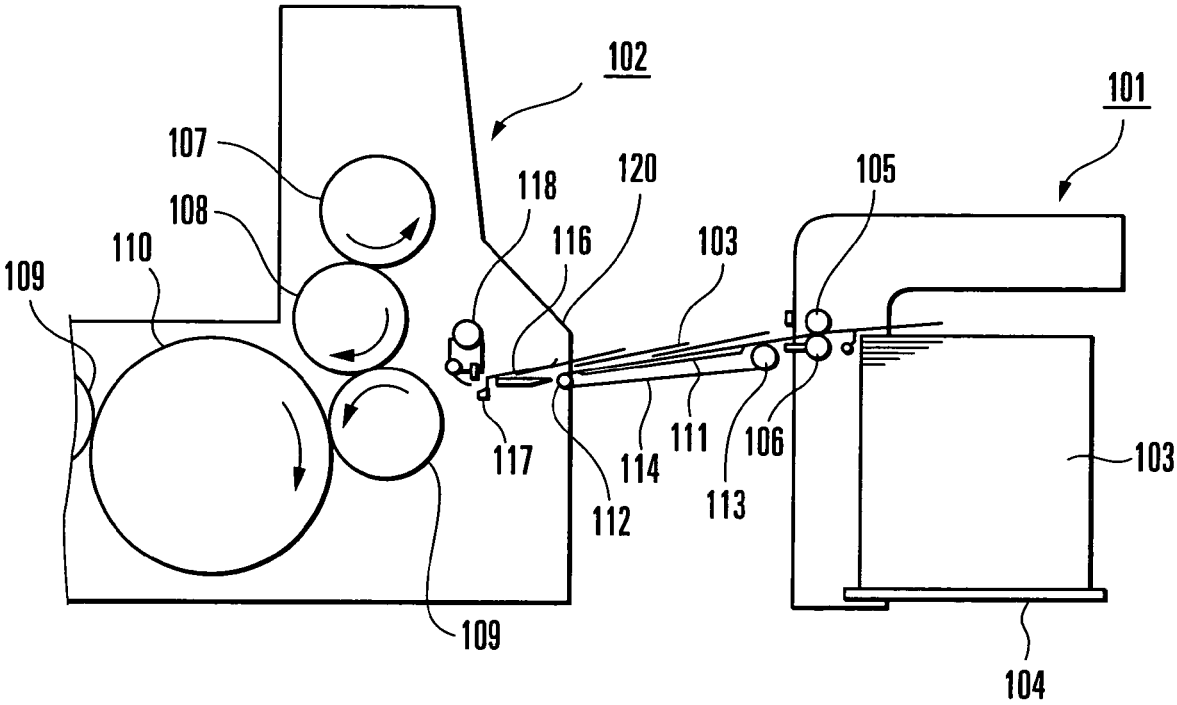
FIG.23 PRIOR ART
FIG. 23 is a side view of a sheet convey unit in the sheet-fed rotary printing press shown in reference 1.
Figure 24:
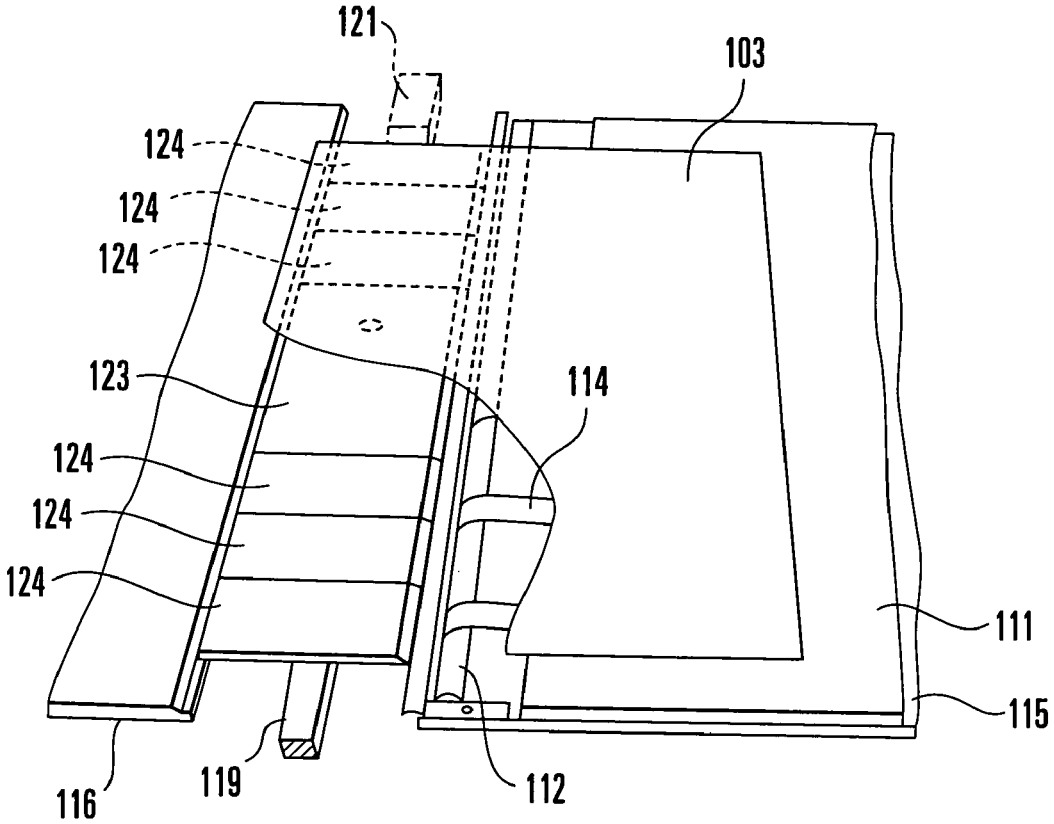
FIG.24 PRIOR ART
FIG. 24 is a perspective view of the feed convey unit in the sheet-fed rotary printing press shown in reference 1.
Figure 25:
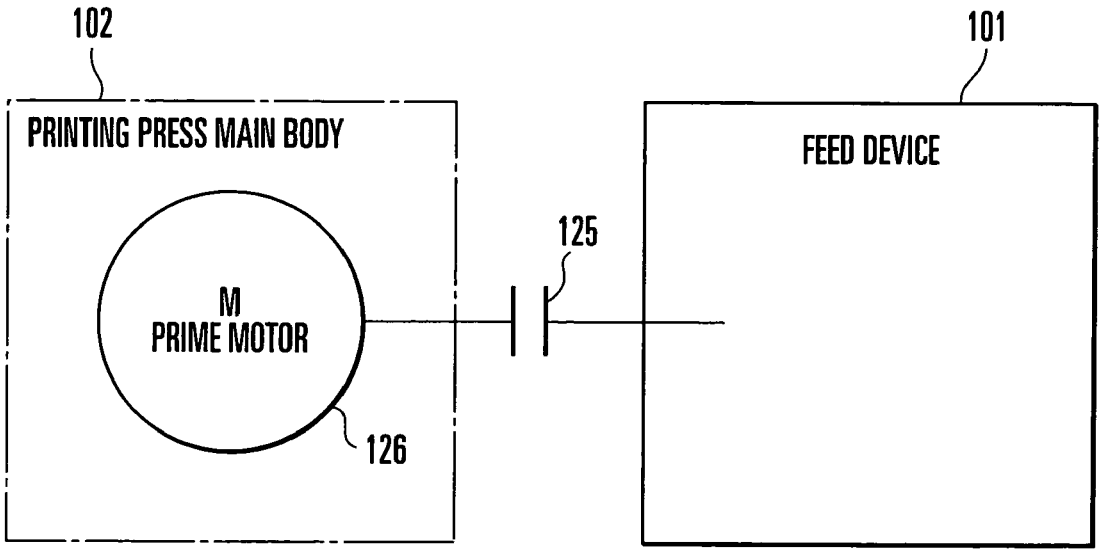
FIG.25 PRIOR ART
FIG. 25 is a schematic view showing the connection state of a printing press main body and feed device by a clutch in a conventional sheet-fed rotary printing press.

More specifically, as shown in FIG. 22, the correction value calculation unit 322 includes a rotational speed-specific correction value calculation unit 322*a*, a sheet type-specific correction value calculation unit 322*b*, a sheet size-specific correction value calculation unit 322*c*, and a sheet thickness-specific correction value calculation unit 322*d*. The rotational speed-specific correction value calculation unit 322*a* calculates the correction value in accordance with the rotational speed of the prime motor (driving motor) 18 of the offset sheet-fed printing press, and performs the processes of, e.g., steps S174 to S176. The sheet type-specific correction value calculation unit 322*b* calculates the correction value in accordance with the sheet type, and performs the processes of, e.g., steps S1 to S13. The sheet size-specific correction value calculation unit 322*c* calculates the correction value in accordance with the sheet size, and performs the processes of, e.g., steps S18 to S25. The sheet thickness-specific correction value calculation unit 322*d* calculates the correction value in accordance with the sheet thickness, and performs the processes of, e.g., steps S14 to S17.

The rotary phase correction unit 323 corrects the rotary phase of the feeder driving motor 62, obtained by conversion of the rotary phase detected by the first rotary phase detection unit 311 using the correction value calculated by the correction value calculation unit 322. For example, the rotary phase correction unit 323 performs the processes of steps S177 to S181.

In the rotational speed designation unit 312, the second rotary phase detection unit 317 detects the actual rotary phase of the feeder driving motor 62. For example, the second rotary phase detection unit 317 performs the processes of steps S440 and S441. The phase difference calculation unit 318 calculates the phase difference between the rotary phase corrected by the rotary phase correction unit 323 and the actual rotary phase detected by the second rotary phase detection unit 317. For example, the phase difference calculation unit 318 performs the processes of steps S442 to S445. When the phase difference calculated by the phase difference calculation unit 318 is outside of tolerance range, the rotational speed correction unit 319 corrects the rotational speed to be designated to the feeder driving motor 62 in accordance with the phase difference. For example, the rotational speed correction unit 319 performs the processes of steps S452 to S454 and S457 and S462.

According to this invention, the driving motor of the sheet processing device drives the sheet processing device, and the driving motor of the sheet feed device drives the sheet feed device. For example, if the sheet processing device is a printing press main body and the sheet feed device is a feed device, the prime motor drives the printing press main body, and the standalone motor drives the feed device. More specifically, the standalone motor provided independently of the prime motor that drives the printing press main body drives the feed device. The standalone motor is operated in synchronism with the printing press main body which is driven by the prime motor, so that the sheet is fed from the feed device to the printing press main body. During this synchronous operation, the timing (the timing of transferring the sheet to the swing arm shaft pregripper) of feeding the sheet from the feed device to the printing press main body can be set at an appropriate timing without stopping the sheet processing machine, by adjusting the rotary phase of the rotary member of the printing press main body and the rotary phase of the standalone motor of the feed device relative to each other.

When adjusting the rotary phase of the rotary member of the sheet processing device and the rotary phase of the driving motor of the sheet feed device relative to each other, the rotary phase of the driving motor of the sheet feed device with respect to the rotary phase of the rotary member of the sheet processing device may be adjusted, or the rotary phase of the driving motor of the sheet processing device with respect to the rotary phase of the driving motor of the sheet feed device may be adjusted.

The correction value of the driving motor of the sheet feed device with respect to the rotary phase of the rotary member of the sheet processing device may be obtained in accordance with the printing conditions. For example, if the sheet processing device is a printing press main body and the sheet feed device is a feed device, the printing conditions such as the speed of the printing machine (e.g., the speed of final printing), the size, thickness and quality of the sheet, and the like are included as the sheet processing conditions, and the correction value of the rotary phase of the standalone motor corresponding to these sheet processing conditions is obtained. Then, at the start of printing, the correction value of the rotary phase corresponding to the given sheet processing conditions can be obtained automatically, so that the rotary phase is adjusted automatically. In this case, the automatically adjusted rotary phase can be adjusted later on manually without stopping the sheet processing machine. Also, the rotary phase can be adjusted automatically by changing the sheet processing conditions during printing. Therefore, every time the sheet processing conditions are changed, the correction value of the rotary phase corresponding to the new sheet processing conditions can be obtained automatically, so that the rotary phase can be adjusted automatically.

What is claimed is:

1. A drive control method for a sheet processing machine, comprising the steps of:

operating a driving motor of a sheet feed device which feeds a sheet to a sheet processing device that processes the sheet, wherein the operating the driving motor is synchronously performed with operation of a rotary member of the sheet processing device so as to keep the driving motor in a predetermined rotary phase relationship with the rotary member of the sheet processing device; and adjusting a rotary phase of the rotary member of the sheet processing device and a rotary phase of the driving motor of the sheet feed device relative to each other.

2. A method according to claim 1, wherein the step of adjusting comprises the step of adjusting the rotary phase of the driving motor of the sheet feed device with respect to the rotary phase of the rotary member of the sheet processing device.

3. A method according to claim 2, further comprising the step of calculating a correction value of the rotary phase of the driving motor of the sheet feed device with respect to the rotary phase of the rotary member of the sheet processing device in accordance with a rotational speed of a driving motor of the sheet processing device.

4. A method according to claim 2, further comprising the step of calculating a correction value of the rotary phase of the driving motor of the sheet feed device with respect to the rotary phase of the rotary member of the sheet processing device in accordance with a type of the sheet.

5. A method according to claim 2, further comprising the step of calculating a correction value of the rotary phase of the driving motor of the sheet feed device with respect to the rotary phase of the rotary member of the sheet processing device in accordance with a size of the sheet.

6. A method according to claim 2, further comprising the step of calculating a correction value of the rotary phase of the driving motor of the sheet feed device with respect to the rotary phase of the rotary member of the sheet processing device in accordance with a thickness of the sheet.

7. A drive control apparatus for a sheet processing machine, comprising:

synchronous operation means for operating a driving motor of a sheet feed device which feeds a sheet to a sheet processing device that processes the sheet, in synchronism with a rotary member of said sheet processing device so as to keep the driving motor in a predetermined rotary phase relationship with the rotary member of the sheet processing device; and rotary phase adjustment means for adjusting a rotary phase of said rotary member of said sheet processing device and a rotary phase of said driving motor of said sheet feed device relative to each other.

8. An apparatus according to claim 7, wherein said rotary phase adjustment means comprises driving motor phase adjustment means for adjusting the rotary phase of said driving motor of said sheet feed device with respect to the rotary phase of said rotary member of said sheet processing device.

9. An apparatus according to claim 8, wherein said driving motor phase adjustment means comprises rotational speed-specific correction value calculation means for calculating a correction value of the rotary phase of said driving motor of said sheet feed device with respect to the rotary phase of said rotary member of said sheet processing device in accordance with a rotational speed of a driving motor of said sheet processing device.

10. An apparatus according to claim 8, wherein said driving motor phase adjustment means comprises sheet type-specific correction value calculation means for calculating a correction value of the rotary phase of said driving motor of said sheet feed device with respect to the rotary phase of said rotary member of said sheet processing device in accordance with a sheet type.

11. An apparatus according to claim 8, wherein said driving motor phase adjustment means comprises sheet size-specific correction value calculation means for calculating a correction value of the rotary phase of said driving motor of said sheet feed device with respect to the rotary phase of said rotary member of said sheet processing device in accordance with a sheet size.

12. An apparatus according to claim 8, wherein said driving motor phase adjustment means comprises sheet thickness-specific correction value calculation means for calculating a correction value of the rotary phase of said driving motor of said sheet feed device with respect to the rotary phase of said rotary member of said sheet processing device in accordance with a sheet thickness.

13. An apparatus according to claim 7, wherein said synchronous operation means comprises first rotary phase detection means for detecting the rotary phase of said rotary member of said sheet processing device at a predetermined time interval, and rotational speed designation means for designating a rotational speed, every time said first rotary phase detection means detects the rotary phase, to said driving motor of said sheet feed device on the basis of the detected rotary phase.

14. An apparatus according to claim 13, wherein said rotational speed designation means comprises rotary phase calculation means for calculating the rotary phase of said rotary member of said sheet processing device, on the basis of the rotary phase detected by said first rotary phase detection means, at a lapse of predetermined period of time since the rotary phase is detected, rotary phase conversion means for converting the detected rotary phase and the calculated rotary phase respectively into rotary phases of said driving motor of said sheet feed device, and rotational speed calculation means for calculating the rotational speed of said driving motor of said sheet feed device from the two rotary phases obtained by conversion and the predetermined period of time.

15. An apparatus according to claim 14, wherein said rotational speed designation means further comprises table storage means for storing a table showing a relationship between the rotary phase of said rotary member of said sheet processing device and the rotary phase of said driving motor of said sheet feed device, according to which a change in rotary phase of said driving motor of said feed device is small at a sheet feed start and a sheet feed end, thus exhibiting a characteristic curve, and said rotary phase conversion means performs conversion by looking up said table stored in said table storage means.

16. An apparatus according to claim 14, wherein said rotary phase adjustment means comprises rotary phase correction means for correcting the rotary phase of said driving motor of said sheet feed device, which is obtained by conversion of the rotary phase detected by said first rotary phase detection means, in accordance with at least one of the rotational speed of said driving motor of said sheet processing device, a sheet type, a sheet size, and a sheet thickness, and said rotation speed designation means further comprises second rotary phase detection means for detecting an actual rotary phase of said driving motor of said sheet feed device, phase difference calculation means for calculating a phase difference between the rotary phase corrected by said rotary phase correction means and the actual rotary phase detected by said second rotary phase detection means, and rotational speed correction means for correcting the rotational speed calculated by said rotational speed calculation means in accordance with the phase difference when the phase difference is outside of an allowable range.

* * * * *